US010842716B2

(12) United States Patent
Zollinger et al.

(10) Patent No.: US 10,842,716 B2
(45) Date of Patent: Nov. 24, 2020

(54) CAROUSEL FOR AUTOMATIC DRUG COMPOUNDER

(71) Applicant: CareFusion 303, Inc., San Diego, CA (US)

(72) Inventors: Christopher J. Zollinger, Chino Hills, CA (US); George Michel Mansour, Pomona, CA (US); Kraig Kruger, San Diego, CA (US)

(73) Assignee: CAREFUSION 303, INC., San Diego, CA (US)

( * ) Notice: Subject to any disclaimer, the term of this patent is extended or adjusted under 35 U.S.C. 154(b) by 18 days.

(21) Appl. No.: 15/781,074

(22) PCT Filed: Dec. 1, 2016

(86) PCT No.: PCT/US2016/064347

§ 371 (c)(1),
(2) Date: Jun. 1, 2018

(87) PCT Pub. No.: WO2017/095999

PCT Pub. Date: Jun. 8, 2017

(65) Prior Publication Data

US 2018/0360689 A1 Dec. 20, 2018

Related U.S. Application Data

(60) Provisional application No. 62/263,576, filed on Dec. 4, 2015.

(51) Int. Cl.

| | |
|---|---|
| ***A61J 1/20*** | (2006.01) |
| ***A61J 3/00*** | (2006.01) |
| ***A61J 1/10*** | (2006.01) |

(52) U.S. Cl.

CPC ..... *A61J 1/2089* (2013.01); *A61J 1/10* (2013.01); *A61J 1/201* (2015.05); *A61J 1/2037* (2015.05);

(Continued)

(58) Field of Classification Search
None
See application file for complete search history.

(56) References Cited

U.S. PATENT DOCUMENTS

| | | | | |
|---|---|---|---|---|
| 9,675,519 | B2 * | 6/2017 | Chang | B01F 13/1055 |
| 2012/0241042 | A1 * | 9/2012 | Strangis | B65B 7/28 141/2 |

FOREIGN PATENT DOCUMENTS

| | | | |
|---|---|---|---|
| CN | 101322087 | A | 12/2008 |
| CN | 105013359 | A | 11/2015 |

(Continued)

OTHER PUBLICATIONS

International Preliminary Report on Patentability for Application No. PCT/US2016/064347, dated Nov. 6, 2017, 15 pages.

(Continued)

*Primary Examiner* — Jessica Cahill
*Assistant Examiner* — Christopher M Afful
(74) *Attorney, Agent, or Firm* — Morgan, Lewis & Bockius LLP

(57) ABSTRACT

A carousel configured to house a plurality of pump cartridges for a compounder system is provided. The carousel may include a plurality of cartridge pockets each having an extended portion that covers a portion of a cartridge and a bottom surface having an extension with a recess. The bottom surface recess of each cartridge pocket may be shaped and sized to receive a needle housing of a pump cartridge in the cartridge pocket. A recess may be provided in the extended portion of each pocket that receives a protrusion that extends from a top surface of a backpack coupled to the pump cartridge to secure the pump cartridge in the cartridge pocket. The bottom surface recess may have an additional bottom surface that prevents actuation of the needle housing of the pump cartridge.

8 Claims, 48 Drawing Sheets

(52) U.S. Cl.
CPC ..... *A61J 1/2048* (2015.05); *A61J 1/2096* (2013.01); *A61J 3/002* (2013.01); *A61J 2200/74* (2013.01)

(56) References Cited

FOREIGN PATENT DOCUMENTS

| | | | |
|---|---|---|---|
| EP | 2223714 | A1 | 9/2010 |
| EP | 2552786 | A2 | 2/2013 |
| JP | 2004154314 | A | 6/2004 |
| JP | 2006051177 | A | 2/2006 |
| WO | WO-2012109032 | A1 | 8/2012 |

OTHER PUBLICATIONS

International Search Report and Written Opinion for Application No. PCT/US2016/064347, dated May 2, 2017, 12 pages.
Chinese Office Action for Application No. 201680079783.4, dated Apr. 16, 2020, 12 pages.

* cited by examiner

CAROUSEL FOR AUTOMATIC DRUG COMPOUNDER

TECHNICAL FIELD

The present disclosure generally relates to an apparatus that reconstitutes, mixes, and delivers a drug from a vial to a receiving container. Specifically, the present disclosure relates to a replaceable carousel that holds an array of cartridges each with multiple flow paths to allow reconstitution of a drug, delivery of diluents from hung diluent bags and diluent vials to medication vials, filling of a receiving container, and removal of waste to a waste container. The replaceable carousel is capable of holding the cartridges and managing the tubes used to fill the receiving containers from the cartridges.

BACKGROUND

Pharmaceutical compounding is the practice of creating a specific pharmaceutical product to fit the unique need of a patient. In practice, compounding is typically performed by a pharmacist, tech or a nurse who combines the appropriate ingredients using various tools. One common form of compounding comprises the combination of a powdered drug formulation with a specific diluent to create a suspended pharmaceutical composition. These types of compositions are commonly used in intravenous/parenteral medications. It is vital that the pharmaceuticals and diluents are maintained in a sterile state during the compounding process, and there exists a need for automating the process while maintaining the proper mixing characteristics (i.e. certain pharmaceuticals must be agitated in specific ways so that the pharmaceutical is properly mixed into solution but the solution is not frothed and air bubbles are not created). There exists a need for a compounding system that is easy to use, may be used frequently, efficiently, is reliable, and reduces user error.

SUMMARY

A carousel configured to house a plurality of pump cartridges for a compounder system is provided.

In accordance with an embodiment, a carousel for a compounder system is provided, the carousel including a cartridge pocket configured to receive a pump cartridge for the compounder system; a top surface having a plurality of extensions configured to extend over the pump cartridge; a bottom surface having an extension with a recess, the bottom surface recess configured to receive a needle housing of the pump cartridge; and a recess in the top surface configured to receive a protrusion that extends from a top surface of a backpack coupled to the pump cartridge to secure the pump cartridge in the cartridge pocket.

In accordance with another embodiment, a method is provided that includes providing a carousel having a plurality of cartridge pockets disposed about a periphery of the carousel; providing a cartridge and backpack assembly in each cartridge pocket of the carousel; and providing the carousel having the cartridge and backpack assemblies onto a carousel hub of a compounder system.

In accordance with another embodiment, a compounder system is provided that includes a carousel hub having a shape; a carousel that includes a plurality of cartridge pockets each configured to receive a pump cartridge and a central opening having a shape that corresponds to the shape of the carousel hub; and a vial and carousel drive assembly configured to rotate the carousel hub to rotate the carousel to move a selected one of the pump cartridges to a position adjacent to a pump head assembly of the compounder system.

BRIEF DESCRIPTION OF THE DRAWINGS

The accompanying drawings, which are included to provide further understanding and are incorporated in and constitute a part of this specification, illustrate disclosed embodiments and together with the description serve to explain the principles of the disclosed embodiments. In the drawings.

DETAILED DESCRIPTION

The detailed description set forth below describes various configurations of the subject technology and is not intended to represent the only configurations in which the subject technology may be practiced. The detailed description includes specific details for the purpose of providing a thorough understanding of the subject technology. Accordingly, dimensions may be provided in regard to certain aspects as non-limiting examples. However, it will be apparent to those skilled in the art that the subject technology may be practiced without these specific details. In some instances, well-known structures and components are shown in block diagram form in order to avoid obscuring the concepts of the subject technology.

It is to be understood that the present disclosure includes examples of the subject technology and does not limit the scope of the appended claims. Various aspects of the subject technology will now be disclosed according to particular but non-limiting examples. Various embodiments described in the present disclosure may be carried out in different ways and variations, and in accordance with a desired application or implementation.

The present system comprises multiple features and technologies that in conjunction form a compounding system that can efficiently reconstitute pharmaceuticals in a sterile environment and deliver the compounded pharmaceutical to a delivery bag for use on a patient.

Figure 1:
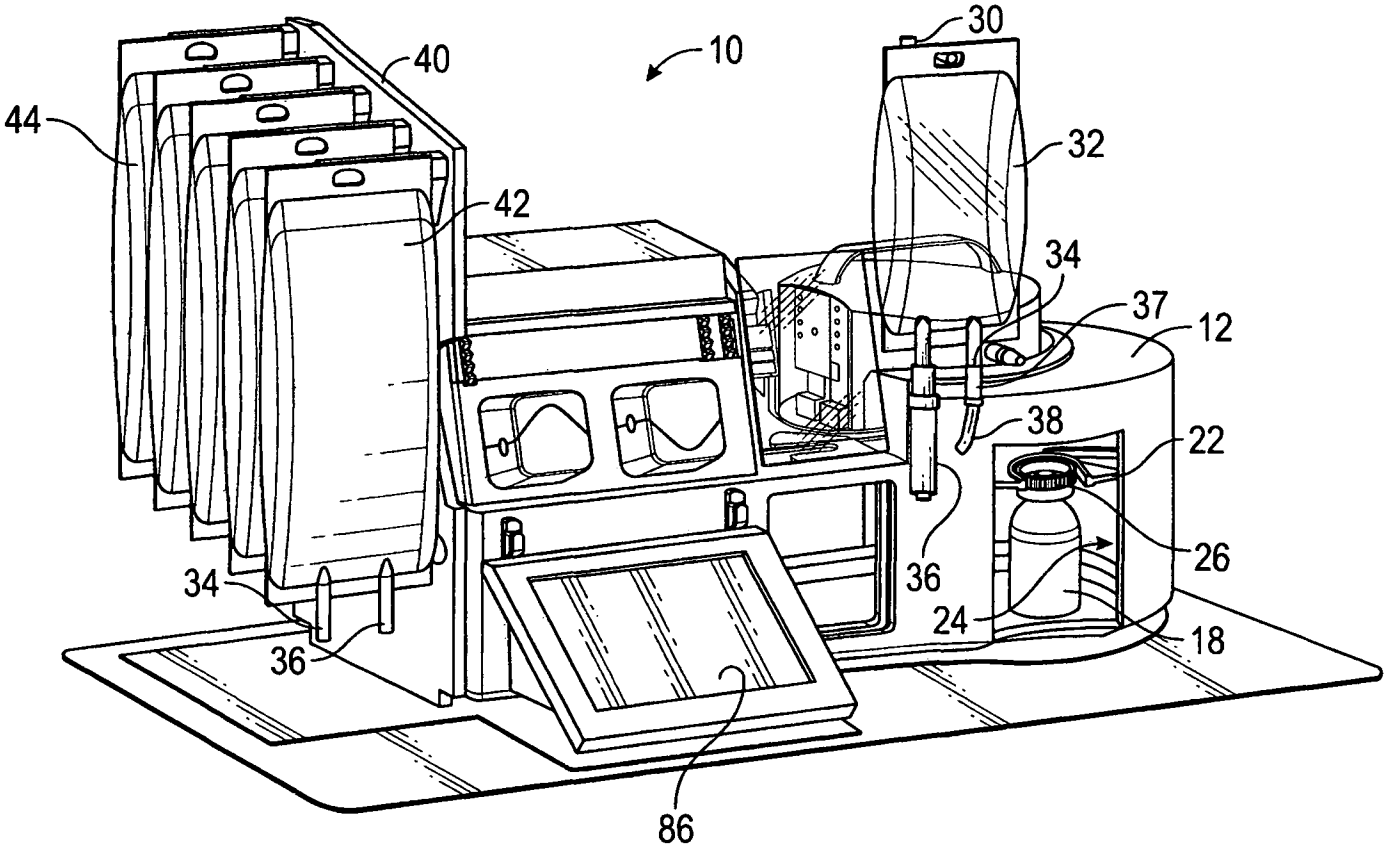
FIG. 1 illustrates a front perspective view of an example of an exemplary embodiment of a compounding system in accordance with aspects of the present disclosure.
Figure 2:
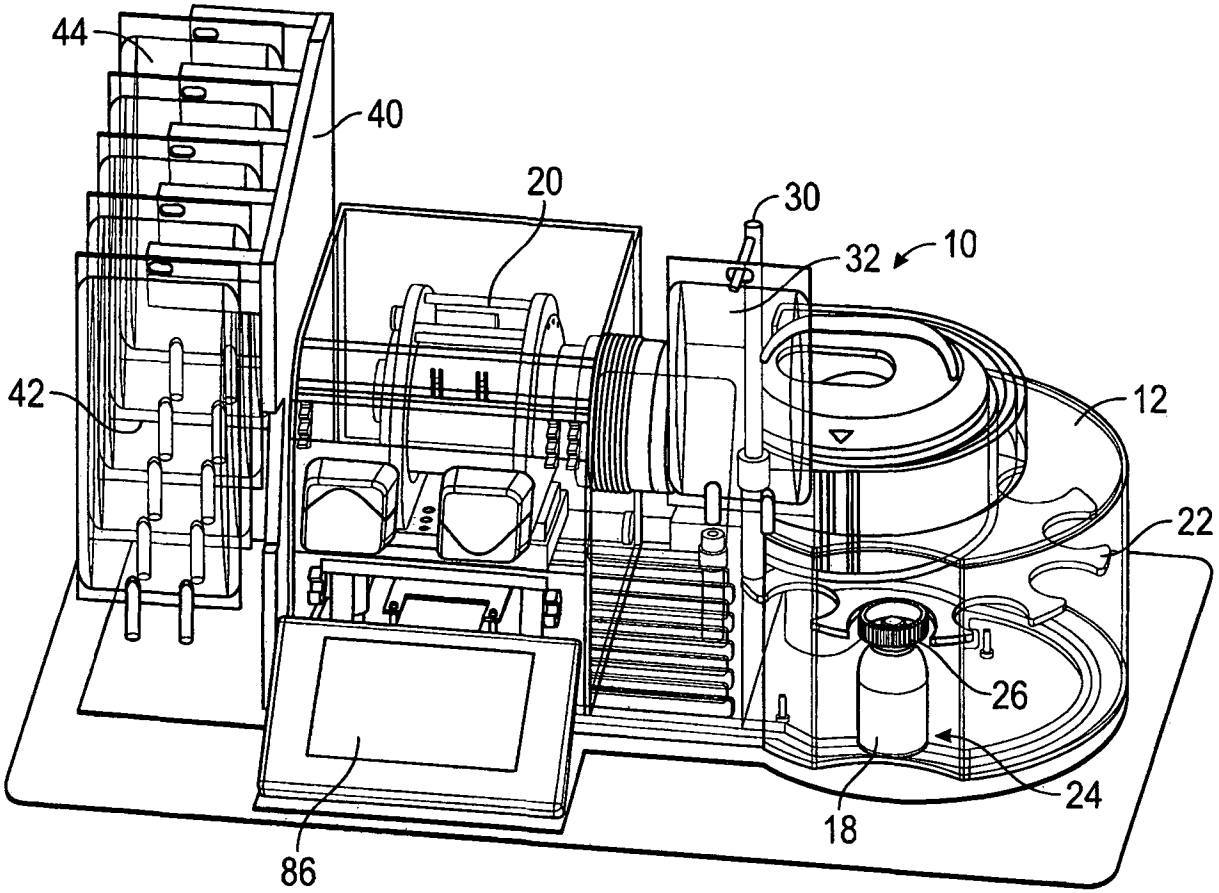
FIG. 2 illustrates a front perspective view of the compounding system of FIG. 1 with a transparent housing in accordance with aspects of the present disclosure.
Figure 3:
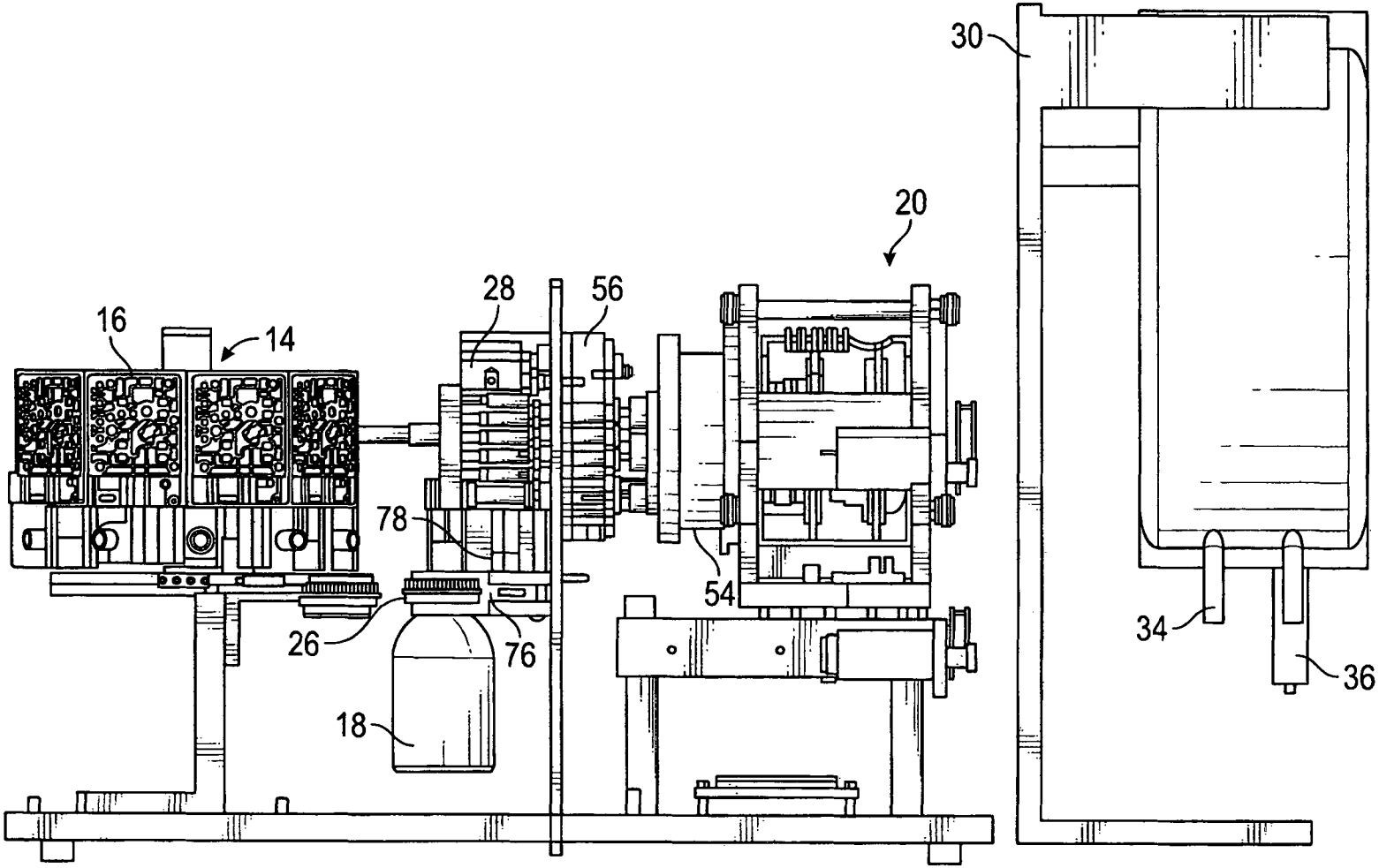
FIG. 3 illustrates a side view of the compounding system of FIG. 1 with the housing removed in accordance with aspects of the present disclosure.

FIG. 1 illustrates a compounder system 10 according to an embodiment. FIG. 2 illustrates the system 10 with a transparent outer housing 12 and FIG. 3 illustrates the system with the housing removed. The system comprises a carousel assembly 14 that contains up to 10 individual cartridges 16. The carousel 14 can hold more or less cartridges 16 if desired. The cartridges 16 are disposable and provide unique fluid paths between a vial 18 containing a powdered drug (or concentrated liquid drug), multiple diluents, and a receiving container. The cartridges 16 may, if desired, also provide a fluid path to a vapor waste container. However, in other embodiments, filtered or unfiltered non-toxic waste may be vented from the compounder to the environment reducing or eliminating the need for a waste port. Each cartridge contains a piston pump and valves that control the fluid intake, outtake, and fluid path selection during the steps of the compounding process as the fluid moves through the cartridge and into a receiving container.

The carousel assembly 14 is mounted on the apparatus such that it can rotate to bring different cartridges 16 into alignment with the pump drive mechanism 20. The carousel 14 is typically enclosed within a housing 12 that can be opened in order to replace the carousel 14 with a new carousel 14 after removing a used one. As illustrated, the carousel 14 can contain up to 10 cartridges 16, allowing a particular carousel to be used up to 10 times. In this configuration, each carousel assembly can support, for example, 10 to 100 receiving containers, depending on the type of compounding to be performed. For example, for hazardous drug compounding, a carousel assembly can support compounding to ten receiving containers. In another example, for non-hazardous drug compounding such as antibiotic or pain medication compounding, a carousel assembly can support compounding to 100 receiving containers. The housing 12 also includes a star wheel 22 positioned underneath the carousel 14. The star wheel 22 rotates vials 18 of pharmaceuticals into position either in concert with, or separate from, the specific cartridges 16 on the carousel 14. The housing 12 may also include an opening 24 for loading the vials 18 into position on the star wheel 22.

Each one of the cartridges 16 in the carousel 14 is a disposable unit that includes multiple pathways for the diluent and vapor waste. Each cartridge 16 is a small, single disposable unit that may also include a "backpack" in which a tube for connection to the receiving container (e.g., an IV bag, a syringe, or an elastomeric bag) may be maintained. Each cartridge 16 also may also include a pumping mechanism such as a piston pump for moving fluid and vapor through the cartridge 16 as well as a duel lumen needle in a housing that can pierce a vial puck 26 on top of a vial 18 once the vial 18 has been moved into position by the pump drive mechanism 20. For example, the needle may pierce the vial puck 26 via the compressive action of the vial puck 26, which is moved towards the needle. Each cartridge 16 also includes a plurality of ports designed to match up with the needles of a plurality of diluent manifolds. Each cartridge 16 also includes openings to receive mounting posts and a locking bayonet from the pump head assembly 28. Although a locking bayonet is described herein as an example, other locking mechanisms may be used to retrieve and lock a cartridge to the pump head (e.g., grippers, clamps, or the like may extend from the pump head). Each cartridge 16 also includes openings allowing valve actuators from the pump motor mechanism to interact with the valves on each cartridge 16.

Adjacent the housing 12 that holds the vials 18 and the carousel 14 is an apparatus 30 for holding at least one container 32, such as an IV bag 32 as shown in the figures. The IV bag 32 typically has two ports such as ports 34 and 36. For example, in one implementation, port 34 is an intake port 34 and port 36 is an outlet port 36. Although this implementation is sometimes discussed herein as an example, either of ports 34 and 36 may be implemented as an input and/or outlet port for container 32. For example, in another implementation, an inlet 34 for receiving a connector at the end of tubing 38 may be provided on the outlet port 36. In the embodiment, shown, the IV bag 32 hangs from the holding apparatus 30, which, in one embodiment is a post with a hook as illustrated in FIGS. 1-3. One or more of the hooks for hanging containers such as diluent containers, receiving containers, or waste containers may be provided with a weight sensor such as a load cell that detects and monitors the weight of a hung container. The holding apparatus 30 can take any other form necessary to position the IV bag 32 or other pharmaceutical container. Once the IV bag 32 is positioned on the holding apparatus 30, a first tube 38 (a portion of which is shown in FIG. 1) is connected from a cartridge 16 on the carousel 14 to the inlet 34 of the IV bag 32. For example, the first tube may be housed in a backpack attached to the cartridge and extended from within the backpack (e.g., by an operator or automatically) to reach the IV bag 32. A connector 37 such as a Texium® connector may be provided on the end of tube 38 for connecting to inlet 34 of receiving container 32.

On the opposite side of the compounder 10 is an array of holding apparatuses 40 for holding multiple IV bags 32 or other containers. In the illustrated version of the compounder 10, five IV bags 42, 44 are pictured. Three of these bags 42 may contain diluents, such as saline, D5 W or sterile water, although any diluent known in the art may be utilized. An additional bag in the array may be an empty vapor waste bag 44 for collecting waste such as potentially hazardous or toxic vapor waste from the mixing process. An additional bag 44 may be a liquid waste bag. The liquid waste bag may be configured to receive non-toxic liquid waste such as saline from a receiving container. Liquid waste may be pumped to the waste bag via dedicated tubing using a mechanical pump. In operation, diluent lines and a vapor waste line from the corresponding containers 42 and 44 may each be connected to a cartridge 16 through a disposable manifold.

The compounding system 10 also includes a specialized vial puck 26 designed to attach to multiple types of vials 18. In operation, the vial puck 26 is placed on top of the vial 18 containing the drug in need of reconstitution. Once the vial puck 26 is in place, the vial 18 is loaded into the star wheel 22 of the compounder 10. Mating features on the vial puck 26 provide proper alignment both while the vial puck 26 is in the star wheel 22 and when the vial puck 26 is later rotated into position so that the compounder 10 can remove it from the star wheel 22 for further processing.

Figure 4:
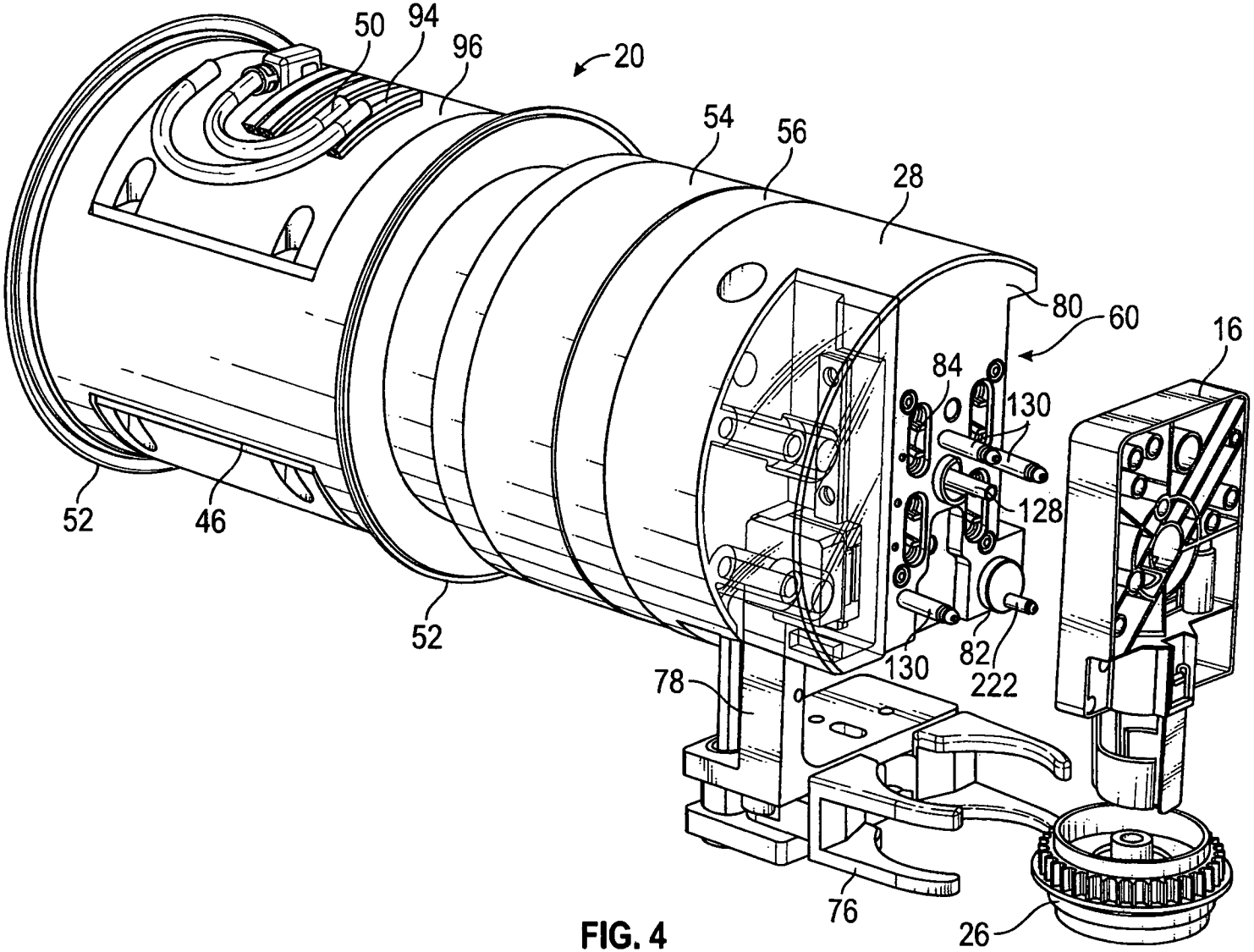
FIG. 4 illustrates a perspective view of an exemplary embodiment of a pump drive mechanism in accordance with aspects of the present disclosure.
Figure 5:
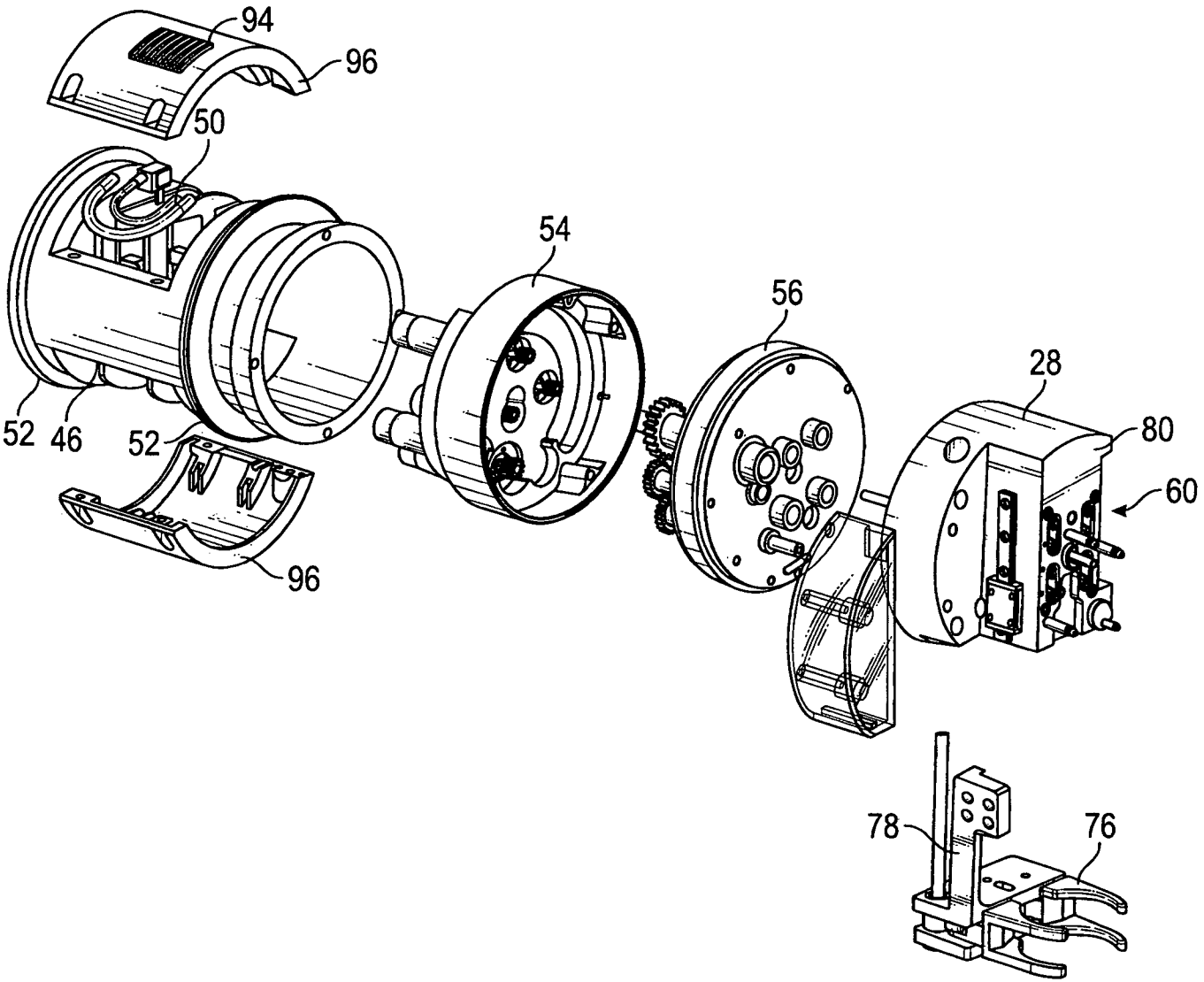
FIG. 5 illustrates an exploded view of the pump drive mechanism of FIG. 4 in accordance with aspects of the present disclosure.

The pump drive mechanism 20 is illustrated in FIG. 4, and in an exploded view in FIG. 5, according to an embodiment. In the embodiment shown in FIGS. 4 and 5, the pump drive mechanism 20 comprises a multitude of sections. At one end of the pump drive mechanism 20 is the rotation housing 46, which holds the drive electronics and includes locking flanges 94 on its housing 96 for flexible tubing 50 which may run from one or more diluent containers and/or waste containers to one or more corresponding manifolds. The rotation housing 46 is capable of rotating around its axis to rotate the rest of the pump drive mechanism 20. The rotation housing 46 includes bearing ribs 52 on its ends which allow it to rotate. For example, the pump drive mechanism may be configured to rotate through any suitable angle such as up to and including 180°, or more than 180°.

Figure 6:
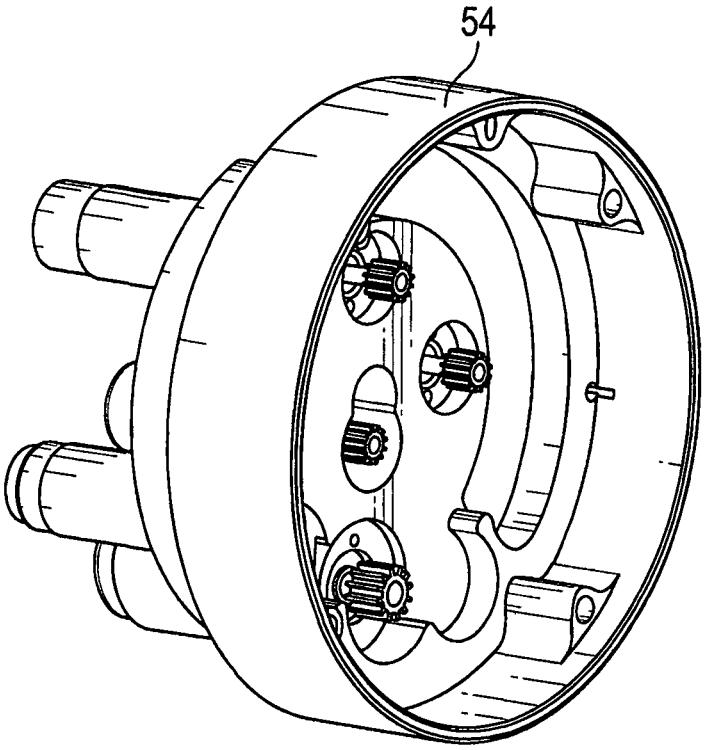
FIG. 6 illustrates a perspective view of an example of an exemplary embodiment of a motor mount in accordance with aspects of the present disclosure.
Figure 7:
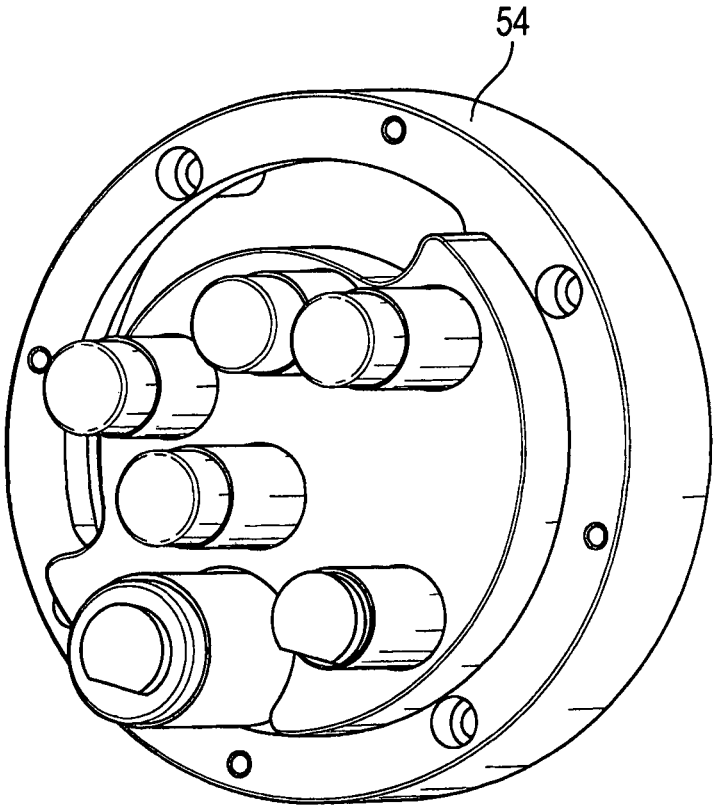
FIG. 7 illustrates a rear perspective view of the motor mount of FIG. 6 in accordance with aspects of the present disclosure.
Figure 8:
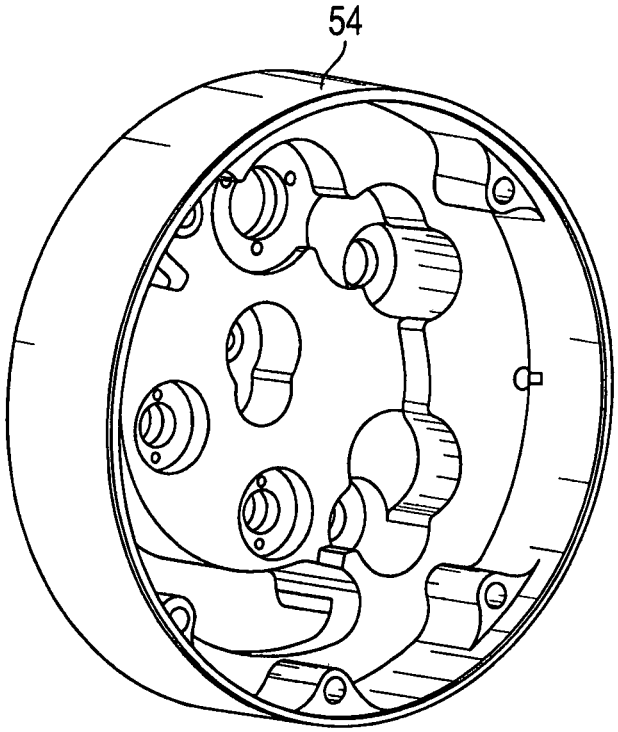
FIG. 8 illustrates a perspective view of the motor mount of FIG. 6 in accordance with aspects of the present disclosure.
Figure 9:
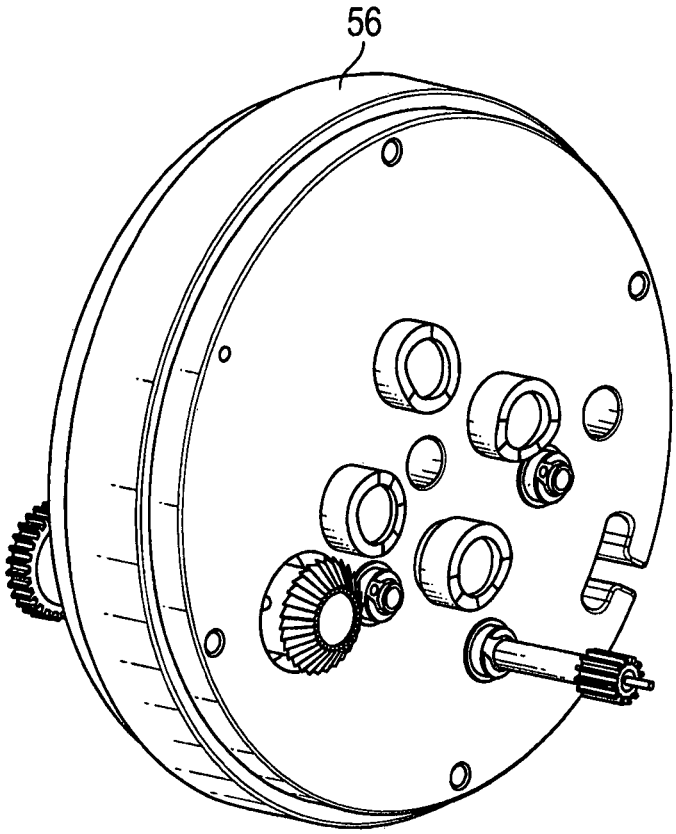
FIG. 9 illustrates a perspective view of an exemplary embodiment of a cam housing in accordance with aspects of the present disclosure.
Figure 10:
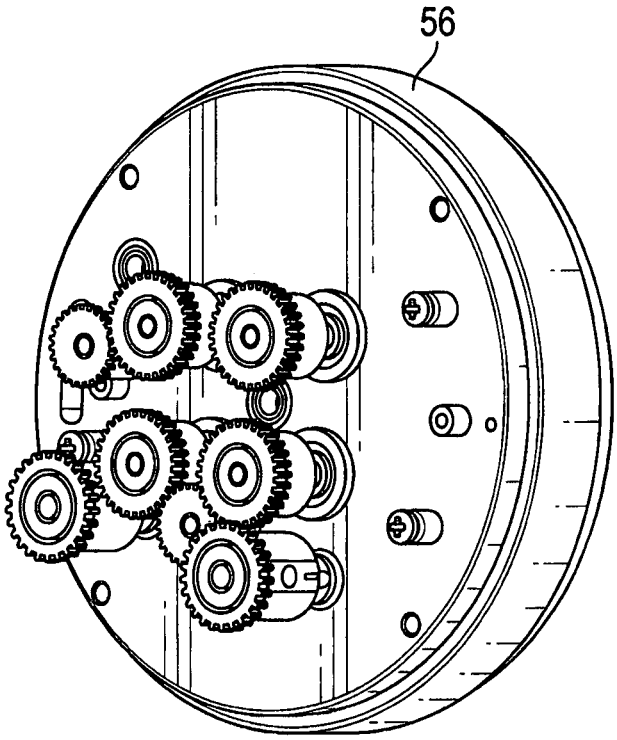
FIG. 10 illustrates a rear perspective view of the cam housing of FIG. 9 in accordance with aspects of the present disclosure.
Figure 11:
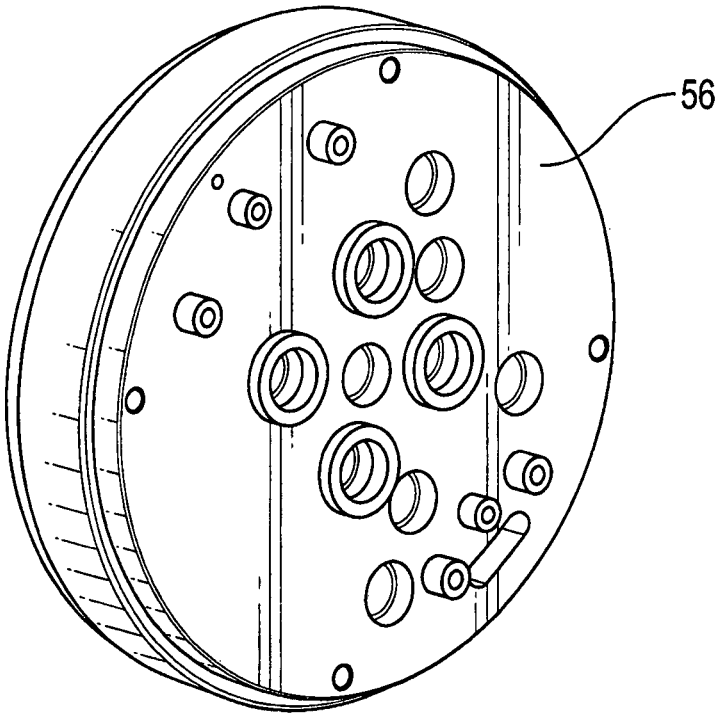
FIG. 11 illustrates a rear perspective view of the cam housing of FIG. 9 with the gears removed in accordance with aspects of the present disclosure.
Figure 12:
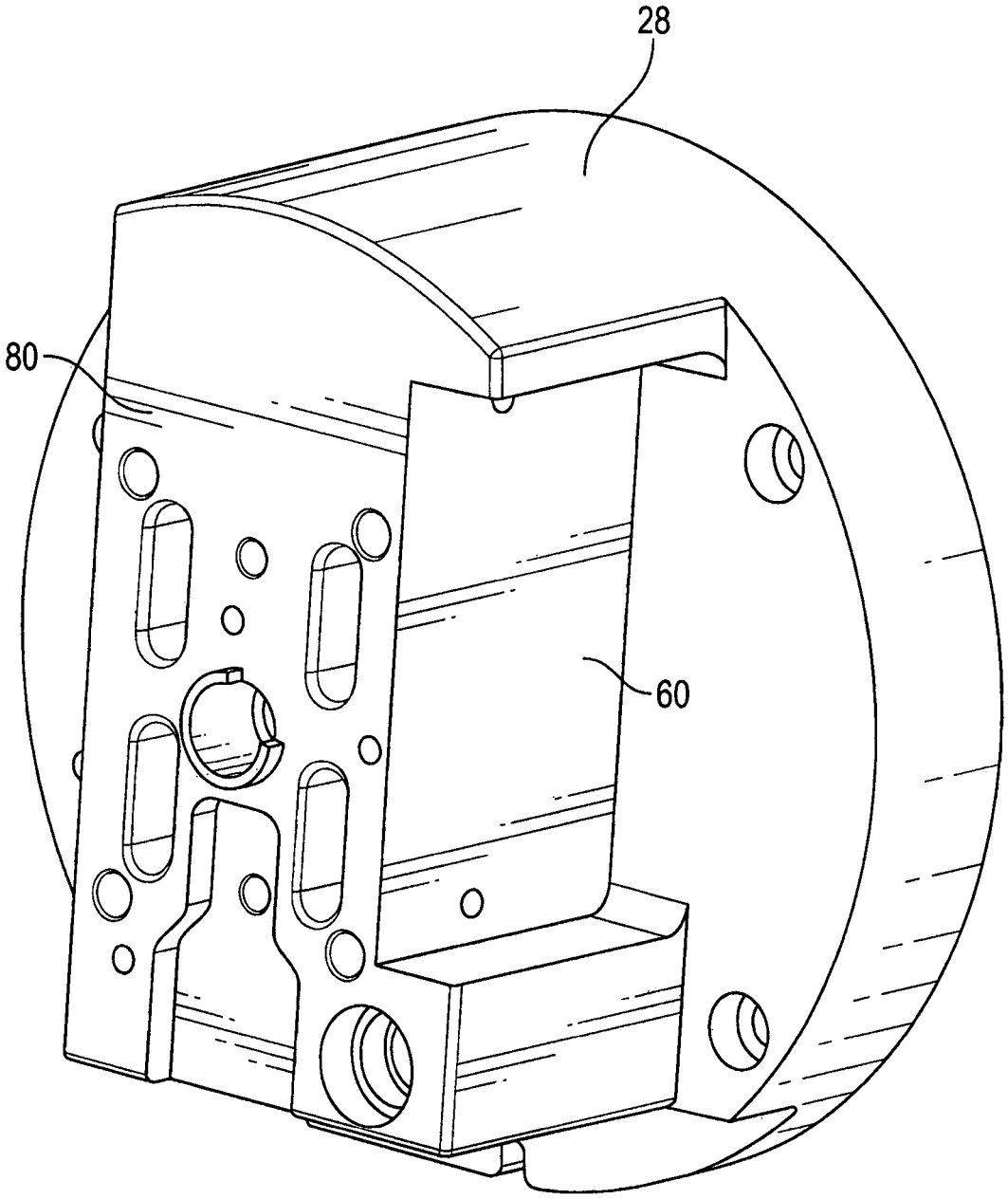
FIG. 12 illustrates a perspective view of an exemplary embodiment of a pump head assembly in accordance with aspects of the present disclosure.
Figure 13:
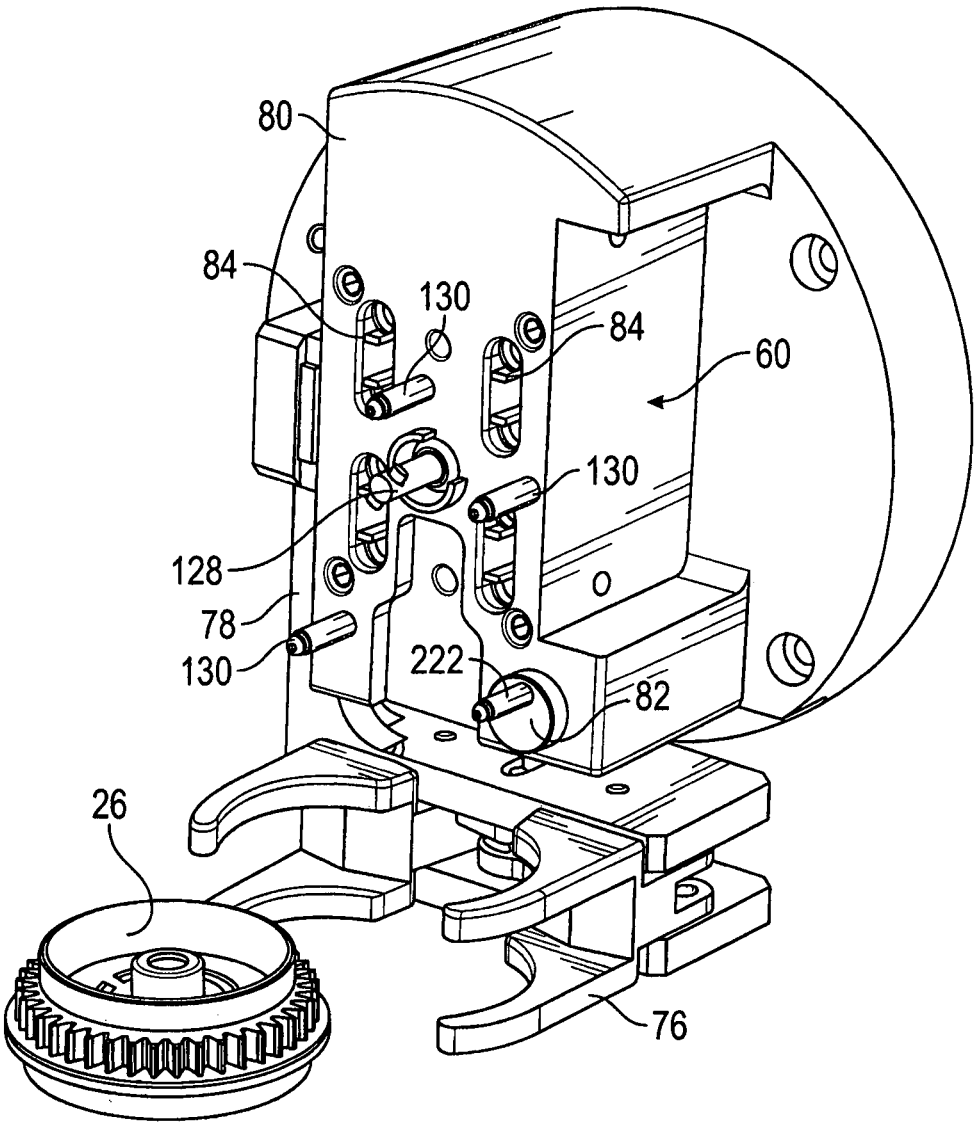
FIG. 13 illustrates a perspective view of the pump head assembly of FIG. 12 with an exemplary embodiment of a gripping system and vial puck in accordance with aspects of the present disclosure.
Figure 14:
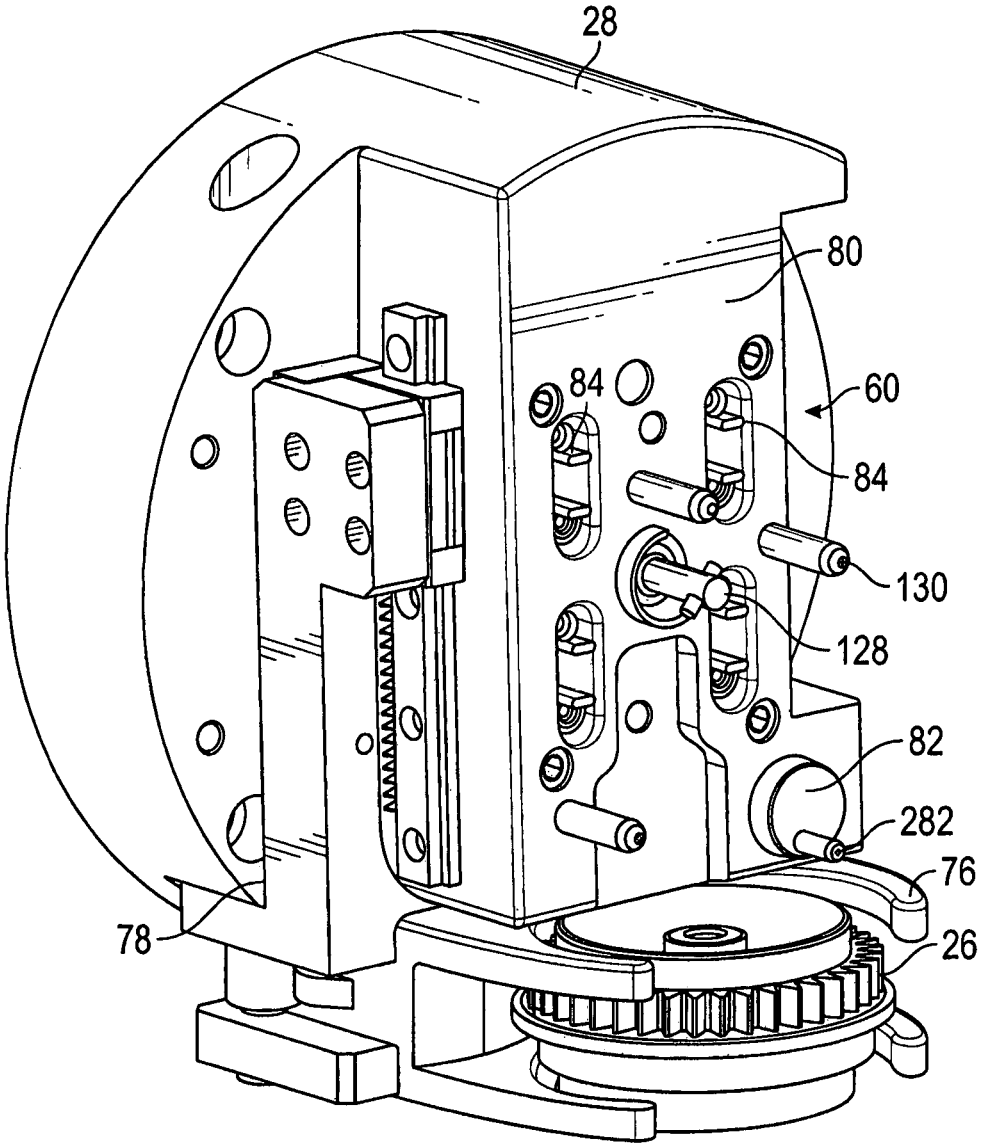
FIG. 14 illustrates a perspective view of the pump head assembly, gripping system and vial puck of FIG. 13 in accordance with aspects of the present disclosure.
Figure 15:
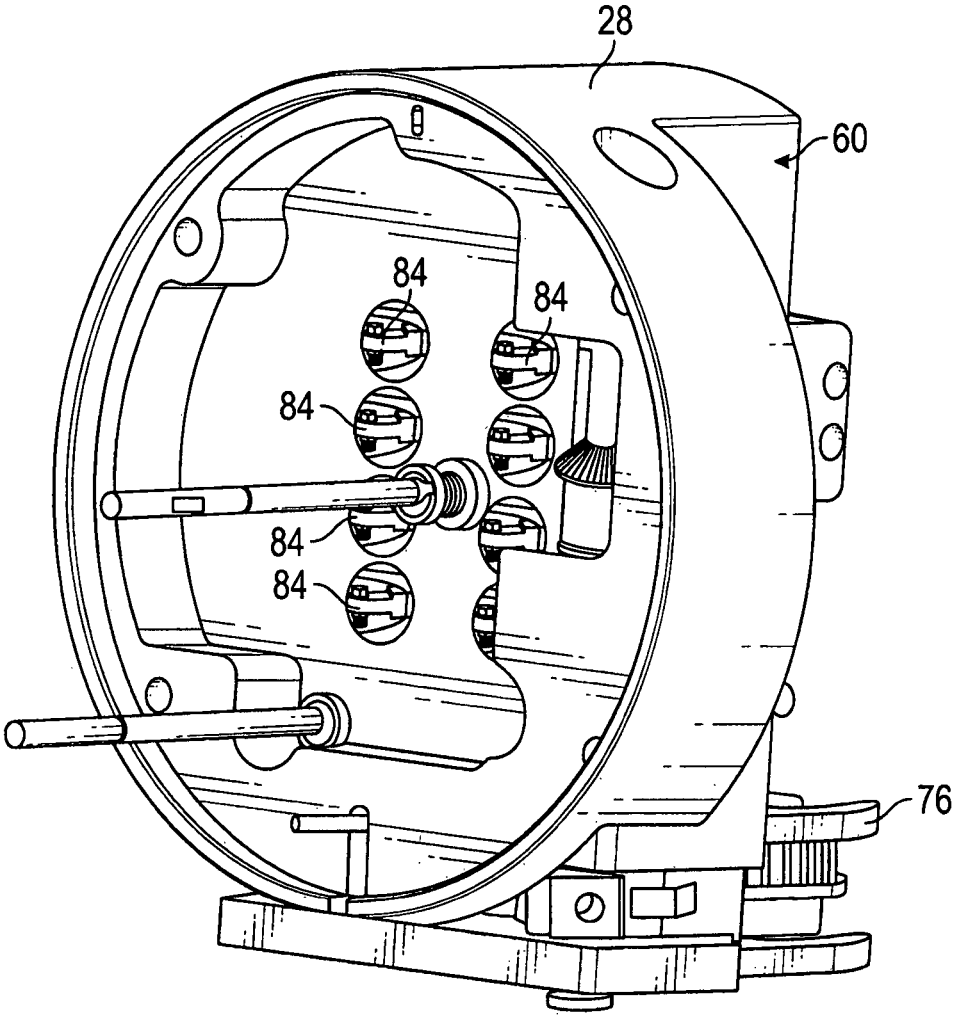
FIG. 15 illustrates a rear perspective view of the pump head assembly, gripping system and vial puck of FIG. 13 in accordance with aspects of the present disclosure.
Figure 16:
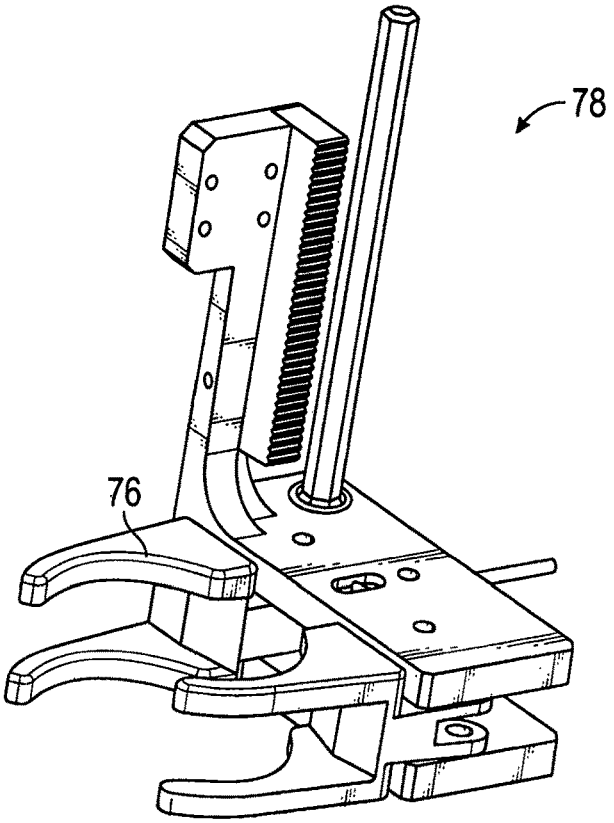
FIG. 16 illustrates a perspective view of an exemplary embodiment of a gripping system in accordance with aspects of the present disclosure.
Figure 17:
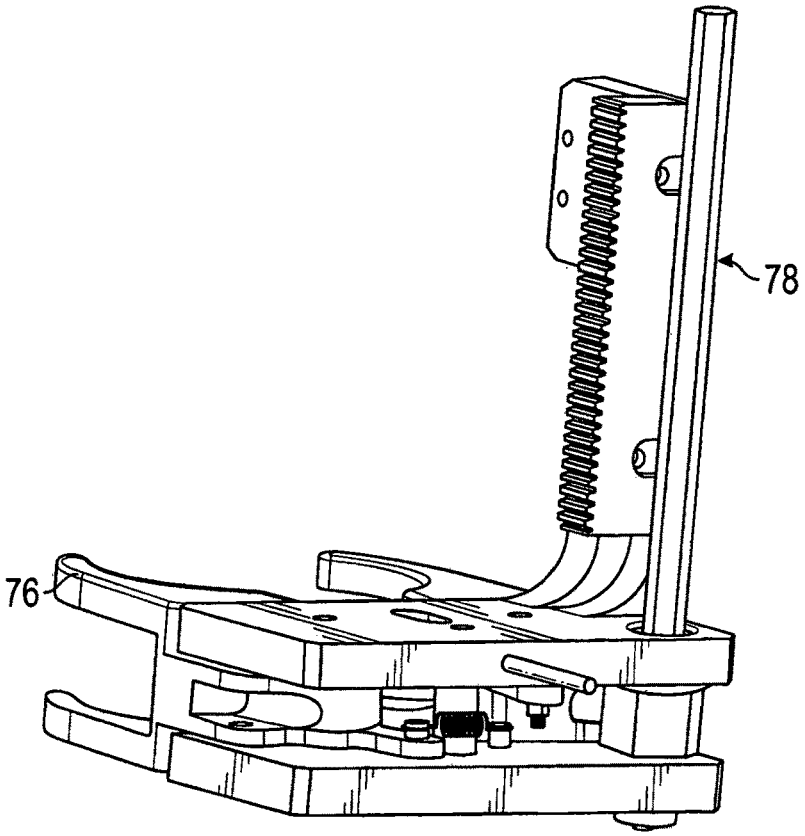
FIG. 17 illustrates a rear perspective view of the gripping system of FIG. 16 in accordance with aspects of the present disclosure.
Figure 18:
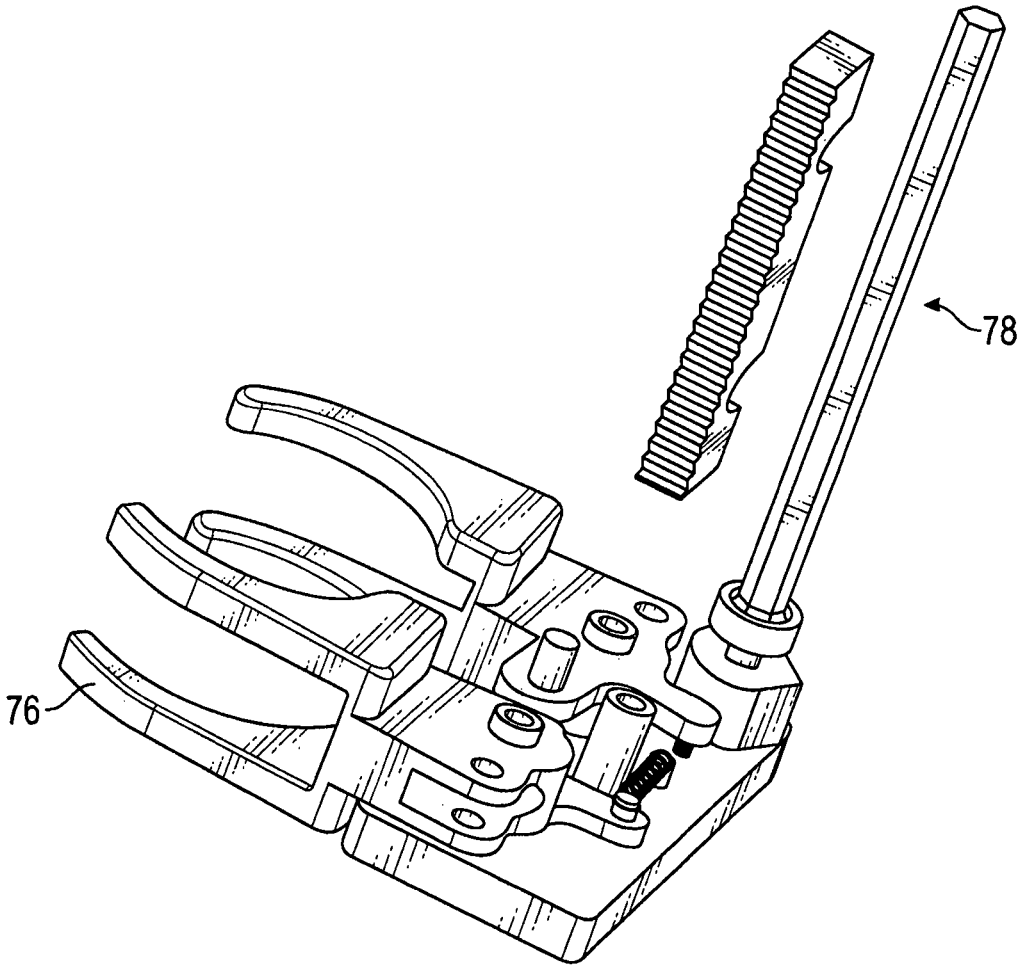
FIG. 18 illustrates a side perspective view of the gripping system of FIG. 16 in accordance with aspects of the present disclosure.
Figure 19:
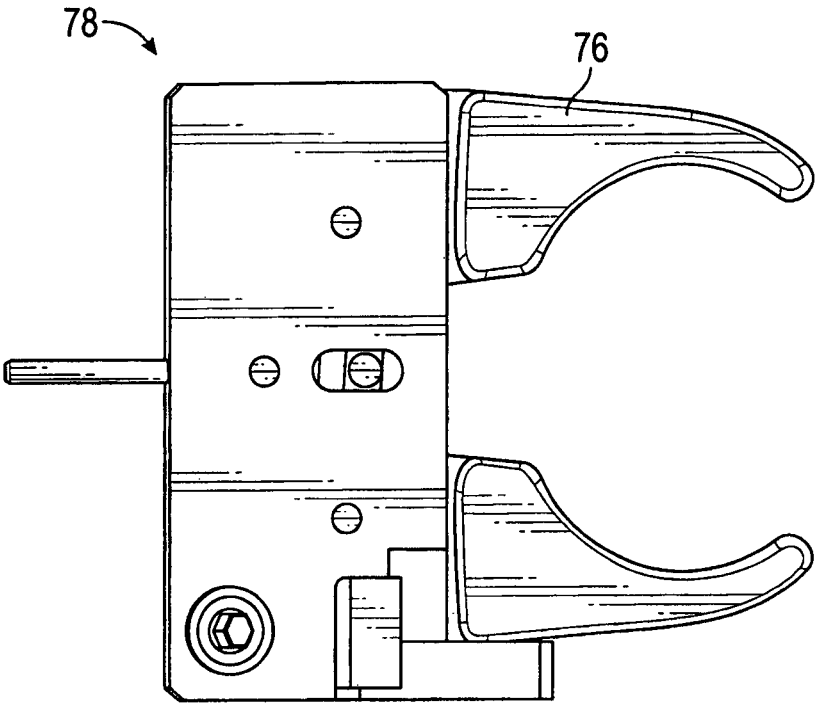
FIG. 19 illustrates a top plan view of the gripping system of FIG. 16 in accordance with aspects of the present disclosure.
Figure 20:
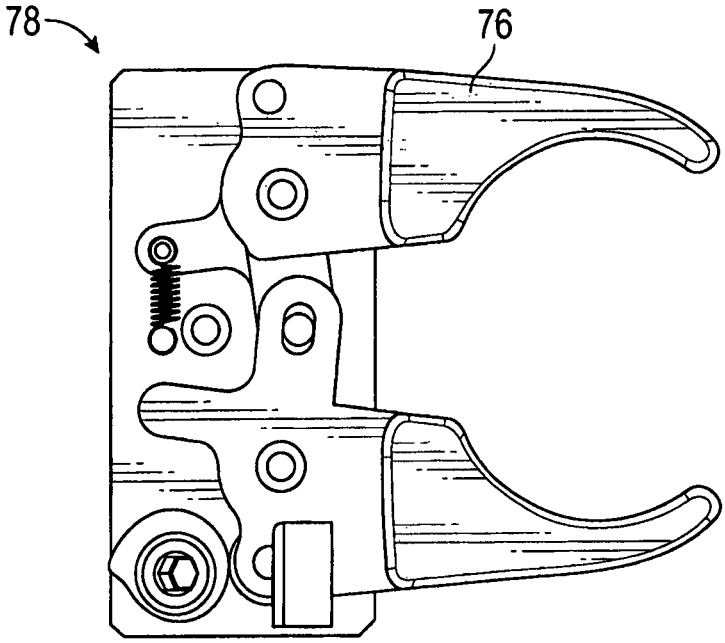
FIG. 20 illustrates a top plan view of the gripping system of FIG. 16 in accordance with aspects of the present disclosure.

Next to the rotation housing 46 is the motor mount 54, which is shown alone from various angles in FIGS. 6-8, according to an embodiment. In the embodiment shown in FIGS. 4-8, the cam housing 56, shown in further details from various angles FIGS. 9-11, is connected to the motor mount 54, which includes cams and gears that control the rotary motion of the motors and the axial motion of the pump drive mechanism 20 as it moves into position to pick up a cartridge 16 and a vial 18.

The compounder system also includes a diluent magazine (not shown) that mounts in a slot 60 located on the side of the pump drive mechanism. The diluent magazine may be a disposable piece configured to receive any number of individual diluent manifolds operable as diluent ports. The diluent manifolds (not shown) may be modular so they can easily and removably connect to each other, the magazine, and/or connect to the pump drive mechanism 20.

The final portion of the pump drive mechanism 20 is the pump head assembly 28. The pump head assembly 28 includes the vial grasping arms 76, the vial lift 78, the pump cartridge grasp 80, the pump piston eccentric drive shaft 82 with arm 222, the valve actuation mechanisms 84, as well as the motors that allow the pump drive mechanism 20 to move forward and back and to rotate in order to mix the pharmaceutical in the vial 18 once the diluent has been added to it. The compounder 10 may also include an input screen 86 such as a touch screen 86 as shown in the figures to provide data entry by the user and notifications, instructions, and feedback to the user.

Figure 21:
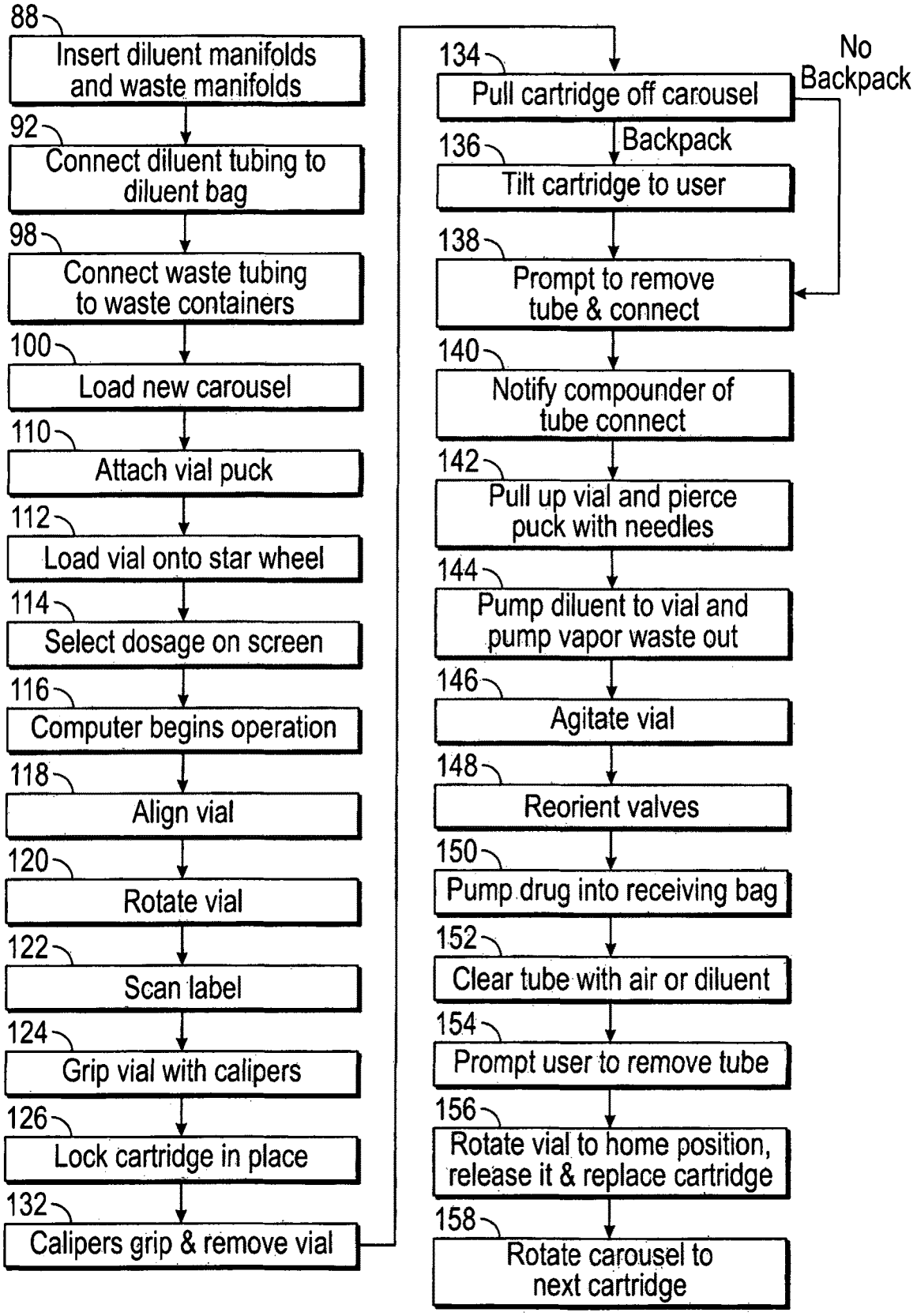
FIG. 21 is a flow chart illustrating an exemplary embodiment of the steps of a process in accordance with aspects of the present disclosure.

The operation of the compounder system 10 will now be generally described in the flowchart illustrated at FIG. 21, according to an embodiment. In the first step 88, a user inserts a new diluent manifold magazine having a plurality of manifolds (e.g., diluent manifolds and waste manifolds) into the slot 60 on the side of the pump head assembly 28. Manifolds may be loaded into the magazine before or after installing the magazine in the slot 60. The manifolds maintain needles inside the housing of the manifold until the cartridge 16 is later locked in place. The magazine may contain any number of diluent manifolds and vapor waste manifolds. In one illustrative system, there may be three diluent manifolds and one vapor waste manifold. In the next step 92, diluent tubing is connected to corresponding diluent bags. The tubes may be routed through locking flanges on a surface (e.g., the front surface) of the compounder frame to hold them in place. For example, in the illustrated embodiment of FIG. 24, the tubes are held in place with locking flanges 2402 on the frame of the compounder. Alternatively, other types of clips or locking mechanisms known in the art may be used to hold the tubes securely in place. In the illustrated embodiment of FIG. 4, the additional flanges 94 positioned on the outside housing 96 of the pump drive mechanism 20 are provided for securing internal wiring of the compounder. In the next step 98, waste tubing may be connected to the vapor waste bag 44. In other embodiments, tubing may be pre-coupled between the manifolds and associated containers such as diluent containers and/or waste containers and the operations of steps 92 and 98 may be omitted.

If desired, in the next step 100, a new carousel 14 may be loaded into a carousel mounting station such as a carousel hub of the compounder system. The carousel 14 may contain any number of disposable cartridges 16 arranged in a generally circular array. In the next step 110, a vial puck 26 is attached to the top of a vial 18 of a powdered or liquid pharmaceutical for reconstitution and the vial 18 is loaded into the star wheel 22 under the carousel 14 in the next step 112. Step 110 may include loading multiple vials 18 into multiple vial puck recesses in star wheel 22. After one or more vials are loaded into the star wheel, the vials are rotated into position to enable and initiate scanning of the vial label of each vial. In one embodiment, the user will be allowed to load vials into the star wheel until all vial slots are occupied with vials before the scanning is initiated. A sensor may be provided that detects the loading of each vial after which a next vial puck recess is rotated into the loading position for the user. Allowing the user to load all vials into the star wheel prior to scanning of the vial labels helps increase the efficiency of compounding. However, in other implementations, scanning of vial labels may be performed after each vial is loaded or after a subset of vials is loaded. Following these setup steps, the next step 114 is for a user to select the appropriate dosage on the input screen.

After the selection on the input screen 86, the compounder 10 begins operation 116. The star wheel 22 rotates the vial into alignment 118 with the vial grasping calipers 76 of the pump head assembly 28. The vial puck 26 includes, for example, gears that interface with gears coupled to a rotational motor that allow the vial 18 to rotate 120 so that a scanner (e.g., a bar code scanner or one or more cameras) can scan 122 a label on the vial 18. The scanner or camera (and associated processing circuitry) may determine a lot number and an expiration date for the vial. The lot number and expiration date may be compared with other information such as the current date and/or recall or other instructions associated with the lot number. Once the vial 18 is scanned and aligned, in the next step 124 the pump drive mechanism 20 moves forward into position to grip the vial 18 with the calipers 76. The forward movement also brings the mounting posts 130 and locking bayonet 128 on the front of the pump head assembly 28 into matching alignment with corresponding openings on a cartridge 16. In the next step 126 the cartridge 16 is locked in place on the pump head assembly 28 with the locking bayonet 128 and the calipers 76 grip 132 the vial puck 26 on the top of the vial 18. The calipers 76 then remove 132 the vial 18 from the star wheel 22 by moving backward, while at the same time pulling 134 the cartridge 16 off of the carousel 14.

In some embodiments, the cartridge 16 includes a backpack that includes a coiled tube. In this embodiment, in step 136 the pump drive mechanism 20 tilts the cartridge 16 toward the user to expose the end of the tube and prompts 138 the user to pull the tube out of the backpack and connect it to the receiving bag 32. In an alternative embodiment, the tube 38 is exposed on the side of the carousel 14 once the cartridge 16 is pulled away from the carousel 14. In another alternative embodiment, the tube 38 is automatically pushed out (e.g., out of the backpack) thus allowing the user to grab onto the connector located at the end of the tube and connect to the receiving container. The system prompts 138 the user to pull the tube out from the carousel 14 and connect it to the input 34 of the IV bag 32. Once the tube 38 is connected, in step 140 the user may notify the compounder 10 to continue the compounding process by interacting with the input screen 86.

At step 142, the vial 18 is pulled up towards the cartridge 16 so that one or more needles such as a coaxial dual lumen needle of the cartridge 16 pierce the top of the vial puck 26 and enter the interior of the vial 18. Although the example of FIG. 21 shows engagement of the needle with the vial puck after the user attaches the tube from the cartridge to the receiving container, this is merely illustrative. In another embodiment, steps 138 and 140 may be performed after step 142 such that engagement of the needle with the vial puck occurs before the user attaches the tube from the cartridge to the receiving container.

Diluent is pumped at step 144 into the vial 18 through the cartridge 16 and a first needle in the proper dosage. If necessary, a second or third diluent may be added to the vial 18 via a second or third diluent manifold attached to the cartridge 16. Simultaneously, vapor waste is pumped 144 out of the vial 18, through a second needle, through the cartridge 16 and the vapor waste manifold, and into the vapor waste bag 44. The valve actuators 84 on the pump head assembly 28 open and close the valves of the cartridge 16 in order to change the fluid flow paths as necessary during the process. Once the diluent is pumped into the vial 18, the pump drive mechanism 20 agitates the vial 18 in the next step 146 by rotating the vial lift 78 up to, for example 180 degrees such that the vial 18 is rotated between right-side-up and upside-down positions. The agitation process may be repeated for as long as necessary, depending on the type of pharmaceutical that is being reconstituted. Moreover, different agitation patterns may be used depending on the type of drugs being reconstituted. For example, for some drugs, rather than rotating by 180 degrees, a combination of forward-backward, and left-right motion of the pump head may be performed to generate a swirling agitation of the vial. A plurality of default agitation patterns for specific drugs or other medical fluids may be included in the drug library stored in (and/or accessible by) the compounder control circuitry. Once the agitation step is complete, the pump drive mechanism rotates the vial to an upside down position or other suitable position and holds it in place. In some embodiments, a fluid such as a diluent already in the receiving container 32 may be pumped (e.g., through the cartridge or via a separate path) into a liquid waste container to allow room in the receiving container for receiving the reconstituted medicine.

In the next step 148, the valve actuators 84 reorient the valves of the cartridge and the pumping mechanism of the cartridge 16 is activated to pump 150 the reconstituted drug into the receiving bag 32 through the attached tube. Once the drug is pumped into the receiving bag 32, in the next step 152 the pump drive mechanism 20 clears the tube 38 by either pumping filtered air or more diluent through the tube 38 into the receiving bag 32 after another valve adjustment to ensure that all of the reconstituted drug is provided to the receiving bag 32. In some scenarios, a syringe may be used as a receiving container 32. In scenarios in which a syringe is used as the receiving container 32, following delivery of the reconstituted drug to the syringe, a vacuum may be generated in tube 38 by pump drive mechanism 20 to remove any air or other vapors that may have been pushed into the syringe so that, when the syringe is removed from tube 38, the reconstituted drug is read for delivery to a patient and no air or other unwanted gasses are present in the syringe.

The system then prompts 154 the user to remove the tube 38 from the receiving container 32. The user may then insert the connector (e.g., a Texium® or SmartSite® connector) into its slot in the backpack or carousel and an optical sensor in the pump head may sense the presence of the connector and automatically retract the tube into either the carousel or the backpack. The tube is pulled back into either the carousel 14 or the backpack, depending on which type of system is in use. In the next step 156, the compounder 10 rotates the vial 18 back into alignment with the star wheel 22 and releases it. The used cartridge 16 may also be replaced on the carousel 14. The used cartridge may be released when a sensor in the pump drive determines that the tube has been replaced in the cartridge (e.g., by sensing the presence of a connector, such as a Texium® connector, at the end of the tube in the backpack of the cartridge through a window of the cartridge). The carousel 14 and/or star wheel 22 then may rotate 158 to a new unused cartridge 16 and/or a new unused vial 18 and the process may be replicated for a new drug. In some circumstances (e.g., multiple reconstitutions of the same drug), a single cartridge may be used more than once with more than one vial.

The cartridges 16 are designed to be disposable, allowing a user to utilize all the cartridges 16 in a given carousel 14 before replacing the carousel 14. After a cartridge 16 is used, the carousel 14 rotates to the next cartridge 16, and the system software updates to note that the cartridge 16 has been used, thus preventing cross-contamination from other reconstituted drugs. Each cartridge 16 is designed to contain all the necessary flow paths, valves, filters and pumps to reconstitute a drug with multiple diluents if necessary, pump the reconstituted drug into the receiving container, pump vapor waste out of the system into a waste container, and perform a final QS step in order to make sure that the proper amount of drug and diluent is present in the receiving container. This complete package is made possible by the specific and unique construction of the cartridge 16, its flow paths, and its valve construction.

Figure 22:
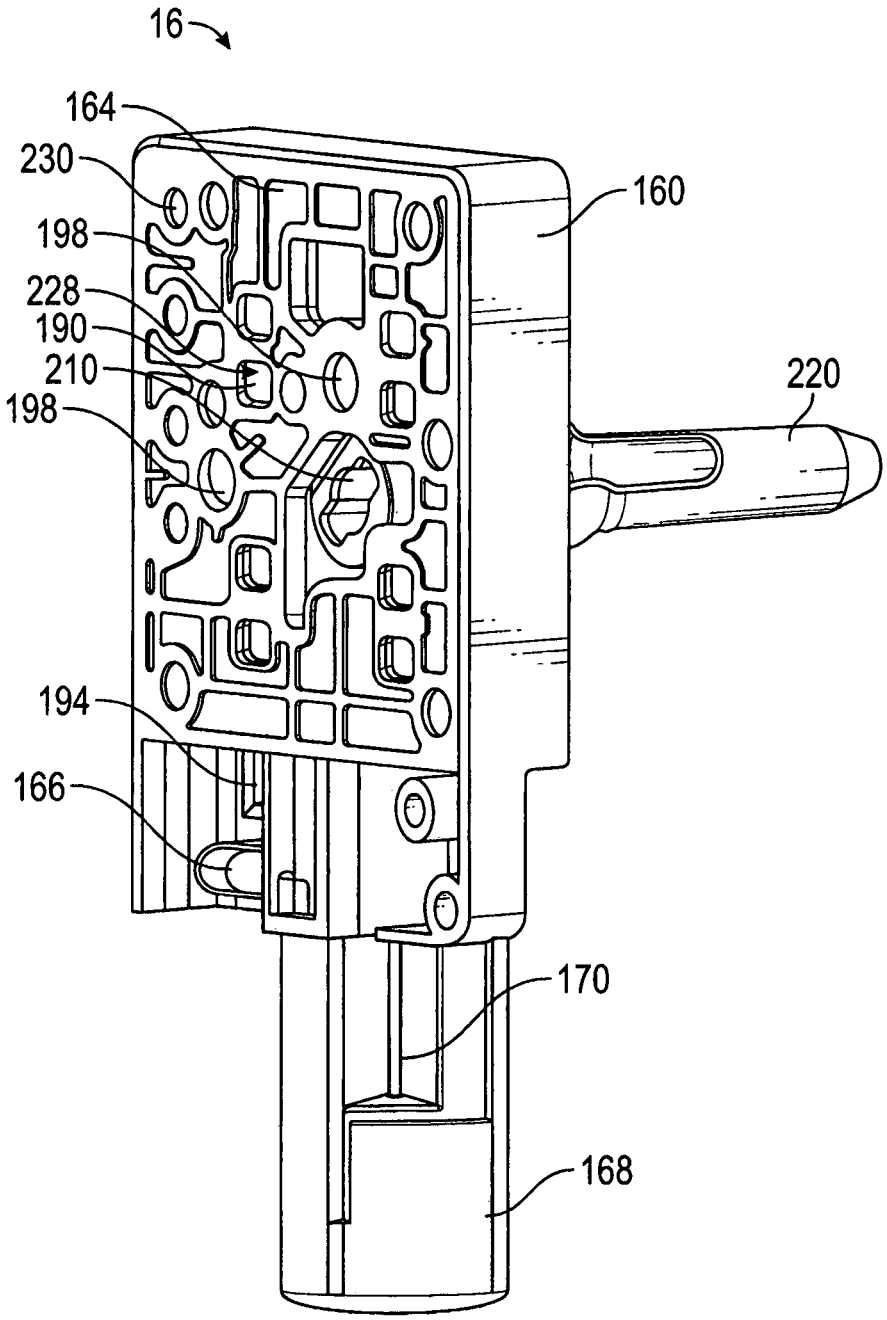
FIG. 22 illustrates a perspective view of an exemplary embodiment of a cartridge in accordance with aspects of the present disclosure.

An embodiment of a cartridge 16 is illustrated in FIG. 22. As shown in FIG. 22, cartridge 16 may include a cartridge frame 160, a cartridge bezel 164, as well as a piston pump 166, a needle housing 168 and a needle assembly 170. The cartridge frame 160 provides the main support for each cartridge 16 and includes diluent chambers, a vapor waste chamber, a pumping chamber, a hydrophobic vent, an exit port, and/or other features as described hereinafter that can be connected to a tube that connects to the receiving container 32.

The frame 160 of the cartridge 16 also includes locating features that allow each cartridge 16 to be removably mounted to the pump head assembly 28. These features include, for example, three openings 198 to receive mounting posts 130 from the pump head assembly 28, and a keyhole 210 that allows a locking bayonet 128 to be inserted therein and turned to lock the cartridge 16 to the pump head assembly 28 for removal from the carousel 14. An outlet port extension 220 may be present in some embodiments. The piston pump 166 is mounted within a chamber with a rod 194 positioned within a silicone piston boot. Furthermore, the bezel 164 includes openings 228 in which the valves 190 of the sealing membrane are located and be accessed by the valve actuators 84. Moreover, the bezel 164 includes openings 230 that allow a fluid manifold to be connected to the diluent and vapor waste chambers in the cartridge 16. Bezel 164 may also include an opening that facilitates the detection of a connector (e.g., a Texium® or SmartSite® connector) when the user inserts the connector into the provided slot when compounding is complete. In operation, the needles of the fluid manifold enter through the openings 230 in the bezel 164 and pierce the sealing membrane to gain fluidic access to the diluent and vapor waste chambers defined in the cartridge 16 between the sealing membrane and the cartridge frame 160. Further details of various embodiments of the cartridge 16 will be discussed hereinafter.

Figure 23:
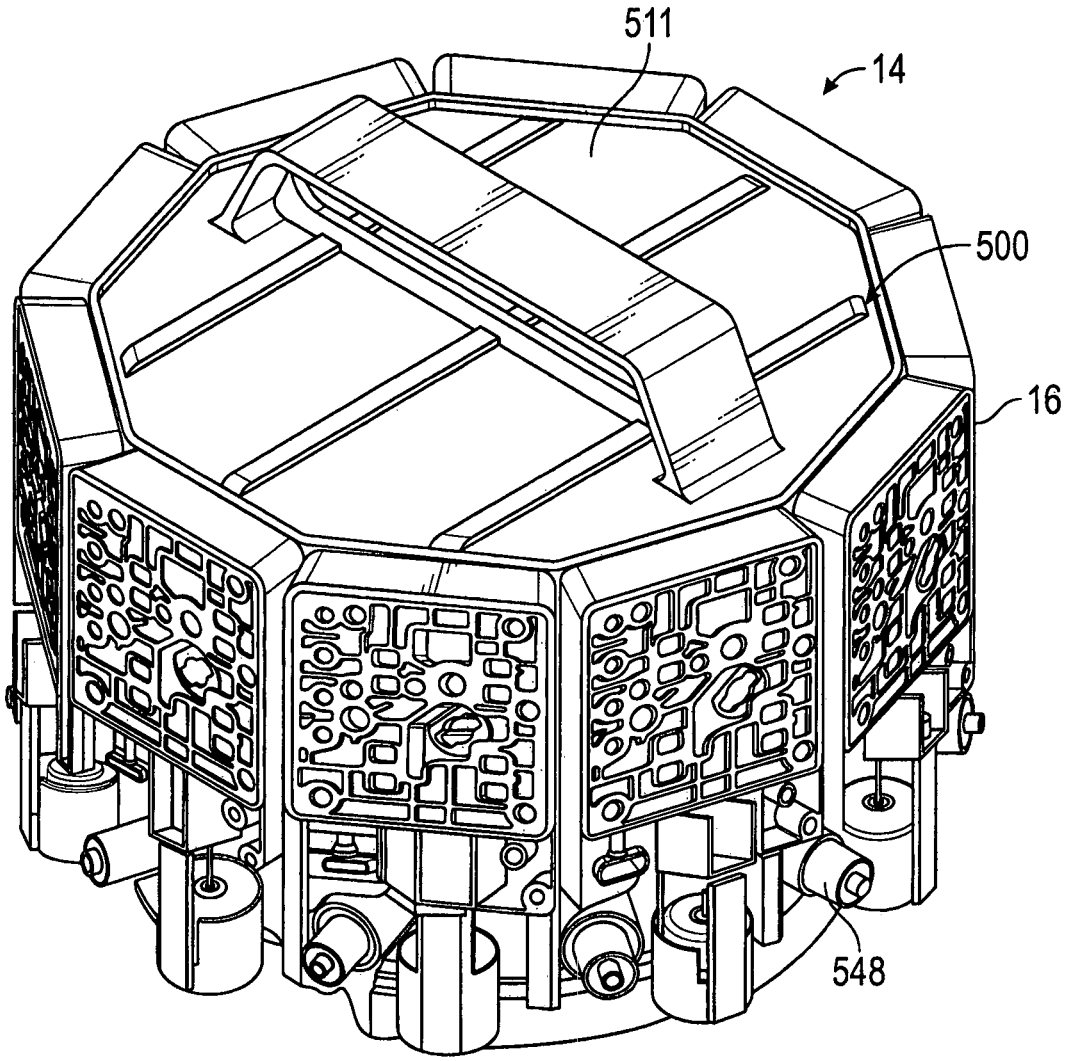
FIG. 23 illustrates a perspective view of an exemplary embodiment of a carousel with a cover in accordance with aspects of the present disclosure.

Referring to FIG. 23, an exemplary embodiment of a carousel 14 removed from the compounder 10 is illustrated, according to an embodiment. The carousel 14 of FIG. 23 includes an array often cartridges 16 in this embodiment, but it should be understood that more or fewer cartridges 16 can be present on the carousel 14, leaving some of the carousel 14 pockets 500 empty, or the frame 510 of the carousel can be designed to have more or fewer cartridge pockets 500. The carousel 14 also includes a cover 511 that prevents a user from accessing the tubes coupled to each of the cartridges 16 directly. The cover 511 may be removed if necessary to access the backs of the cartridges 16. In the example implementation of FIG. 23, a connector such as a Texium® attachment 548 is disposed adjacent each cartridge 16, the attachment 548 being attached to the tube 38 that runs from the extension 220 on each cartridge 16.

Figure 24:
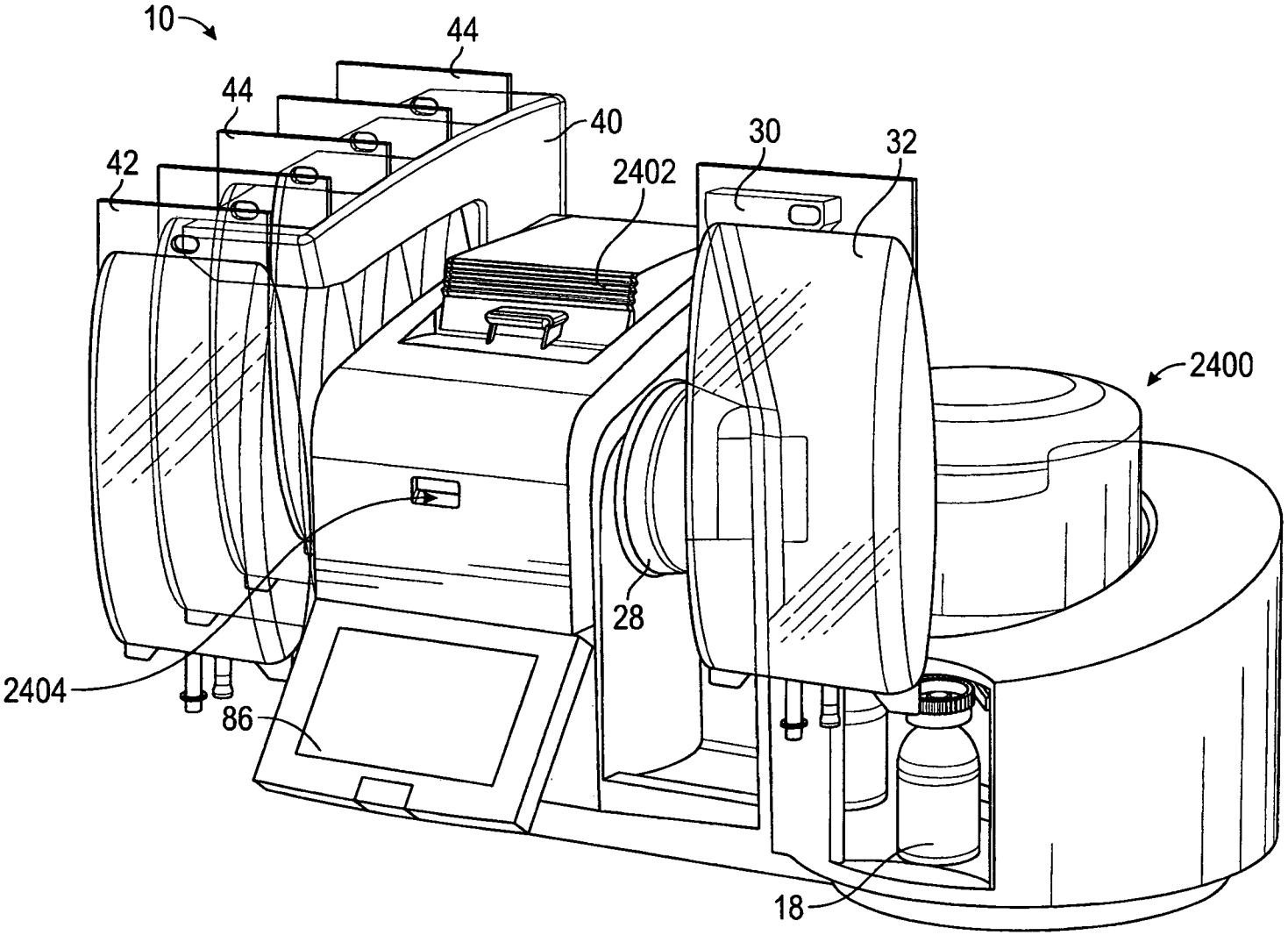
FIG. 24 illustrates a front perspective view of another exemplary embodiment of a compounding system in accordance with aspects of the present disclosure.

FIGS. 24-29 show the compounder 10 according to another embodiment. As shown in FIG. 24, holding apparatus 40 may be implemented as an extended arm providing support for mounting devices for each of containers 42 and 44. Holding apparatus 40 and holding apparatus 30 may each include one or more sensors such as weight sensors configured to provide weight measurements for determining whether an appropriate amount of fluid has been added to or removed from a container or to confirm that fluid is being transferred to and/or from the appropriate container (e.g., that the appropriate diluent is being dispensed). A scanner 2404 may be provided with which each diluent container and/or the receiving container can be scanned before and/or after attachment to compounder 10. As shown in FIG. 24, a carousel cover 2400 and tube management structures 2402 may also be provided on compounder 10 in various embodiments. For example, tubes connected between containers 42 and/or 44 and corresponding manifolds can each be mounted in a groove of tube management structure 2402 to prevent tangling or catching of the tubes during operation of compounder 10.

Figure 25:
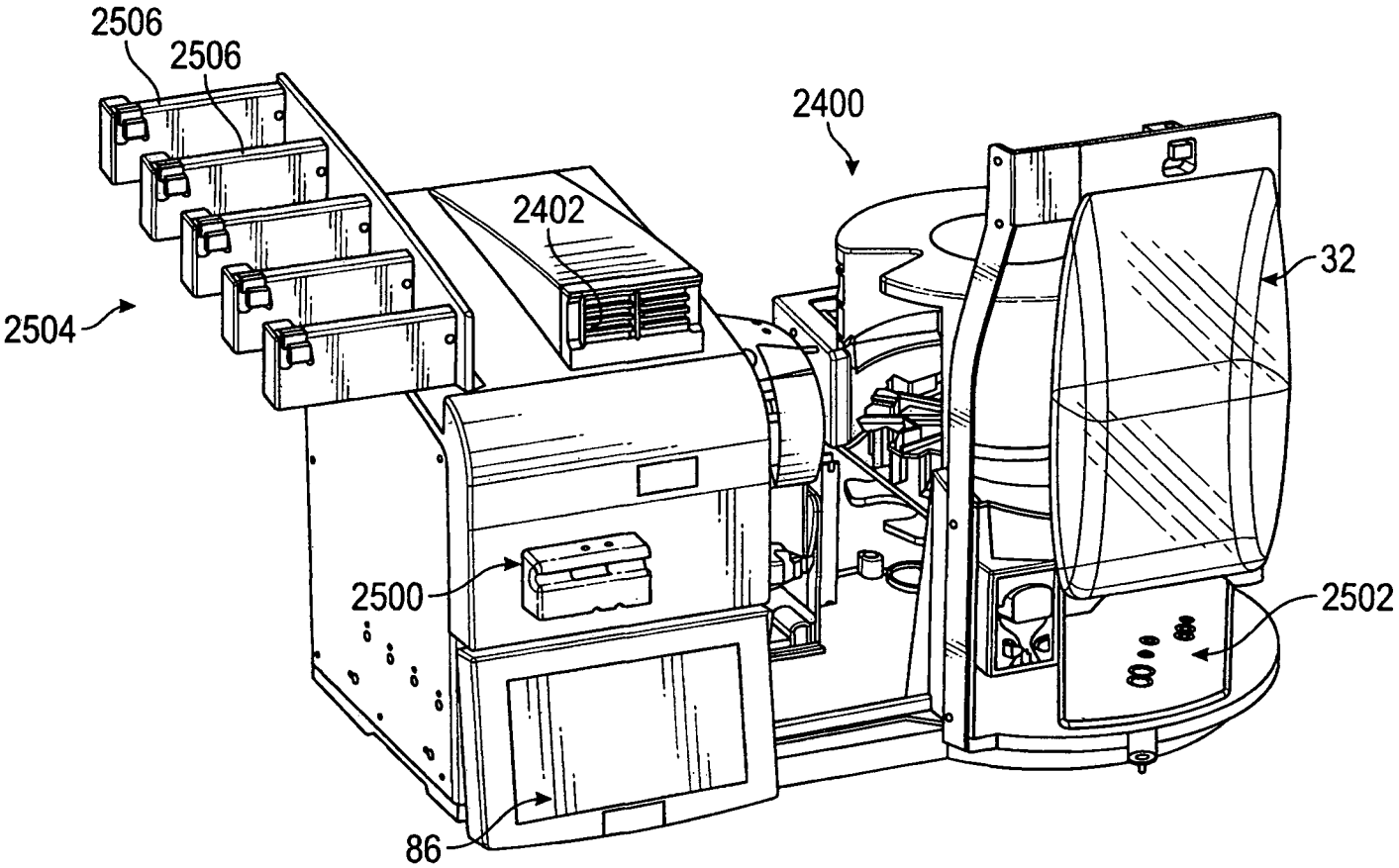
FIG. 25 illustrates another front perspective view of the compounding system of FIG. 24 in accordance with aspects of the present disclosure.

As shown in FIG. 25, an opening 2502 may be provided by which vials 18 can be installed in the star wheel. Additionally, an exterior pump 2500 may be provided for pumping non-toxic liquid waste from, for example, receiving container 32 to a waste container 44 (e.g., for pumping a desired amount of saline out of receiving container 32 quickly and without passing the liquid waste through a cartridge and/or other portions of the compounder).

A fluidics module 2504 may be provided that includes several container mounts 2506. Container mounts 2506 may be used for hanging diluent and waste containers and may include sensor circuitry for sensing when a container has been hung and/or sensing the weight of the container. In this way, the operation of compounder 10 can be monitored to ensure that the correct diluent contain has been scanned and hung in the correct location and that the waste is being provided in an expected amount to the appropriate waste container.

Figure 26:
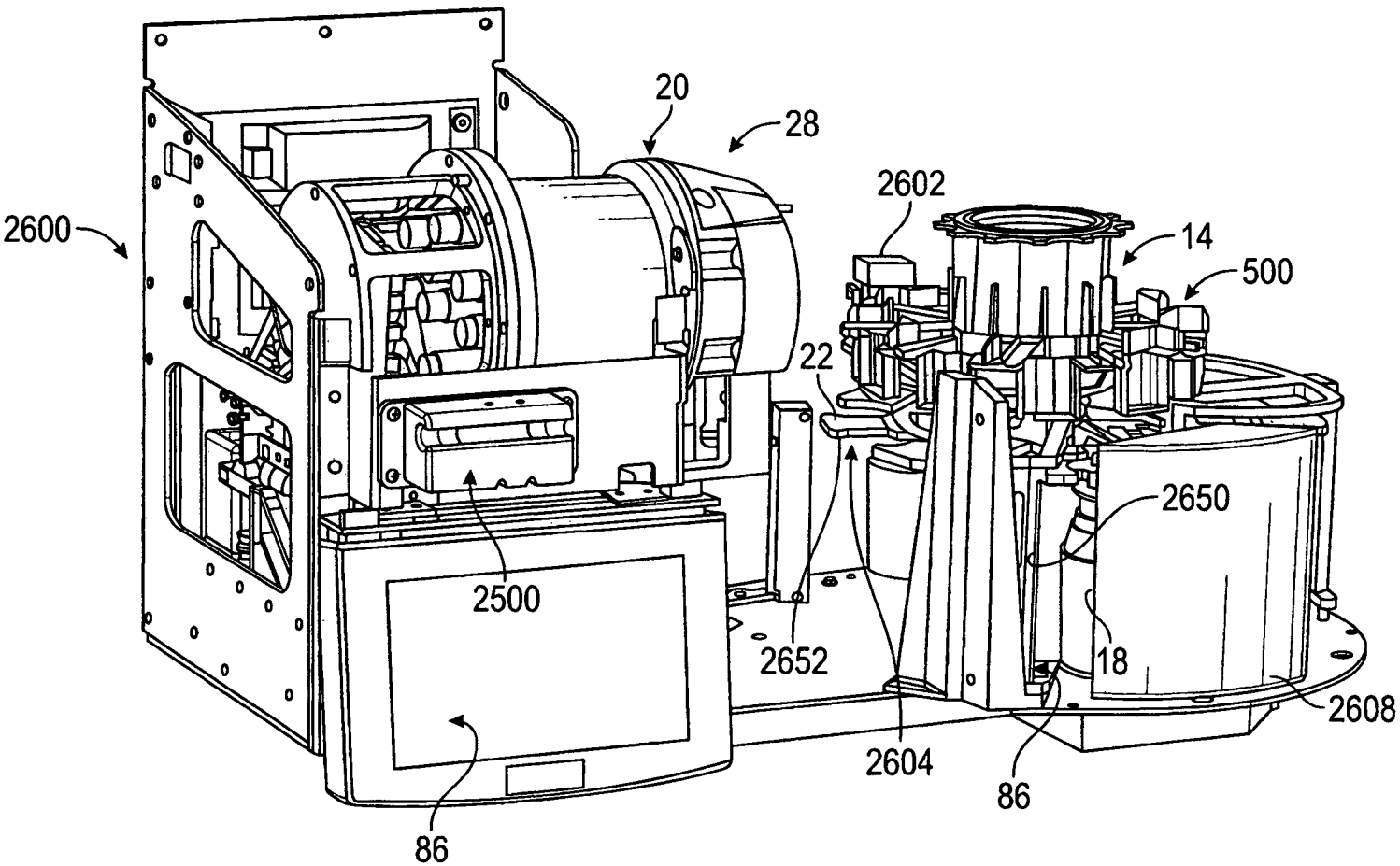
FIG. 26 illustrates a front perspective view of the compounding system of FIG. 24 with portions of the housing removed in accordance with aspects of the present disclosure.

As shown in FIG. 26, pump 2500 and display 86 may be mounted to a chassis 2600. Pump drive 20 may be mounted partially within the chassis 2600 with pump head assembly 28 extending from the chassis to a position which allows the pump head assembly to rotate (e.g., to turn over or agitate a vial). Carousel 14 is also shown in FIG. 26 without any cartridges mounted therein so that cartridge mounting recesses 500 can be seen.

Star wheel 22 (sometimes referred to herein as a vial tray) is shown in FIG. 26 with several empty vial puck recesses 2604. Vial tray 22 may be rotated and an actuating door 2608 may be opened to facilitate loading of vials 18 into the vial puck recesses 2604 in vial tray 22. In some embodiments, door 2608 may be closed before rotation of vial tray 22 to ensure that the operator's fingers are not in danger of injury from the rotating tray. However, this is merely illustrative. In other embodiments a sensor such as sensor 2650 (e.g., a light curtain) may be provided instead of (or in addition to) door 2608 to sense the presence of an operator in the vicinity of tray 22 and prevent rotation of the tray if the operator or any other obstruction is detected.

Similarly, a lid may be provided for carousel 14 to prevent contamination of cartridges 16 loaded therein, and to prevent injury to an operator due to rotation of the carousel. A lid sensor (not shown) may also be provided to detect the position (e.g., an open position or a closed position) of the lid. Rotation of carousel 14 may be prevented if the lid is not detected in a closed position by the lid sensor.

Each vial 18 that is inserted may be detected using a sensor such as sensor 2652 (e.g., a load sensor or an optical sensor) when placed in a vial puck recess 2604. When detected, the inserted vial may be moved to a scanning position by rotating vial tray 22 and then the inserted vial 18 may be rotated within its position in vial tray 22 using a vial rotation motor 2602 to allow the vial label to be scanned.

Figure 27:
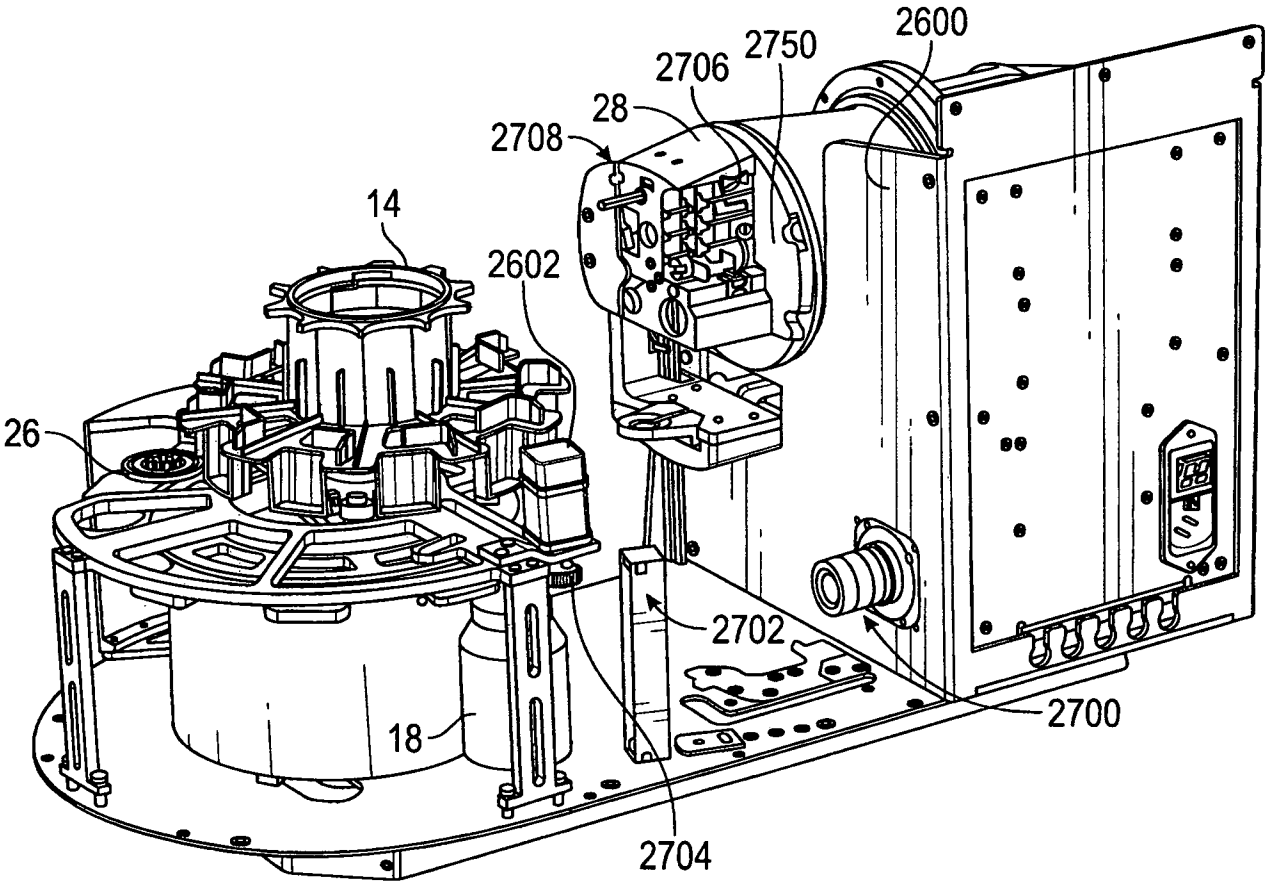
FIG. 27 illustrates a rear perspective view of the compounding system of FIG. 24 with portions of the housing removed in accordance with aspects of the present disclosure.

A reverse perspective view of compounder 10 is shown in FIG. 27 in which scanning components can be seen. In particular, a camera 2700 is mounted in an opening in chassis 2600 and configured to view a vial 18 in a scanning position. Motor 2602 may rotate vial 18 through one or more full rotations so that camera 2700 can capture images of the vial label. In some embodiments, an illumination device 2702 (e.g., a light-emitting diode or other light source) may be provided that illuminates vial 18 for imaging with camera 2700.

As shown in FIG. 27 one or more gears 2704 coupled to motor 2602 may be provided that engage corresponding gears on a vial puck 26 to which a vial 18 is attached at the scanning position. The vial tray 22 may be rotated so that the vial puck gears engage the rotation motor gears so that when the motor 2602 is operated the vial 18 is rotated.

FIG. 27 also shows how a magazine 2706 containing one or more manifolds may be mounted in a recess in pump head assembly 28. A magazine slot in magazine 2706 for the vapor waste manifold may be keyed to prevent accidental connection of a diluent manifold in that slot (or a waste manifold in a diluent slot in the magazine). Other diluent slots in magazine 2706 may have a common geometry and thus any diluent manifold can fit in the magazine diluent slots. One or more manifold sensors such as manifold sensor 2750 (e.g., an optical sensor) may be provided in the manifold recess in pump head assembly 28. Manifold sensor 2750 may be configured to detect the presence (or absence) of a manifold in a manifold recess (slot) in magazine 2706 to ensure that an appropriate manifold (e.g., a diluent manifold or waste manifold) is loaded at the expected position for compounding operations. In this way, the pump head may detect a manifold presence. The pump head and/or manifold sensors may communicate with the diluent load sensors to ensure proper positioning of the diluent manifolds. Various operational components 2708 such as valve actuators, needle actuators, mounting posts, a locking bayonet, and a drive pin can also be seen extended from pump head assembly 28 which are configured to secure and operate a pump cartridge 16 (e.g., as described above in connection with FIG. 4).

Figure 28:
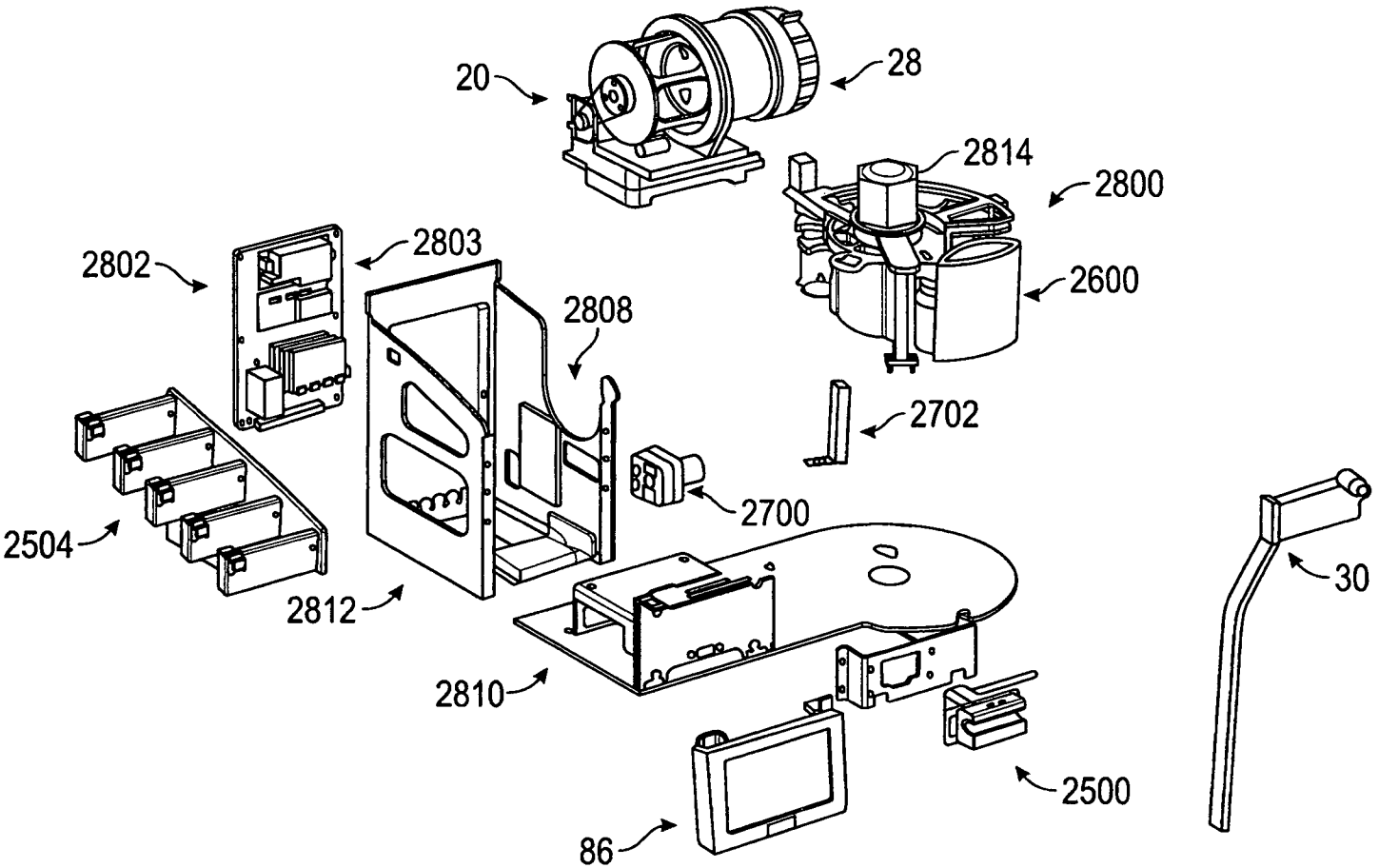
FIG. 28 illustrates an exploded perspective view of the compounding system of FIG. 24 in accordance with aspects of the present disclosure.

An exploded view of various components of compounder 10 is shown in FIG. 28. Components discussed above such as display 86, pump 2500, dose hanger 30, fluidics module 2504, pump drive 20 with pump head assembly 28, camera 2700, and lighting device 2702 are shown. Additional components such as a chassis base 2810 and chassis housing 2812 of chassis 2600 are also shown in FIG. 28. A rear panel 2802 having an electronics assembly 2803 can be mounted to chassis housing 12 and pump drive 20 may be seated in an opening 2808 in chassis housing 2812 that allows pump head assembly 28 to protrude from chassis housing 2812. Processing circuitry for managing operations of compounder system 10 may be included in electronics assembly 2803.

A vial tray and carousel drive assembly 2800 is also shown in which actuating door 2608 and a carousel hub 2814 can be seen. Carousel 14 may be placed onto carousel hub and rotated by vial tray and carousel drive assembly 2800 operating to rotate hub 2814 to move a selected cartridge in the carousel into position to be retrieved and operated by pump drive 20. Vial tray and carousel drive assembly 2800 may include separate drive assemblies for the vial tray and for the carousel such that vial tray 22 and carousel 14 may be rotated independently.

Figure 29:
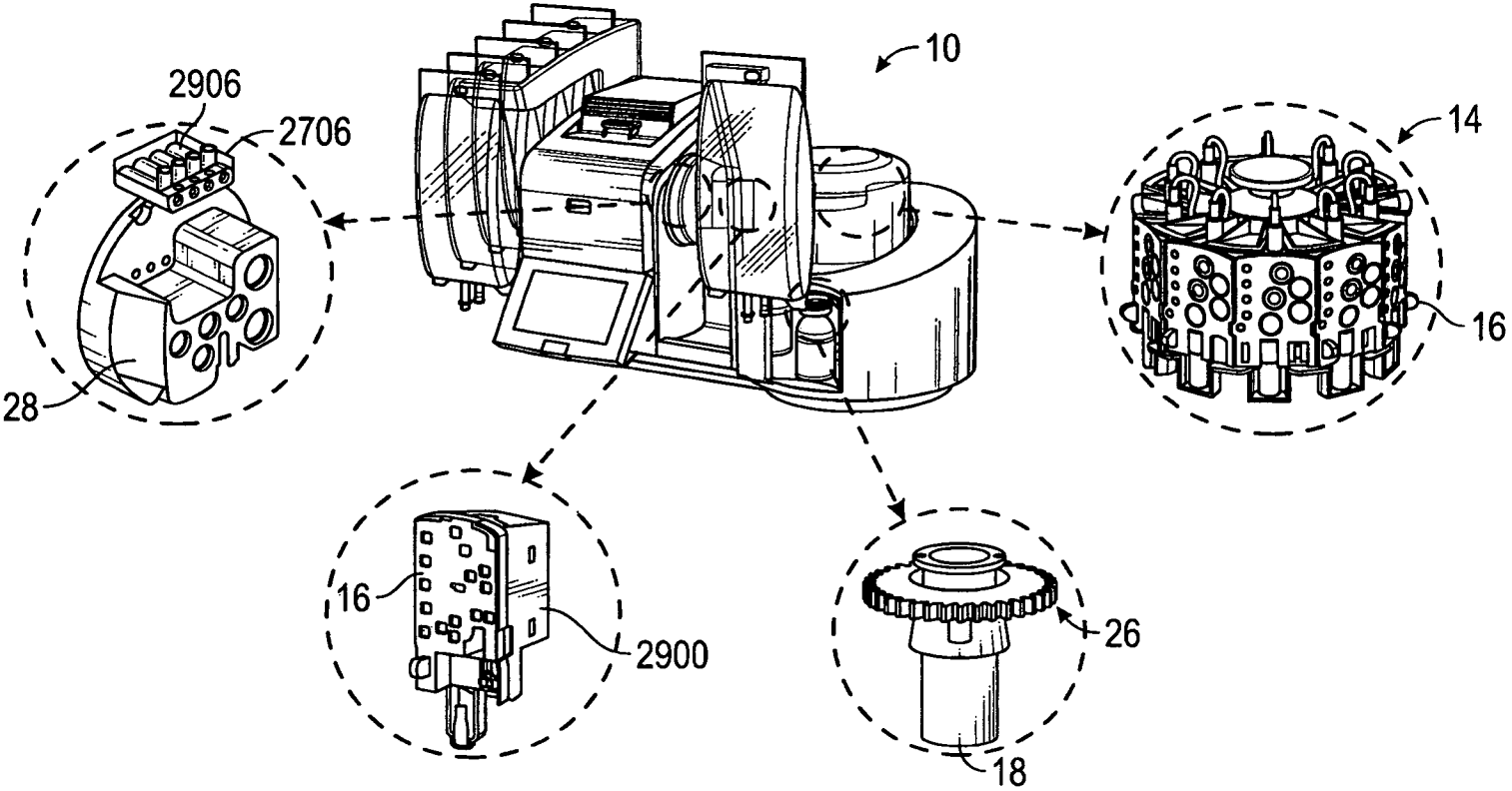
FIG. 29 illustrates a perspective view of the compounding system of FIG. 24 with various components shown in enlarged views for clarity in accordance with aspects of the present disclosure.

FIG. 29 shows another perspective view of compounder 10 highlighting the locations of various particular components such as the carousel 14 with cartridges 16 mounted therein, a cartridge 16 having a backpack 2900, a vial puck 26 for mounting vials 18, and pump head assembly 28 with a diluent magazine 2706 containing a plurality of manifolds 2906 in accordance with an embodiment. Further features of the carousel will be described hereinafter in connection with FIGS. 30-57.

Figure 30:
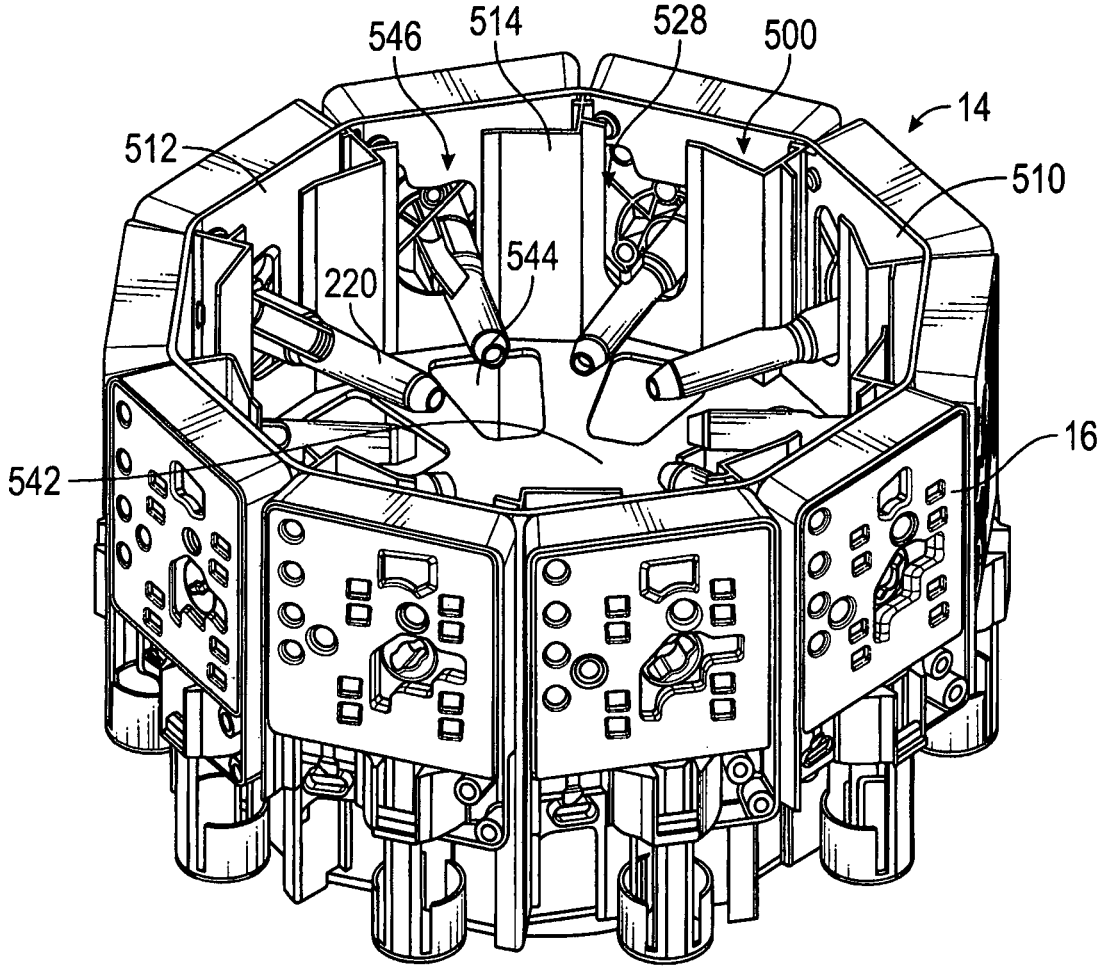
FIG. 30 illustrates a perspective view of the carousel of FIG. 23 with the cover removed in accordance with aspects of the present disclosure.
Figure 31:
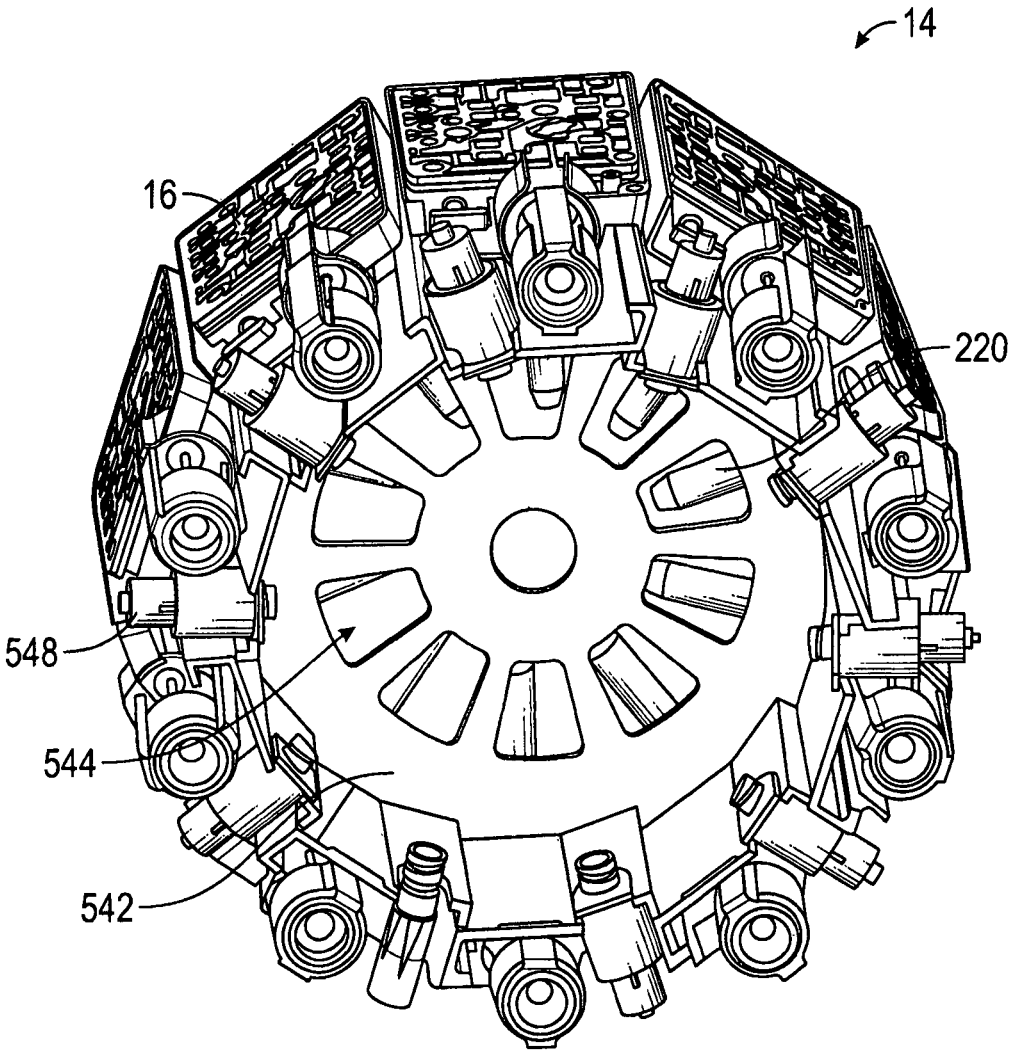
FIG. 31 illustrates a bottom perspective view of the carousel of FIG. 23 in accordance with aspects of the present disclosure.

Turning now to FIG. 30, the carousel 14 of FIG. 23 is shown with the cover 511 removed. In the example of FIG. 30, the carousel 14 comprises a frame 510 to support the cartridges 16 in pockets 500 around the outside of the frame 510. As described in further detail hereinafter, these pockets 500 are designed such that the individual cartridges 16 may slide into the pockets 500 and lock in place. Typically, the cartridges 16 are not removed by a user, but the pockets may include a release mechanism so that individual cartridges 16 can be removed and replaced with fresh ones.

Referring to FIGS. 30-36, various views of the carousel 14, cartridges 16 and frame 510 are illustrated in accordance with one or more embodiments. The frame 510 includes an outer wall 512, an inner wall 514, pocket walls 516, side walls 518, a support ring 520 and support posts 522 in FIGS. 32-34. In an alternative embodiment shown in FIGS. 30 and 31, the carousel 14 includes an outer wall 512, an inner wall 514, pocket walls 516 and a support floor 542 with openings 544 defined therein.

Figure 35:
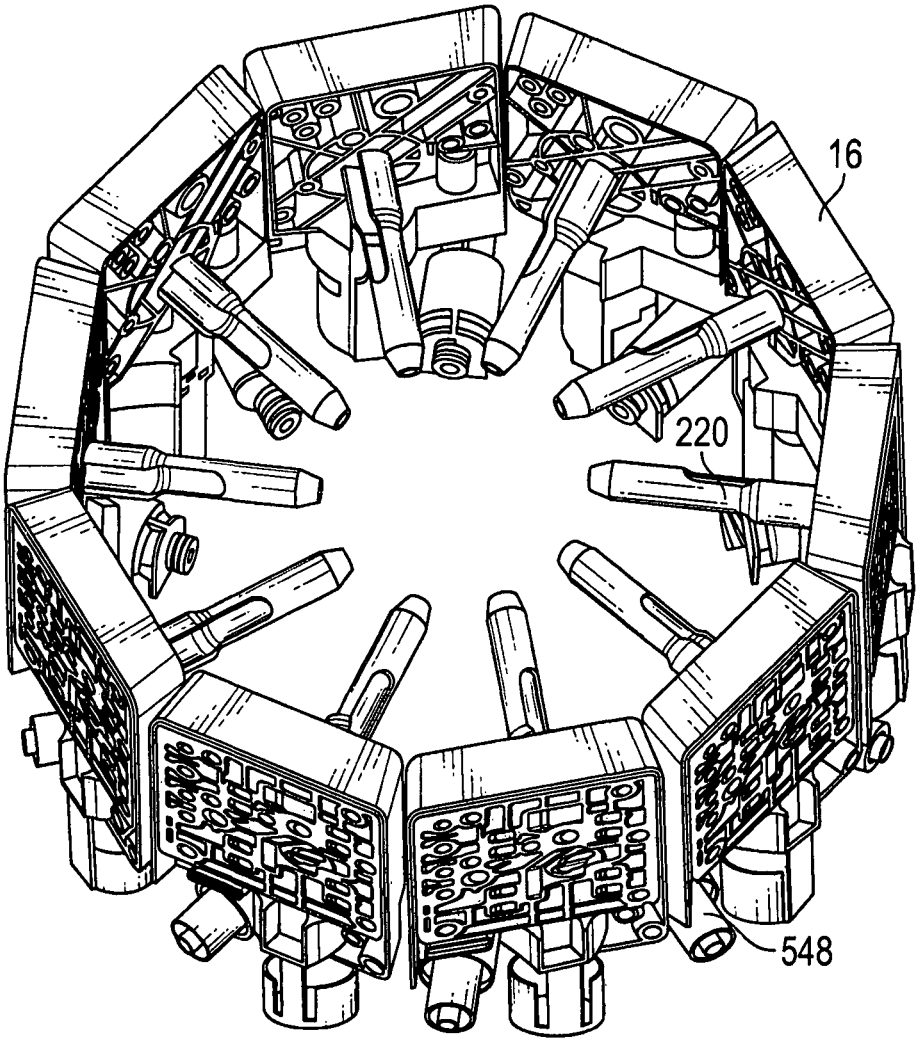
FIG. 35 illustrates a top perspective view of the cartridges in FIG. 23 with the carousel frame removed in accordance with aspects of the present disclosure.
Figure 36:
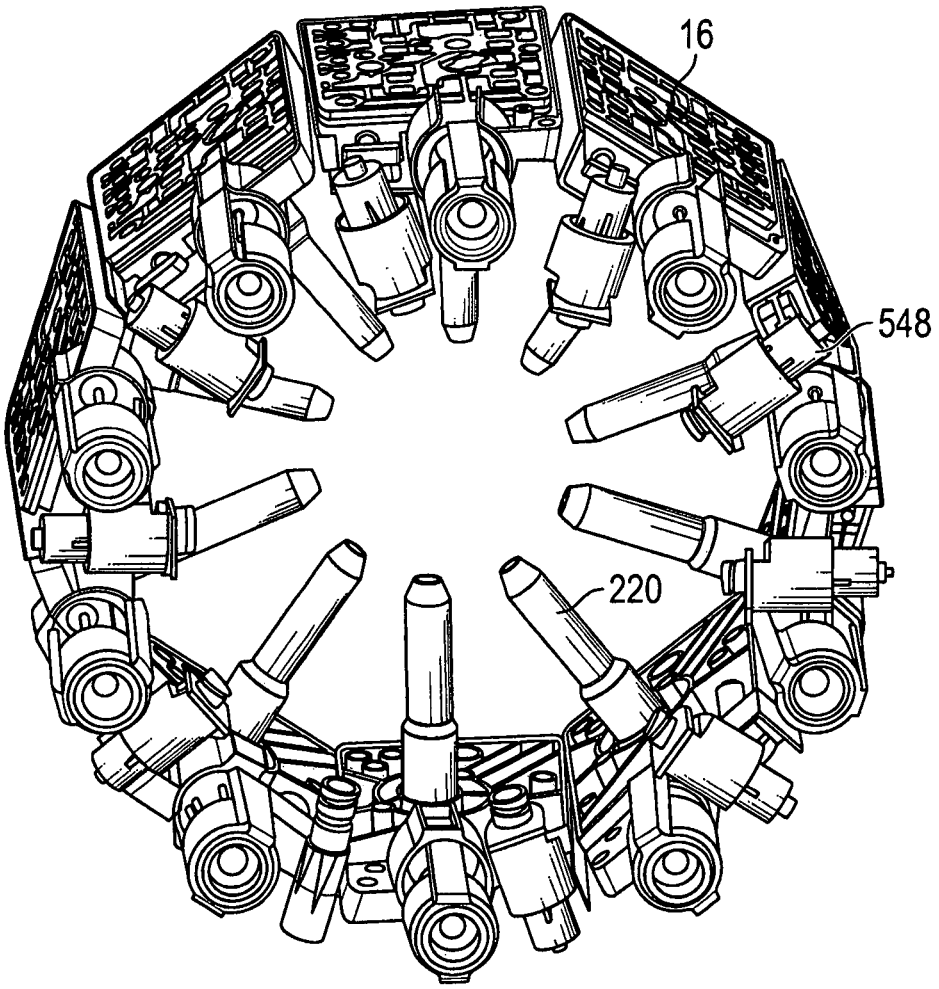
FIG. 36 illustrates a bottom perspective view of the cartridges in FIG. 23 with the carousel frame removed in accordance with aspects of the present disclosure.
Figure 37:
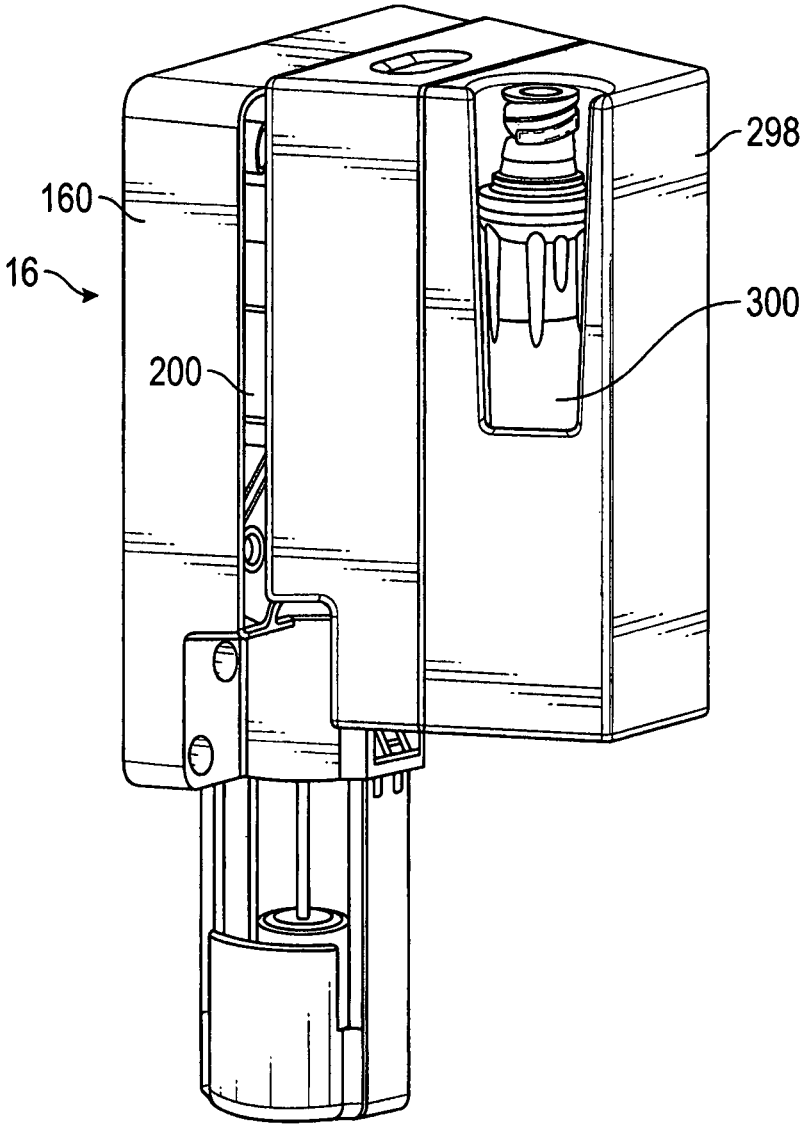
FIG. 37 illustrates a perspective view of an exemplary embodiment of a cartridge with a backpack attachment in accordance with aspects of the present disclosure.
Figure 38:
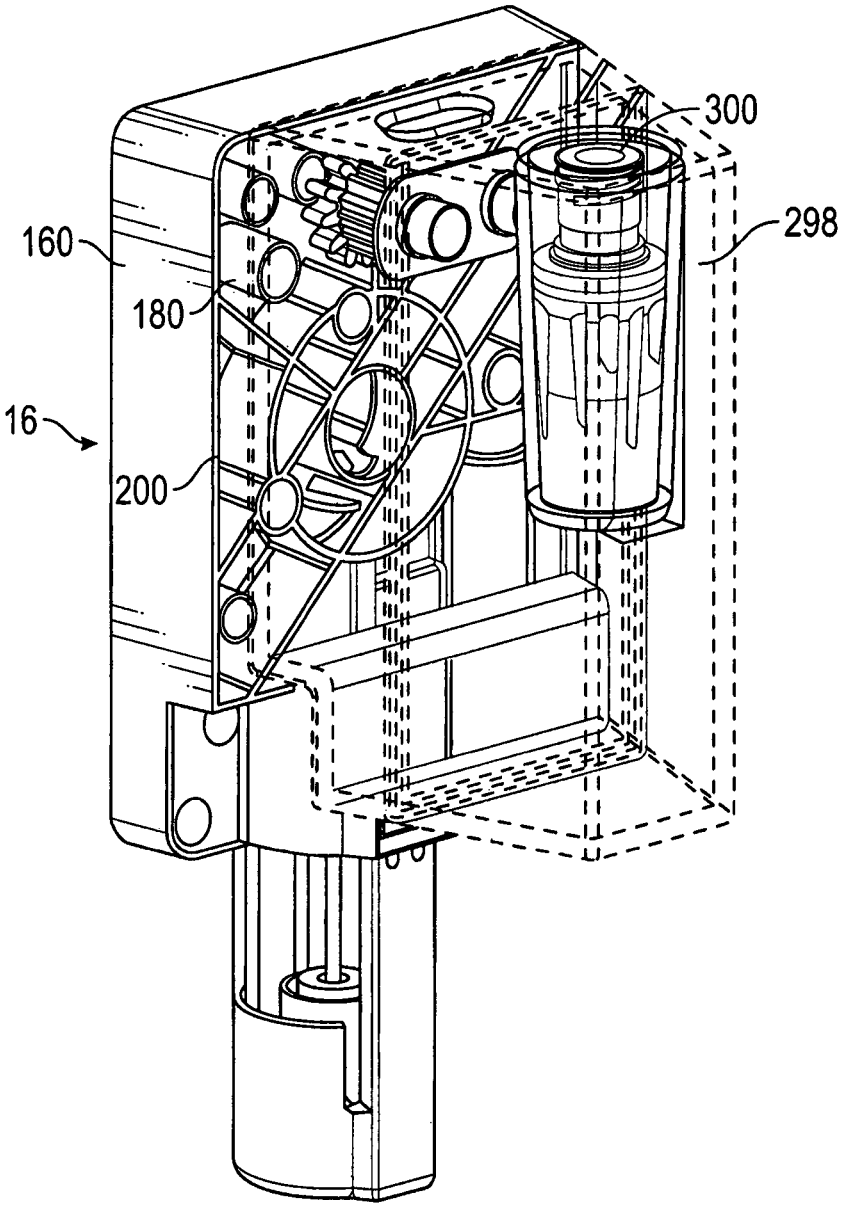
FIG. 38 illustrates a perspective view of the cartridge of FIG. 37 with a transparent backpack attachment in accordance with aspects of the present disclosure.

Referring to FIGS. 30, 31, 45 and 46, an embodiment of the carousel 14 and frame 510 is illustrated. This embodiment includes an outer wall 512, an inner wall 514, pocket walls 516 and a support floor 542 with a plurality of openings 544 defined therein. The outer wall 512 includes a cartridge opening 524 at each position where a cartridge 16 is mounted. This cartridge opening 524 allows the extension 220 of the cartridge 16 to protrude into the interior of the frame 510 of the cartridge 16, through the cartridge pocket 500. The outer wall 512 also includes mounting posts 522 on the front 530 of the outer wall 512 that are inserted into openings on the back of the cartridge 16 to hold the cartridge 16 in place while also allowing easy removal of the cartridge 16 from the carousel 14 by the pump head assembly 28 when the cartridge 16 is in use. A pair of pocket walls 516 extend from the back of the outer wall 512 and connect to front 534 of the inner wall 514 to form each pocket 500. The inner wall 514 is generally concentric with the outer wall 512. The inner wall 514 has an opening 536 defined therein allowing the extension 220 of each cartridge 16 to protrude into the interior of the carousel 14. The inner wall 514 also includes an opening 546 near the bottom side of the inner wall 514. This opening 546 provides a mounting point for a connector such as a Texium® attachment 548 that are each attached to the tube 38 that runs from the extension 220 on each cartridge 16. The Texium® attachment 548 can be pulled out by a user when the specific cartridge 16 is ready for use. A support floor 542 is connected to the back 550 of the inner wall and extends across the interior of the carousel 14. This support floor 550 is positioned between the cartridge openings 524 and the inner wall openings 536. Extension 220 may be provided as a tube management structure and may include an opening 1801 through which a tube (e.g., a tube from outlet port 180) can be fed to prevent tangling or other interference between tubes of various cartridges. In operation, a support tube 38 may be routed through each extension 220 and routed through a support floor opening 544 and attached to the Texium® attachment 548. In this way, the tubes 38 are kept separate from each other to prevent kinking and tangling, but a user may freely pull out the attachment 548 and the tube 38 from the carousel 14. FIGS. 35 and 36 show the array of cartridges 16 and Texium® attachments 548 without the frame 510 attached for clarity.

Figure 32:
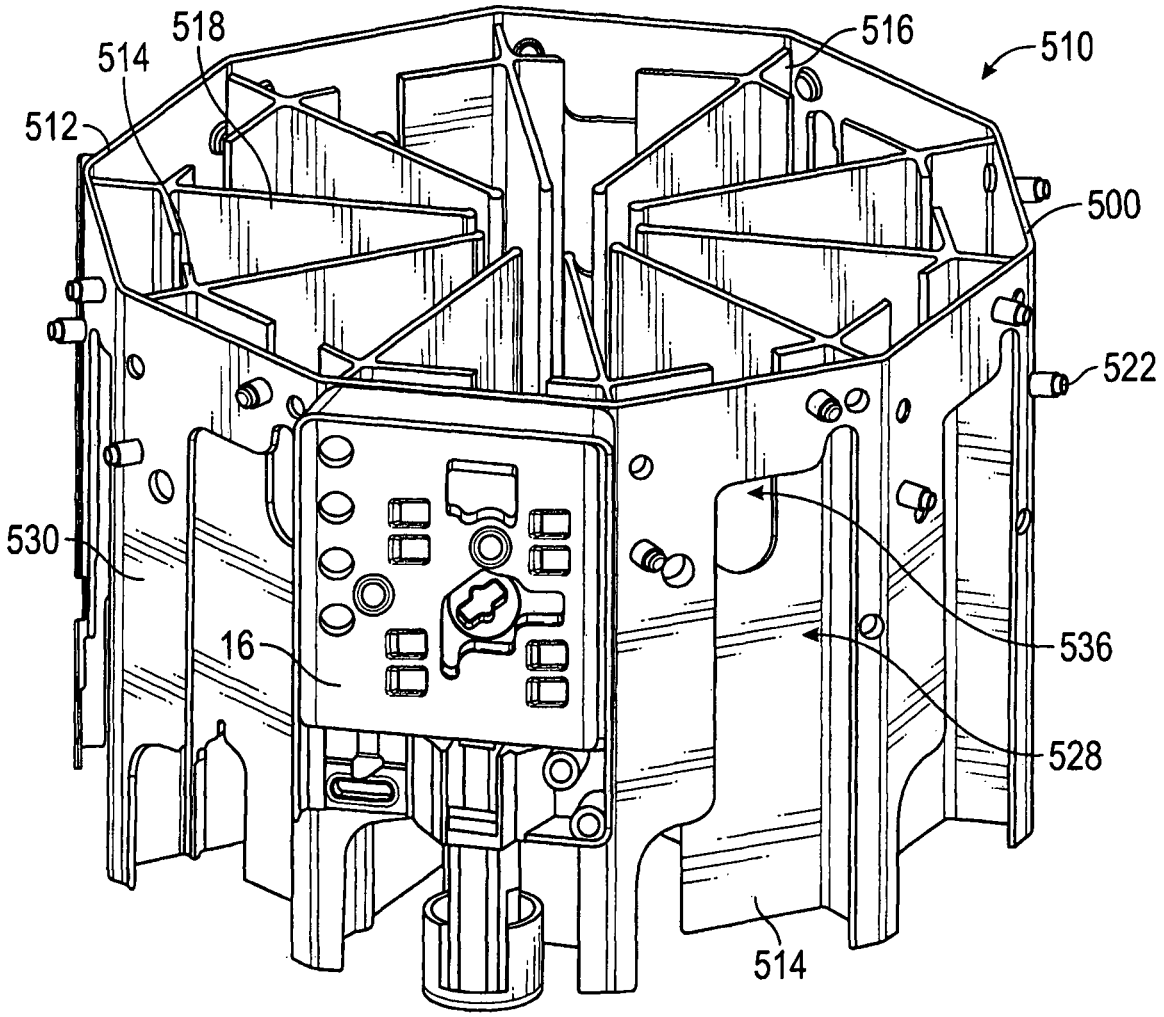
FIG. 32 illustrates a perspective view of the carousel of FIG. 23 with only one cartridge attached in accordance with aspects of the present disclosure.
Figure 33:
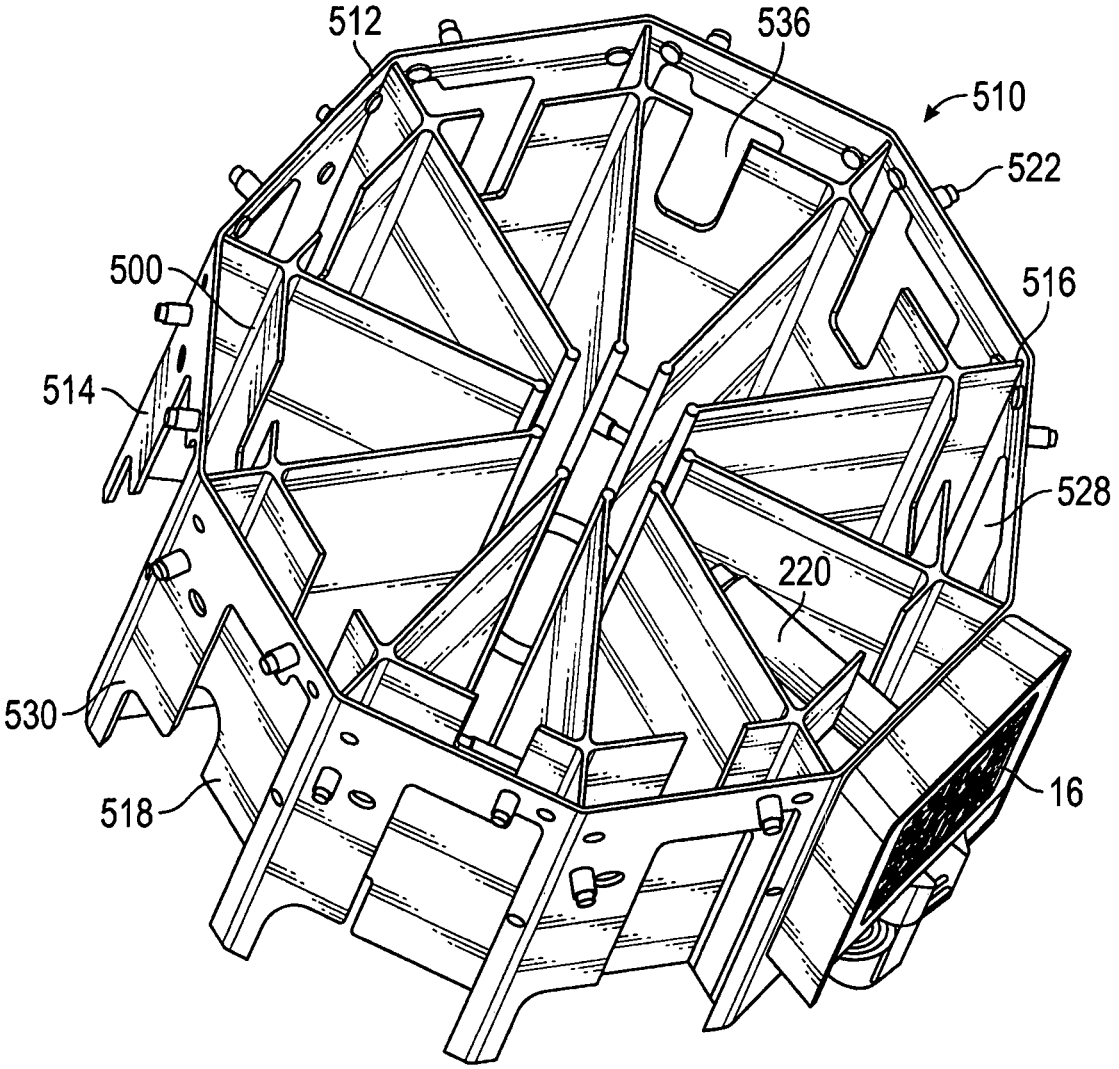
FIG. 33 illustrates a bottom perspective view of the carousel of FIG. 23 with only one cartridge attached in accordance with aspects of the present disclosure.
Figure 34:
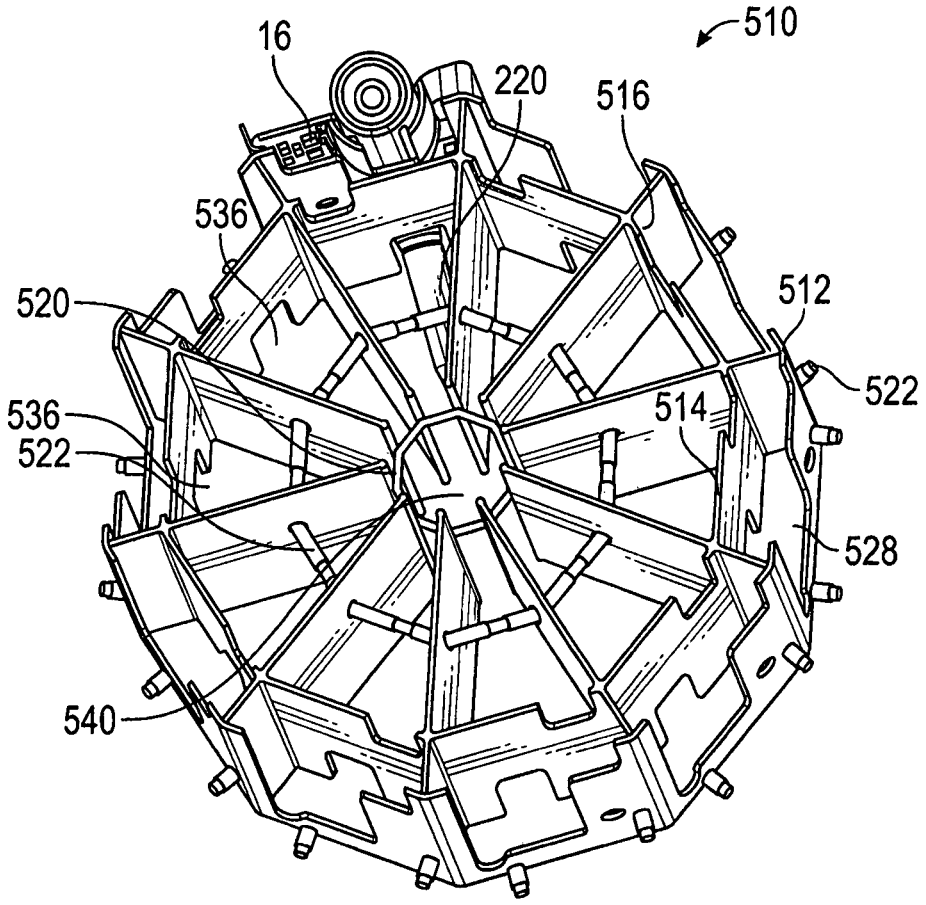
FIG. 34 illustrates a bottom perspective view of the carousel of FIG. 23 with only one cartridge attached in accordance with aspects of the present disclosure.

Referring to the illustrated embodiment in FIGS. 32-34, the outer wall 512 forms the outside surface of the frame 510 of the carousel 14. The outer wall 512 includes a cartridge opening 528 at each position where a cartridge 16 is mounted. This cartridge opening 528 allows the extension 220 of the cartridge 16 to protrude into the interior of the frame 510 through the cartridge pocket 500. The outer wall 512 also includes mounting posts 522 on the front 530 of the outer wall 512 that are inserted into openings on the back of the cartridge 16 to hold the cartridge 16 place while also allowing easy removal of the cartridge 16 from the carousel 14 by the pump head assembly 28 when the cartridge 16 is in use. A pair of pocket walls 516 extend from the back of the outer wall 512 and connect to front 534 of the inner wall 514 to form each pocket 500. The inner wall 514 is generally concentric with the outer wall 512. The inner wall 514 has an opening 536 defined therein that allows the extension 220 of each cartridge 16 to protrude into the interior of the carousel 14. At each point 538 where the outer wall 512, inner wall 514 and pocket wall 518 intersect, a side wall 520 extends towards the middle 540 of the carousel 14. These side walls 520 connect to a supporting ring 520 in the middle 540 of the carousel 14 and provide extra support for the carousel 14 while also keeping the tubes 38 from each cartridge 16 separate. A support post 522 extends between each side wall 518 for additional support.

An embodiment of the cartridge 16 utilizing a tube management structure implemented as a "backpack" to retain the flexible tubing 38 is illustrated in FIGS. 37-40. The backpack 298 is attached to the back 200 of the cartridge frame 16 and one end of the flexible tube 38 is attached to the outlet port 180 on the back 200 of the cartridge frame 16. The backpack 298 comprises a housing with an opening for a Texium® attachment 300 attached to the tube 38 from the outlet port 180 on the cartridge 16 so a user can pull the Texium® attachment 300 out of the backpack 298, pull tubing 38 from within the backpack and attach it to the receiving container 32.

Figure 39:
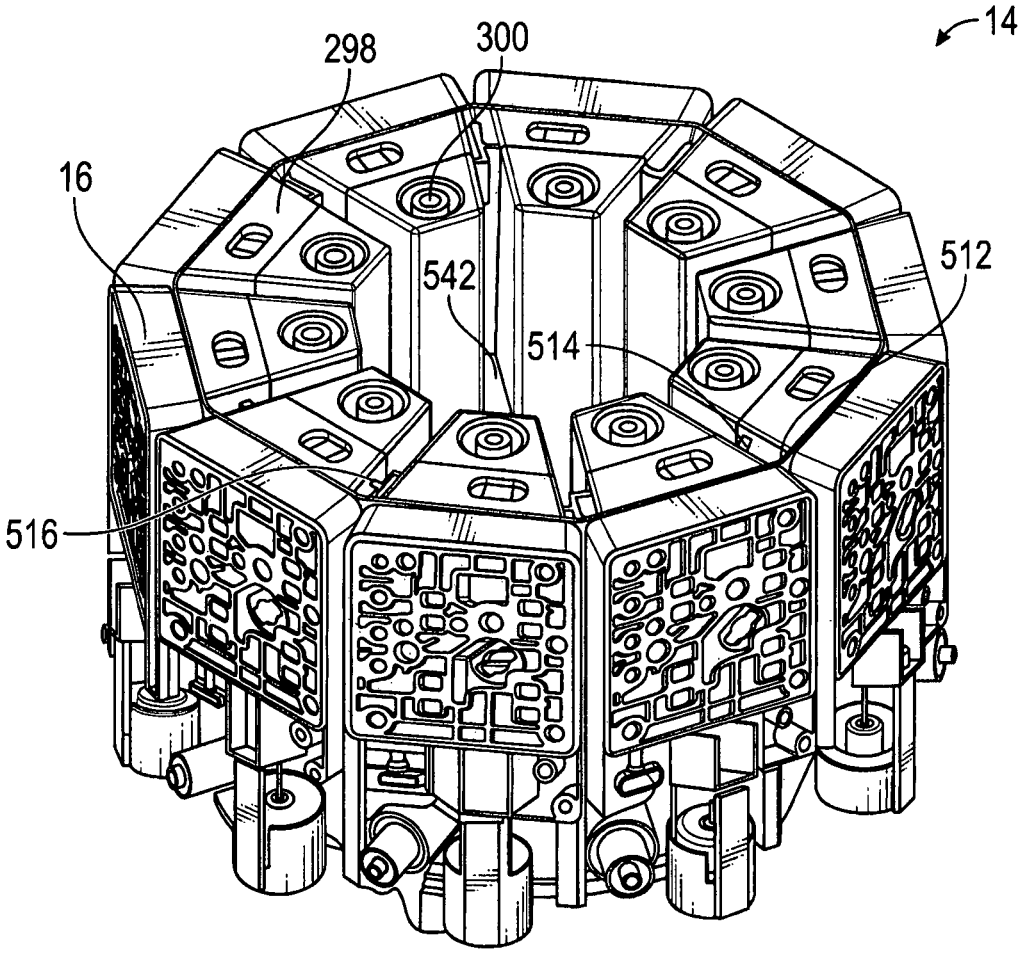
FIG. 39 illustrates a perspective view of an exemplary embodiment of a carousel with cartridges including backpacks in accordance with aspects of the present disclosure.
Figure 40:
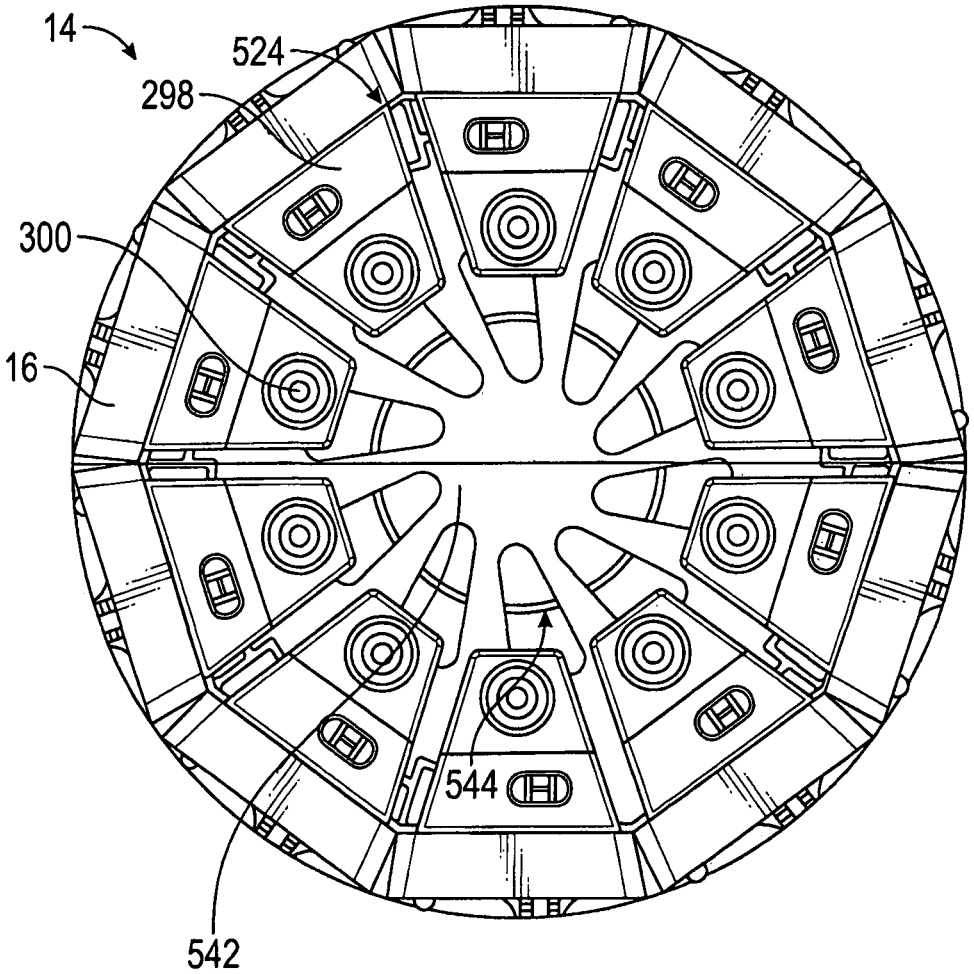
FIG. 40 is a top plan view of the carousel of FIG. 39 in accordance with aspects of the present disclosure.

FIGS. 39 and 40 illustrate a carousel 14 with an implementation of a backpack tube management feature of the cartridges 16 installed. This embodiment also includes an outer wall 512, an inner wall 514, pocket walls 516 and a support floor 542 with a plurality of openings 544 defined therein. The outer wall 512 includes a cartridge opening 524 at each position where a cartridge 16 is mounted. In this embodiment, the cartridge opening 524 is large enough to allow the backpack 298 to protrude into the interior of the carousel 14. The support floor 542 extends from the back 550 of the inner wall 514 and may be positioned such that the backpack 298 is supported thereon in one embodiment. In some embodiments, backpack 298 may be configured to snap or otherwise be guided into and secured in a corresponding slot in carousel 16. In these embodiments, when the cartridge 16 is pulled out of the carousel 14 by the pump head assembly 28, the backpack 298 is accessible by a user and the user may pull the Texium® attachment 300, along with associated tubing, out of the backpack 298 to connect it to the receiving container 32.

Figure 41:
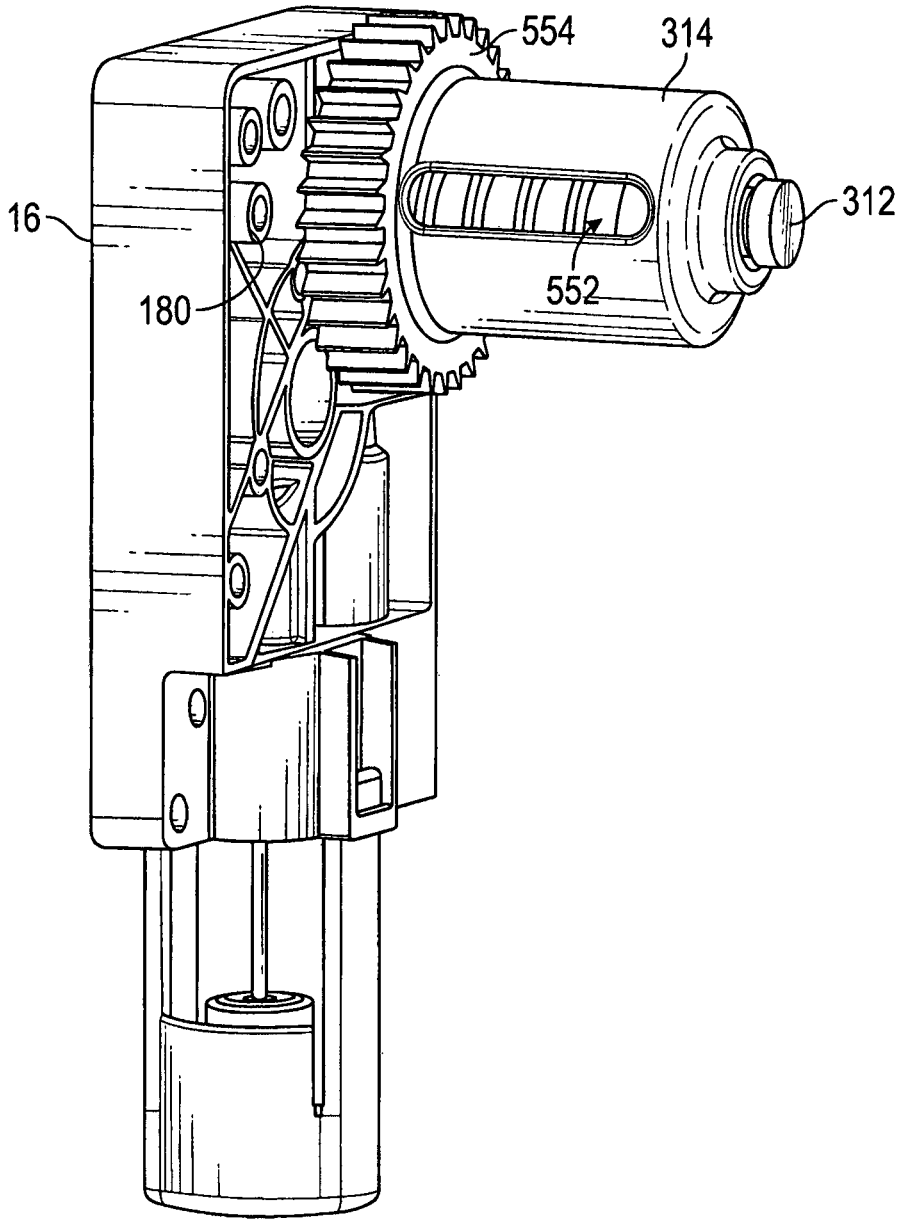
FIG. 41 illustrates a perspective view of a cartridge with a spool retractor attached in accordance with aspects of the present disclosure.
Figure 42:
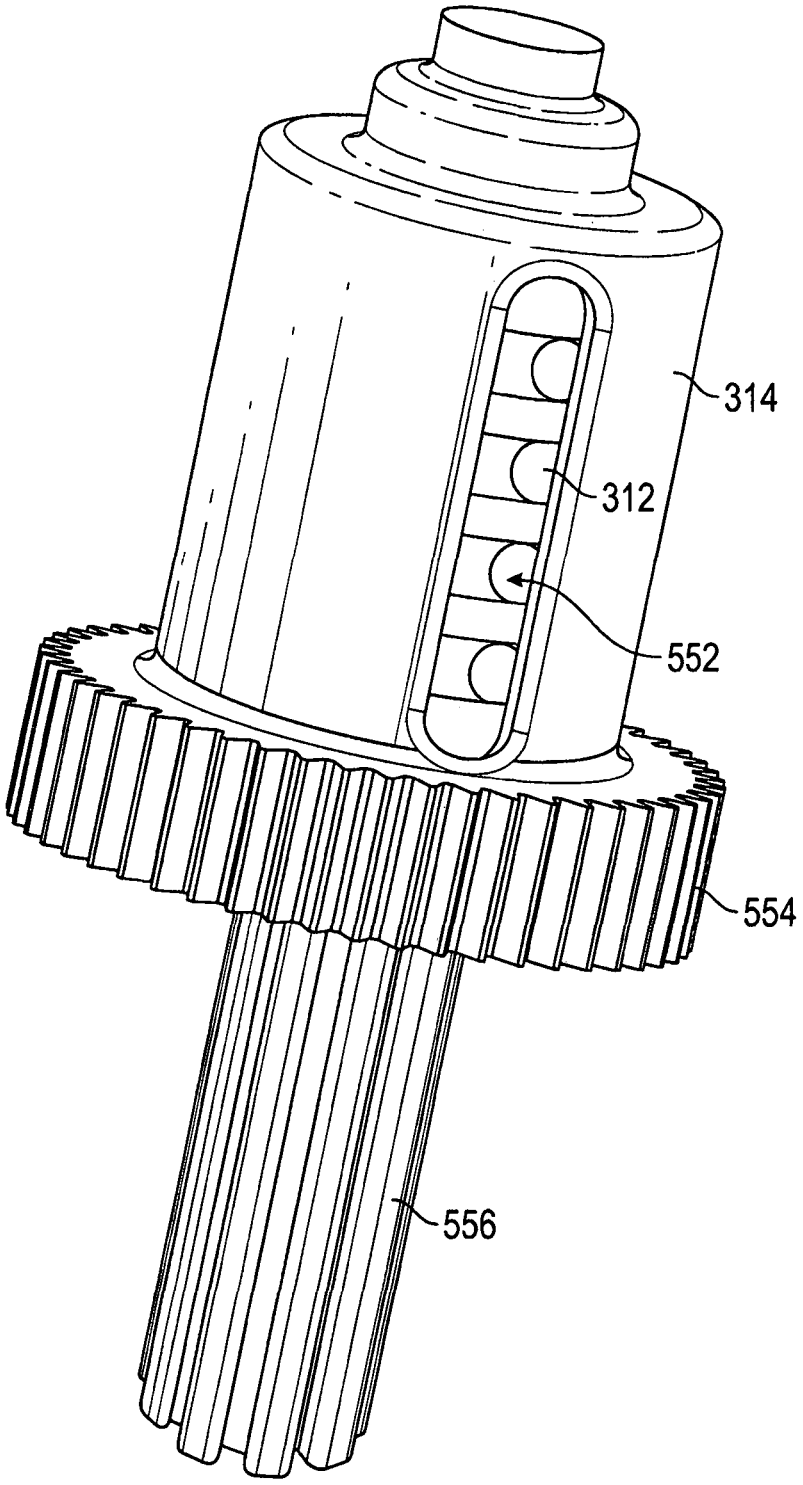
FIG. 42 illustrates a perspective view of the spool retractor of FIG. 41 in accordance with aspects of the present disclosure.
Figure 43:
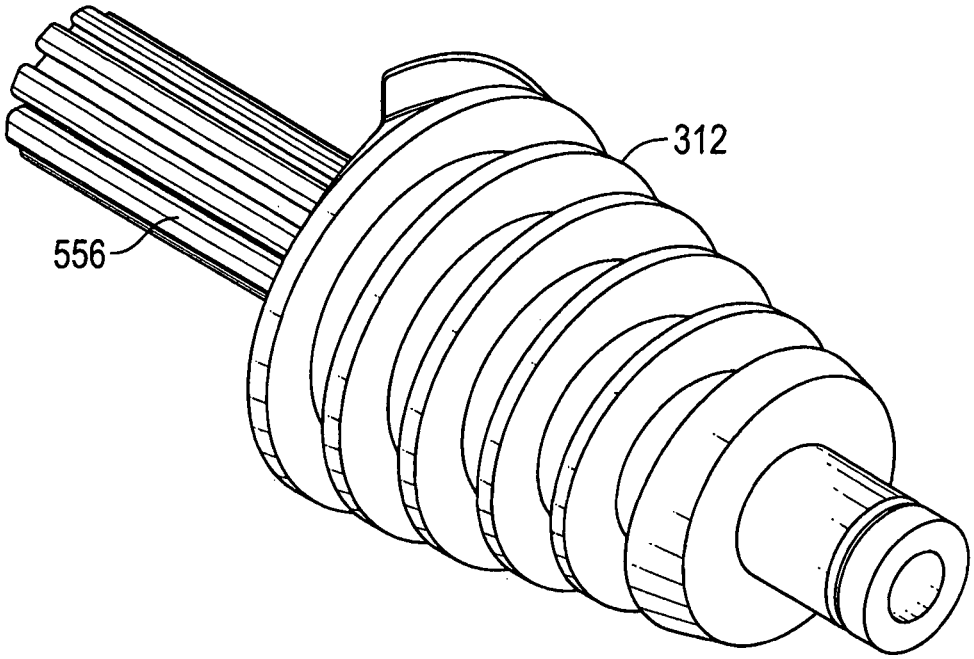
FIG. 43 illustrates a perspective view of the screw of FIG. 42 inside a spool in accordance with aspects of the present disclosure.
Figure 44:
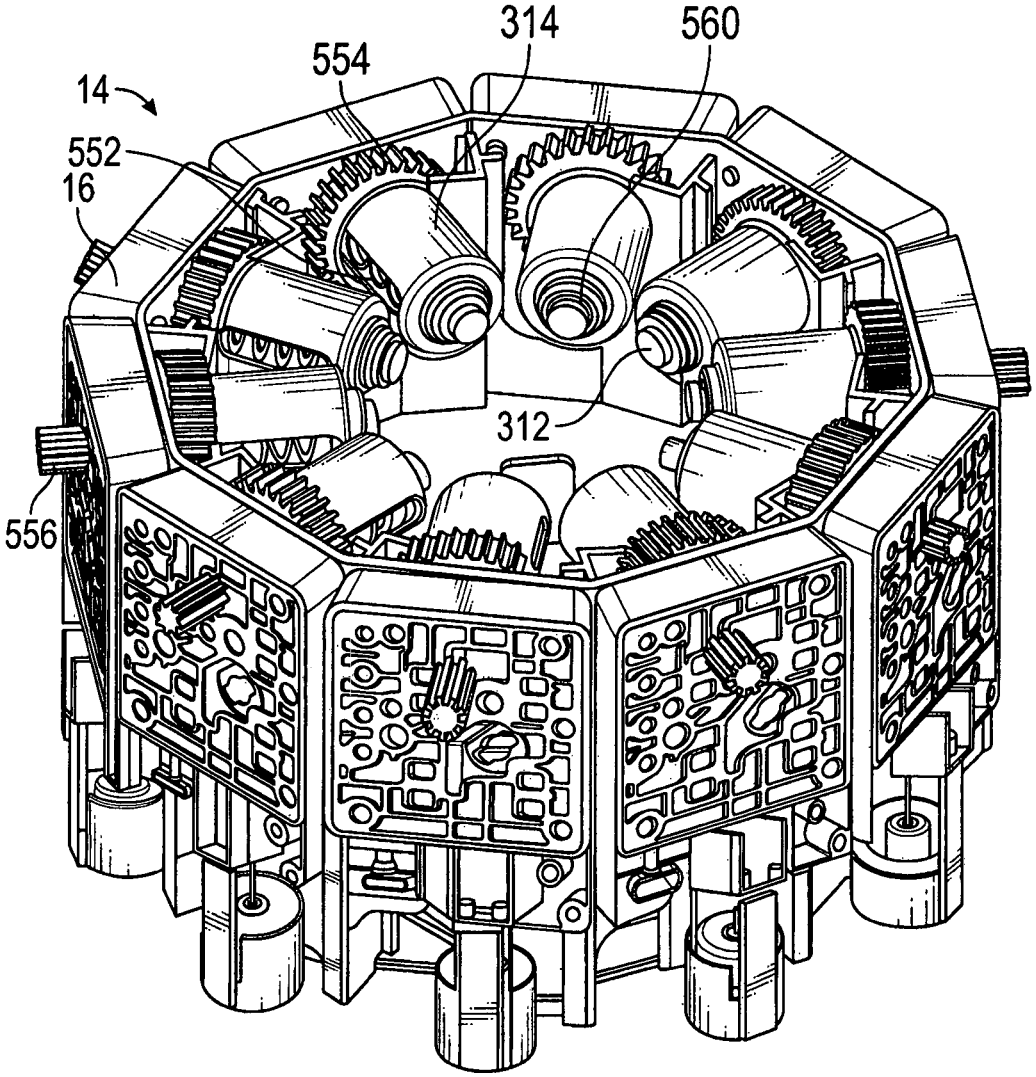
FIG. 44 illustrates a perspective view of an exemplary embodiment of a carousel with an array of cartridges of FIG. 43 in accordance with aspects of the present disclosure.

FIGS. 41-44 illustrate another alternative embodiment of a retraction mechanism for tube management and the associated carousel 14. In this embodiment, a screw 312 is enclosed in a screw chamber 314. The screw chamber 314 is generally cylindrical and has an opening 552 on the side to allow a tube 38 to coil into the threads of the screw 312. As the screw 312 rotates, the tube 38 is drawn along the threads of the screw to retract the tube 38. A gear 554 is defined on one end of the screw chamber 314. A gear 556 is also defined on a post extending from the screw 312. The screw chamber 314 also includes an opening 560 at an end thereof such that when the screw 312 is inserted into the screw chamber 314, the gear 556 on the screw 312 extends out through the opening 560. As illustrated in FIG. 41, the screw chamber 314 is mounted on the back of the frame 160 of a cartridge 16 with the gear 556 on the screw 312 extending through the cartridge 16 and protruding out of the front of the cartridge 16.

Figure 45:
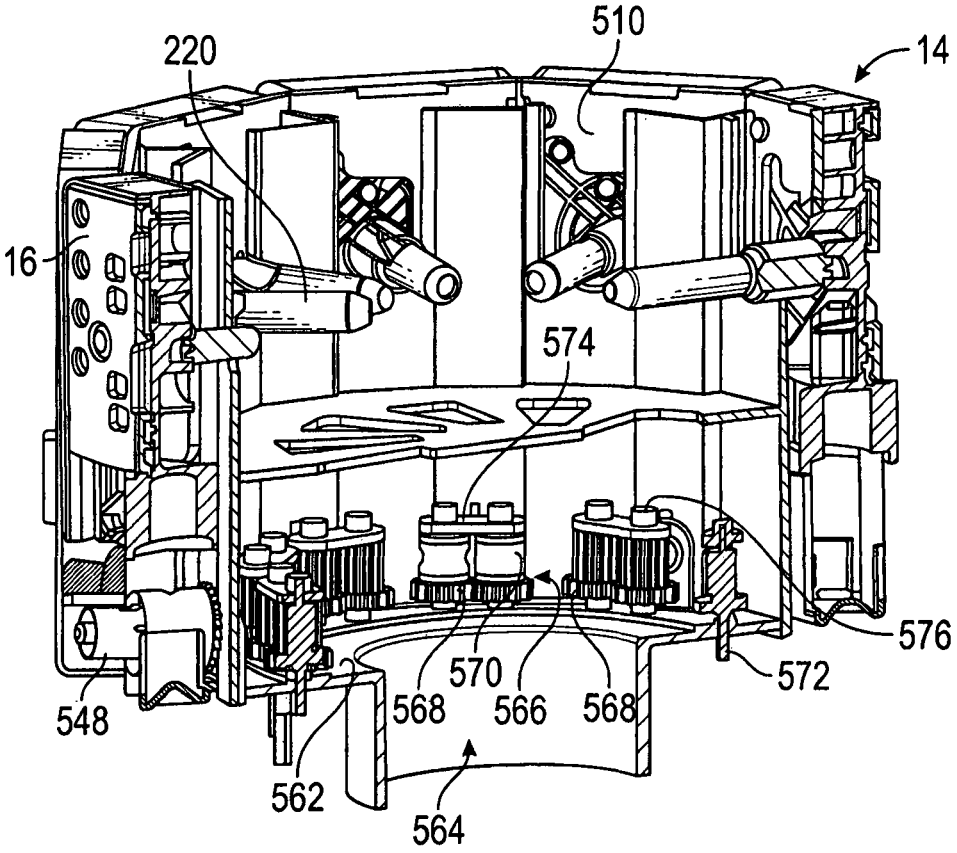
FIG. 45 illustrates a cross sectional view of an exemplary embodiment of a carousel with a tube retraction mechanism in accordance with aspects of the present disclosure.
Figure 46:
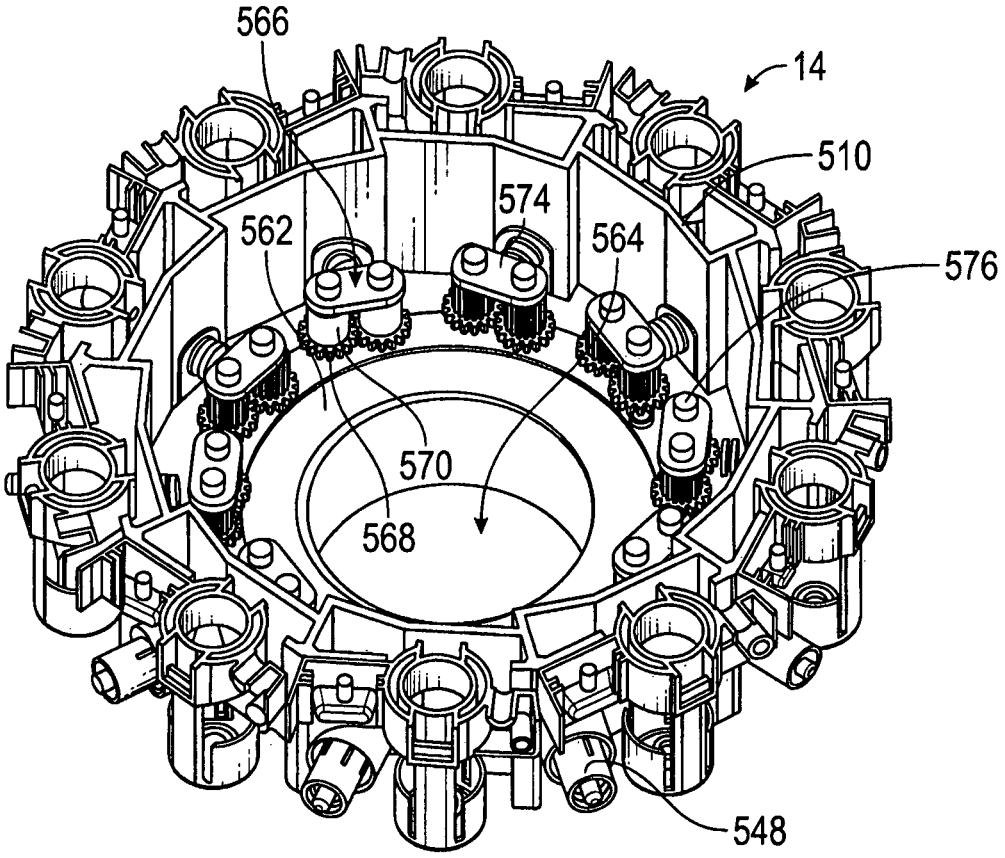
FIG. 46 illustrates a view of the bottom portion of the carousel of FIG. 45 in accordance with aspects of the present disclosure.

Another embodiment of a retraction mechanism and the associated carousel 14 is illustrated in FIGS. 45 and 46. In this embodiment, a bottom support 562 is defined near the bottom of the carousel 14. The bottom support 562 is defined as an annular ring that matches the inside dimensions of the inner wall 514 of the carousel 14 and includes an opening 564 defined therein. Texium® attachments 548 are mounted in the openings 546 near the bottom sides of the inner wall 514. Tubes 38 running from the outlet port 180 through extension 220 on each cartridge 16 are attached to each Texium® attachment 548. A gearing mechanism 566 is mounted on the bottom support 562 behind each Texium® attachment 548. The gearing mechanism 566 is comprised of two gears 568 mounted on the bottom support 562 such that rotation of the carousel 14 causes the gears 568 to rotate as well. Each gear 568 has an extension 570 with concave sides mounted on a post 572 that extends through the gear 568 and through a panel 574 on top of the extension 570. A locking post 576 is positioned on top of each post 572 on top of the panel 572 to maintain the position of the post 572 while allowing it to rotate freely. In operation, each tube 38 is threaded through the two extensions 570 and then attached to the Texium® attachment 548.

Figure 47:
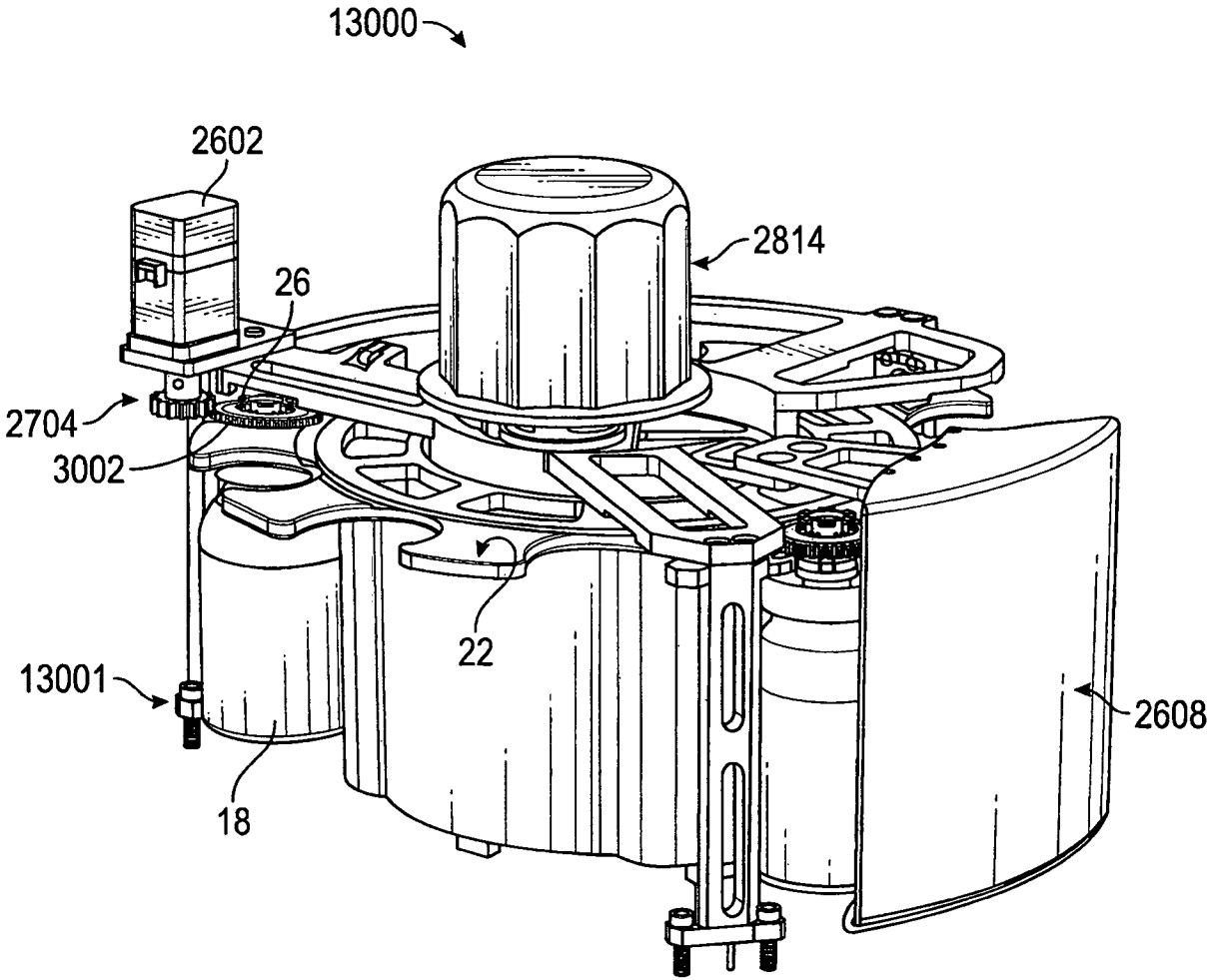
FIG. 47 illustrates a perspective view of a vial and carousel drive assembly for a compounding system in accordance with aspects of the present disclosure.

Turning now to FIG. 47, a perspective view of a vial and carousel drive assembly 3000 is shown, according to an embodiment. In the example, of FIG. 47, vial tray 22 has been rotated so that a vial 18 is in an imaging position 3001 at which the label on the vial may be imaged. In the imaging position 3001, gears 3002 of the vial puck that is attached to the vial 18 are engaged with gears 2704 of motor 2602. In this way, motor 2602 can be operated to rotate vial 18 while vial 18 is in the vial recess of vial tray 22 at the imaging position. While motor 2602 rotates vial 18, a camera such as 2700 (see, e.g., FIGS. 27 and 28) may capture images of the label on vial 18. A light source such as light source 2702 may be operated to illuminate at least a portion of the label while the images are captured. Light source 2702 may be a line-wise light source configured to illuminate a vertical line on the vial so while the vial is rotated so that each captured image includes an image of a vertical line on the vial. The vertical line images may be combined using processing circuitry associated with the camera and/or processing circuitry such as one or more processors for the compounder system to form a rectilinear image of the entire vial label.

Figure 48:
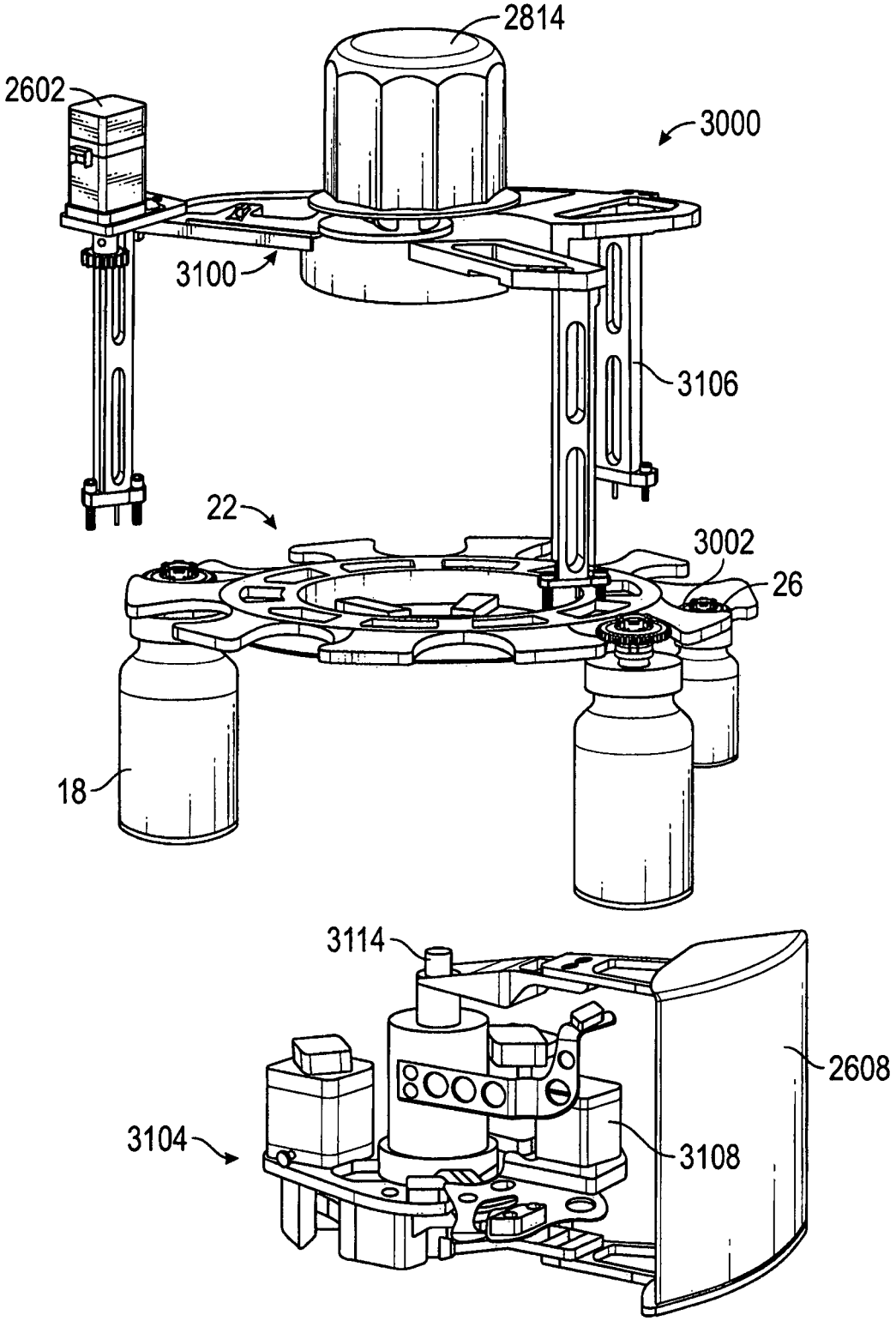
FIG. 48 illustrates an exploded perspective view of the vial and carousel drive assembly of FIG. 30 in accordance with aspects of the present disclosure.

FIG. 48 shows an exploded perspective view of the vial and carousel drive assembly 3000. As shown in FIG. 48, assembly 3000 may include a carousel support frame 3100 having legs 3106 on which the carousel hub 2814 and vial spin drive 2602 are mounted. Assembly 3000 may also include a drive mechanism having one or more additional motors such as motor 3108 configured via a plurality of gears and/or belts to actuate door 2608, rotate vial tray 22, and/or rotate carousel hub 2814 to rotate a carousel of cartridges mounted thereon. As shown, vial tray 22 may be disposed at least partially between carousel support frame 3100 and drive mechanism 3104.

As shown in FIGS. 47 and 48, carousel hub 2814 may have a polygonal shape. Carousel 14 may be provided with a central opening having a corresponding polygonal shape so that, when carousel 14 is placed onto carousel hub 2814 and carousel hub 2814 is rotated, the carousel is correspondingly rotated. However, this is merely illustrative. Carousel hub 2814 may be provided with other shapes such as a "D" shape or any other suitable shape that corresponds to the shape of the central opening in carousel 14 such that, when carousel 14 is placed onto carousel hub 2814 and carousel hub 2814 is rotated, the carousel is correspondingly rotated. As shown in FIG. 48, drive mechanism 3104 may have an extension 3114 that extends into carousel hub 2814 to rotate hub 2814 responsive to operation of a motor of drive mechanism 3104.

Figure 49:
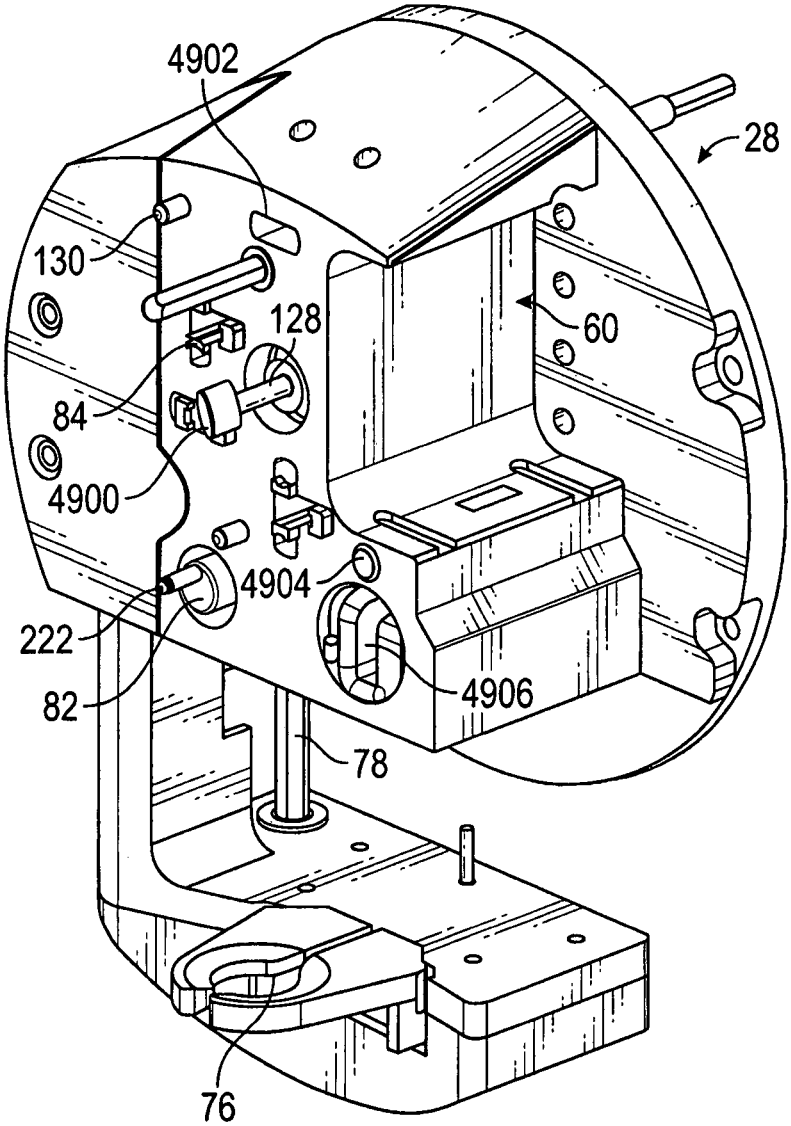
FIG. 49 illustrates a pump head assembly of a pump drive in accordance with aspects of the present disclosure.

FIG. 49 shows another embodiment of the pump head assembly 28. As shown, in the embodiment of FIG. 49, pump head assembly 28 includes vial grasping arms 76, vial lift 78, pump piston eccentric drive shaft 82, valve actuation mechanisms 84, as well as the motors (not explicitly shown) that allow the pump drive mechanism 20 to move forward and back and to rotate in order to mix the pharmaceutical in the vial 18 once the diluent has been added to it. As shown in FIG. 49, bayonet 128 may include an end portion 4900 that forms the top of a T-shaped bayonet. In this embodiment, the end portion 4900 may be rotated to actuate a release mechanism of a cartridge backpack to release the backpack and cartridge from the carousel and to simultaneously bear against a ramp portion of the cartridge to lift and pull the cartridge and backpack from the carousel. Further details of the cartridge/backpack release mechanism and the ramp portions of the cartridge are discussed hereinafter in connection with FIGS. 50-55 in accordance with one or more embodiments.

As shown in FIG. 49, pump head assembly 28 may include other devices and structures such as a pressure sensor 4904 configured to sense the pressure in a fluid pathway in a pump cartridge, an air-in-line sensor 4906 configured to receive an air-in-line fitment of a pump cartridge, and a connector sensor 4902 configured to view a connector such as a Texium® connector in a backpack of a pump cartridge for determining whether the connector has been placed into the backpack to determine whether to release the cartridge and backpack from the pump head assembly and back into the carousel (e.g., by turning bayonet 128 in a direction opposite to the direction the bayonet was turned to lift and pull the cartridge from the bayonet).

Figure 50:
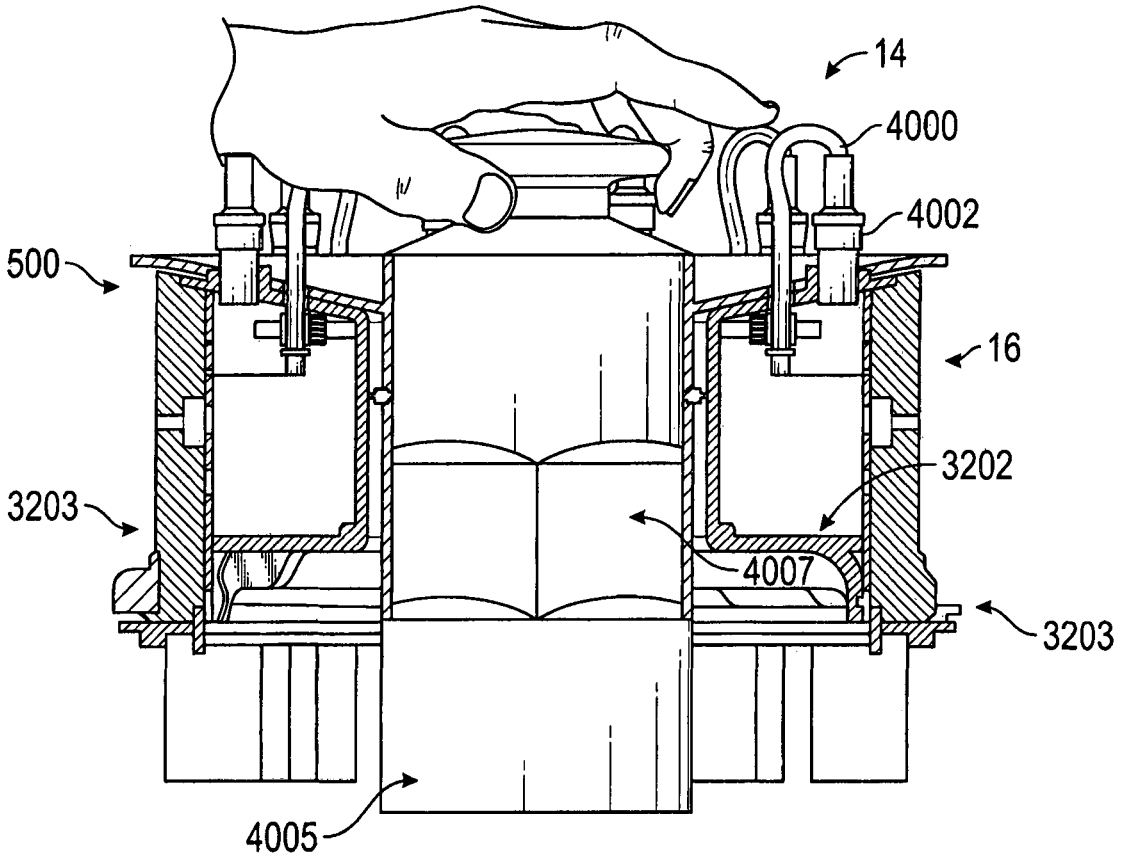
FIG. 50 illustrates a cross-sectional view of an embodiment of a carousel having cartridges disposed thereon in accordance with aspects of the present disclosure.
Figure 51:
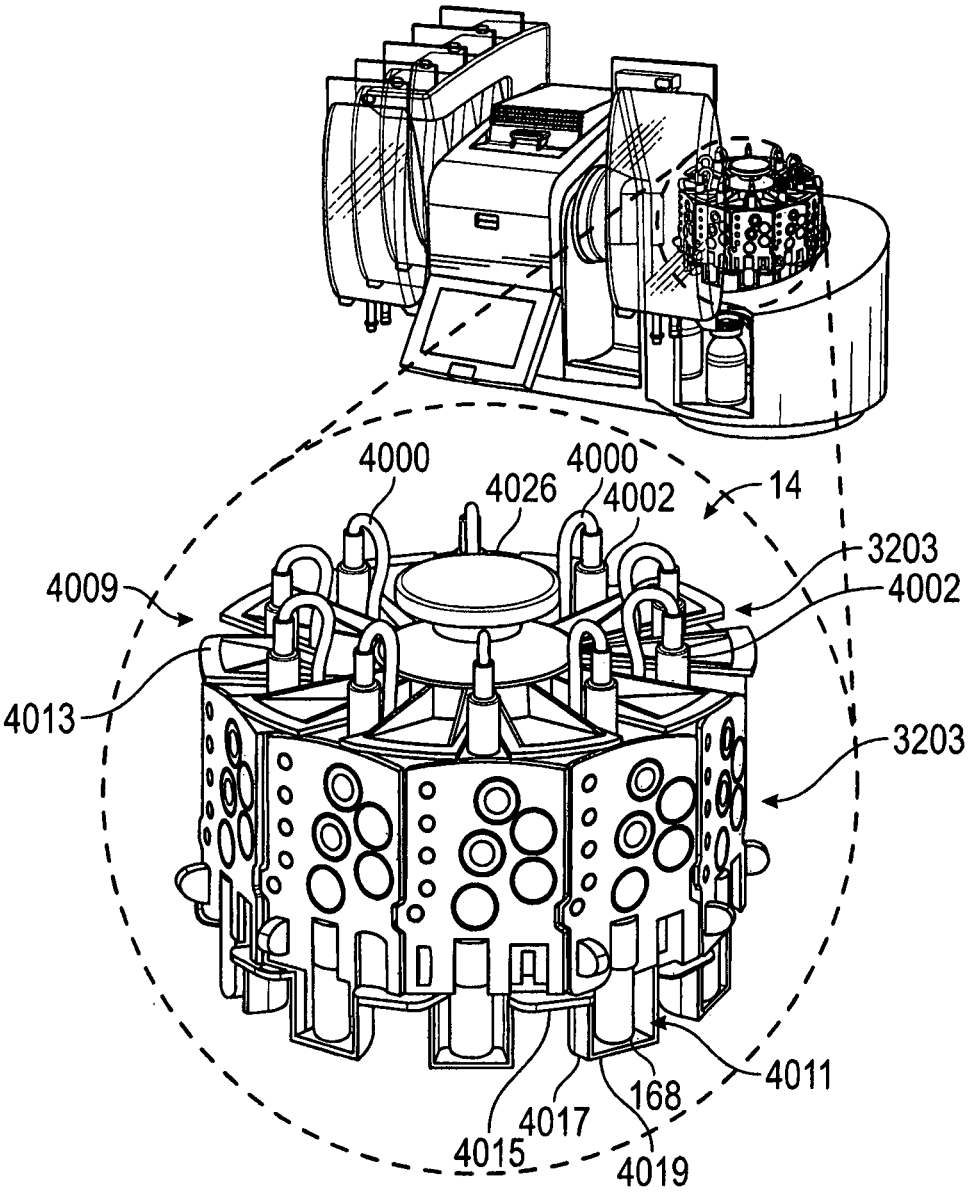
FIG. 51 illustrates a perspective view of the carousel of FIG. 50 in accordance with aspects of the present disclosure.

FIG. 50 shows a cross sectional view of a carousel 14 having a plurality of cartridge and backpack assemblies 3203 mounted in corresponding cartridge pockets 500 in accordance with one or more embodiments. As shown in FIG. 50 a connector 4002 such as a Texium® connector may be disposed in an opening in each backpack 3202 of each cartridge and backpack assembly 3203. The connector 4002 may be disposed at an end of tubing 4000 (e.g., an implementation of tubing 38 of FIG. 1) that extends from the connector into the internal cavity of each backpack 3202 and connects to an output port of the cartridge 16 attached to that backpack. A perspective view of carousel 14 is shown in FIG. 51. As shown in FIG. 51, cartridge and backpack assemblies 3203 may be disposed around the circumference of carousel 14 and carousel 14 may include recesses 4009 in an upper surface 4013 for accommodating tubing 4000 and connector 4002 of each cartridge and backpack assembly 3203. Carousel 14 may also include a bottom surface 4015 having a plurality of extensions 4017 that each extends downward therefrom and each has a recess 4011 that accommodates needle housing 168 of a corresponding cartridge and backpack assembly 3203. Extensions 4017 may have a protective bottom surface 4019 that runs underneath a needle housing 168 of an installed cartridge and prevents actuation of the needle housing that could expose an operator to the needle assembly therein. Protective bottom surface 4019 may also serve as a surface for collecting any small amount of drug that may inadvertently drip from the needle (or needle housing) of the cartridge 16). A handle 4026 may be provided that facilitates user installation of a new carousel of cartridges onto carousel hub 2814 and removal of a carousel with used cartridges from the carousel hub.

A central opening 4005 can also be seen in the cross-sectional view of FIG. 50. As shown, central opening 4005 may be a substantially cylindrical opening with a portion having slatted planar walls that together for a polygonal pattern 4007 that corresponds to the polygonal shape of carousel hub 2814.

Figure 52:
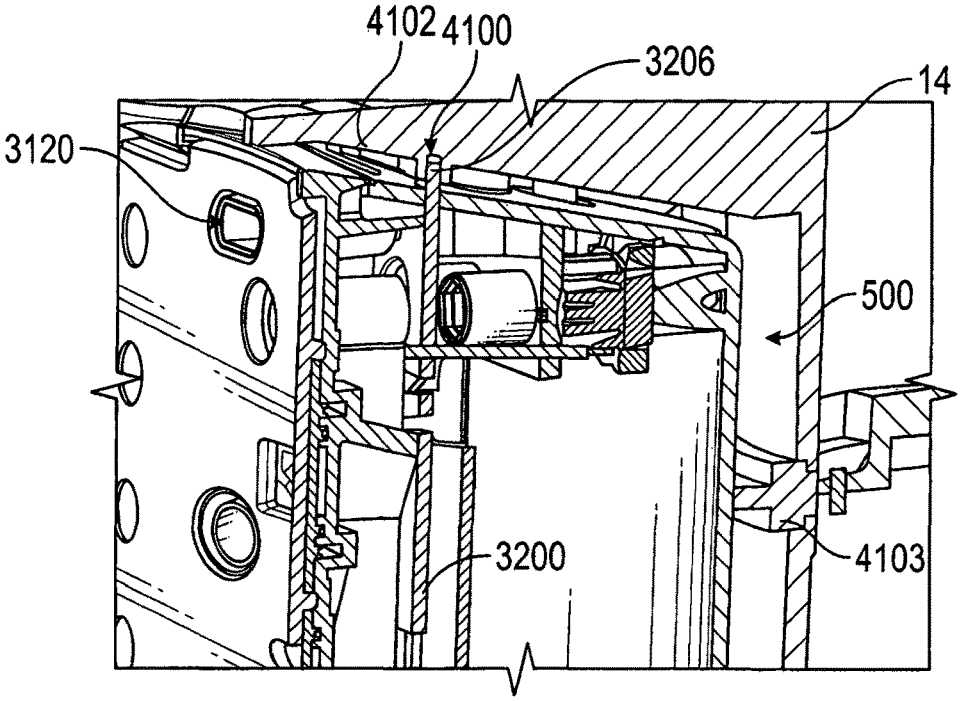
FIG. 52 illustrates a cross-sectional perspective view of a portion of the carousel of FIG. 50 showing backpack engagement features of the carousel in accordance with aspects of the present disclosure.

FIG. 52 is a cross-sectional perspective view of a portion of a cartridge and backpack assembly 3203 that is mounted to carousel 14. As shown in FIG. 52, carousel 14 may include an extended portion 4102 of top surface 4013 that extends over cartridge and backpack assembly 3203 in cartridge pocket 500 and includes a recess 4100 on an inner surface that is configured to receive protrusion 3206 of structure 3200 of cartridge and backpack assembly 3203 to secure cartridge and backpack assembly 3203 within pocket 500. Carousel 14 may also include structural members in pocket 500 such as a bumper member 4103 configured to help hold cartridge and backpack assembly 3203 in place when cartridge and backpack assembly 3203 is mounted in pocket 500. When it is desired to remove cartridge and backpack assembly 3203 from pocket 500 of carousel 14, protrusions 3206 may be lowered and thereby removed from recesses 4100 to allow cartridge and backpack assembly 3203 to move out of pocket 500. Protrusions 3206 may be lowered by deforming structure 3200 using, for example, bayonet 128.

Figure 53:
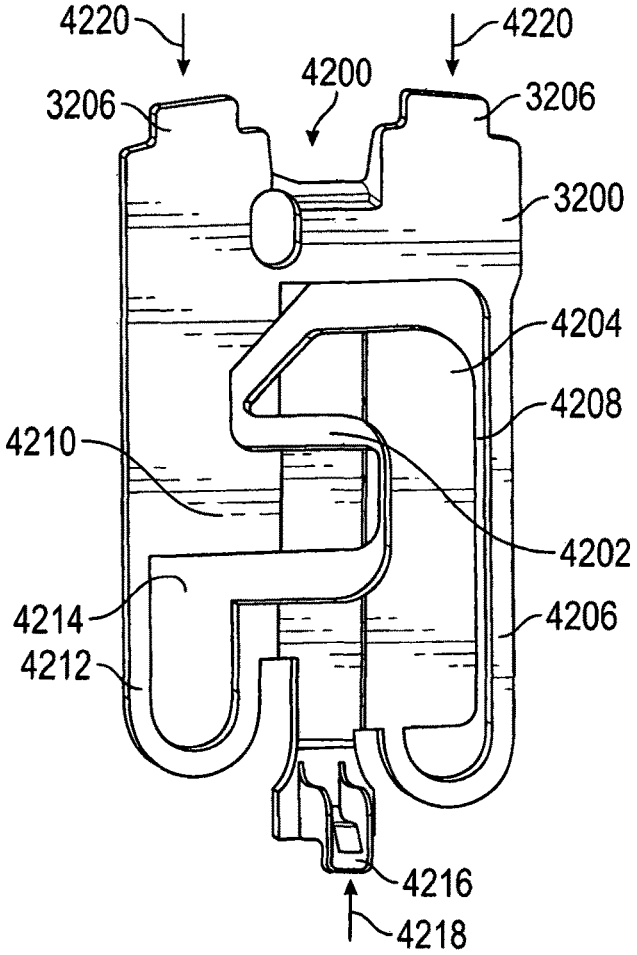
FIG. 53 illustrates a perspective view of a mounting member for a cartridge and backpack assembly in accordance with aspects of the present disclosure.

FIG. 53 shows a perspective view of structure 3200. As shown in FIG. 53, structure 3200 may be a patterned structure (e.g., a molded resiliently deformable plastic structure) having various features for facilitating mounting and removal of cartridge and backpack assembly 3203 to and from carousel 14. For example, structure 3200 may include a central opening 4202 configured to receive a portion of the bayonet that extends from the pump drive assembly through cartridge 16. When the bayonet is turned, portions of the bayonet may simultaneously bear against an upper structure 4204 and a lower structure 4210 of structure 3200. When the bayonet bears downward against lower structure 4210, lower structure 4210 may be moved downward and/or rotated by the bayonet such that lower structure 4210 pulls correspondingly downward on protrusions 3206 in order to lower protrusions 3206 (e.g., in direction 4220 of FIG. 53). When the bayonet simultaneously bears upward on upper structure 4204, upper structure 4204 may pull, via arms 4206 and 4212, correspondingly upward on latch structure 4216 (e.g., to raise the latch structure in direction 4218 of FIG. 53 and out of a corresponding recess in a bottom surface of the carousel).

In this way, protrusions 3206 and latch structure 4216 may be simultaneously retracted toward the center of structure 3200 (e.g., out of recess 4100 of cartridge 14) in order to release cartridge and backpack assembly 3203 from carousel 14. Latch structure 4216 may, for example, extend through an opening in backpack 3202 to engage a corresponding recess in cartridge pocket 500 when the cartridge and backpack assembly 3203 is mounted in the pocket.

Structure 3200 may also include a recess 4200 that forms a portion of opening 3120 to facilitate viewing of a connector 4002 stored within backpack 3202 as discussed herein. An opening 4208 may be formed in structure 3200 between arm 4206 and upper structure 4204. An opening 4214 may be formed in structure 3200 that extends from arm 4212 along lower structure 4210. Openings 4208 and 4214 may be a connected single opening that is patterned to form structures 4210, 4204, 4206 and 4212 that actuate protrusions 3206 and latch structure 4216 when structure 3200 is deformed.

Figure 54:
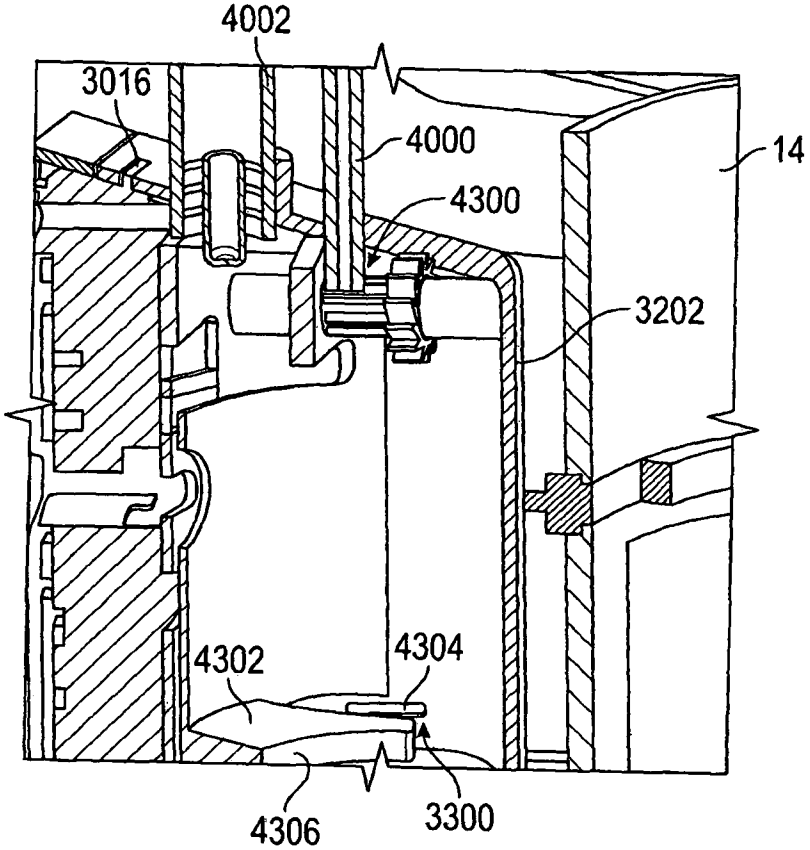
FIG. 54 illustrates a cross-sectional perspective view of the carousel and backpack of FIG. 50 showing tube management features of the backpack in accordance with aspects of the present disclosure.

FIG. 54 is a cross-sectional perspective view of another portion of a cartridge and backpack assembly 3203 that is mounted to carousel 14. As shown in FIG. 54, backpack 3202 may include a roller assembly 4300 that can be turned to actively drive tubing 4000 into or out of backpack 3202. For example, roller assembly 4300 may be turned in a first direction to extend tubing 4000 from within cavity 3300 or turned in an opposite second direction to retract tubing 4000 into cavity 3300. Roller assembly 4300 may be turned by an operator or automatically by a drive mechanism that extends from the pump drive assembly through cartridge 16 to backpack 3202. Roller assembly may be operated to retract tubing 4000 into the backpack when the connector 4002 is detected in the opening in backpack 3202. Cartridge and backpack assembly 3203 may also be released back into the carousel 14 when the connector 4002 is detected. Releasing cartridge and backpack assembly 3203 back into carousel 14 may include moving pump drive mechanism 20 forward toward the carousel until protrusion 3206 of the cartridge and backpack assembly is aligned with recess 4100 of carousel 14, turning bayonet 128 to raise protrusions 3206 into the recesses 4100, and moving the pump drive mechanism backward to withdraw the bayonet from opening 210 of the cartridge and backpack assembly. Ramp portion 5499 of cartridge 16 (e.g., within opening 210) can also be seen in FIG. 54 against which bayonet 128 may be rotated in a first direction to lift and pull the cartridge and backpack assembly 3203 from carousel 14 while bearing against structure 3200 in opening 4202. Turning the bayonet in an opposite, second direction may release the cartridge and backpack assembly and raise protrusions 3206.

As shown in FIG. 54, backpack 3202 may also include internal structures for managing the insertion and removal of tubing 4000. For example, a strain relief structure 4304 may be provided that at least partially covers a bottom portion of tubing 4000 so that a pull against tubing 4000 from outside of backpack 3202 will result in tubing 4000 bearing against strain relief structure 4304 rather than resulting in a pull along the length of the tubing that could undesirably detach the tubing from cartridge 16. Strain relief structure 4304 may, for example, be an integrally formed internal extension that extends from a sidewall of interior compartment 3300 in a direction substantially perpendicular to the direction in which tubing 4000 exits backpack 3202. Backpack 3202 may also include a guide structure 4302 having a curved internal surface 4306 that forms a curved surface against which tubing 4000 can be coiled.

Figure 55:
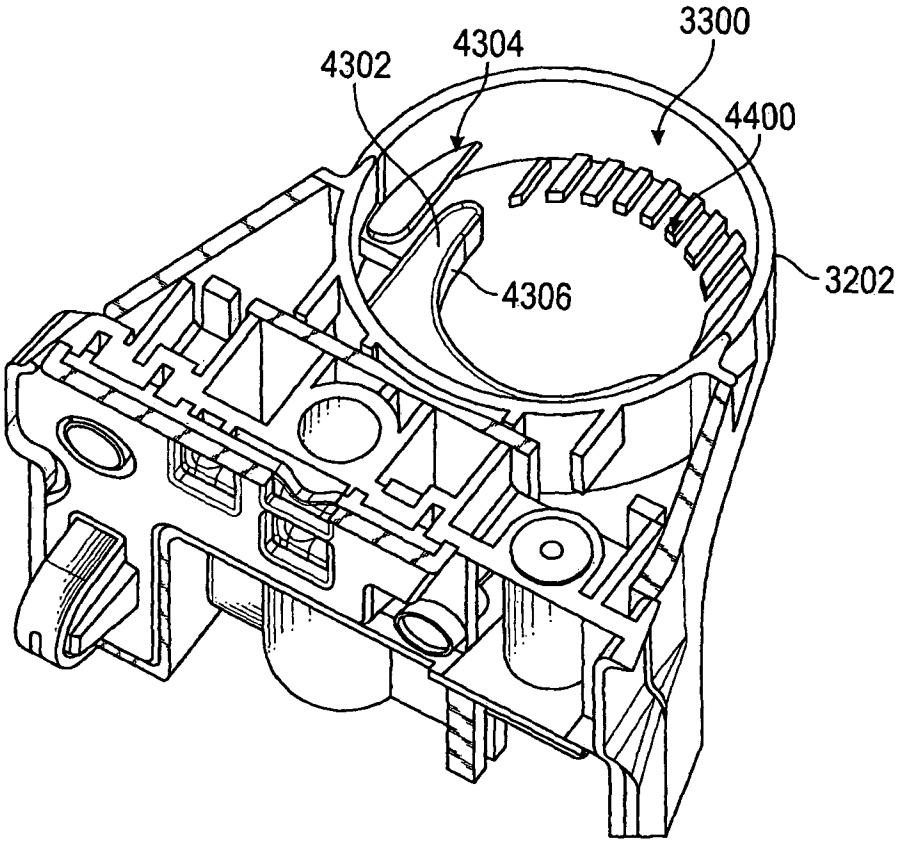
FIG. 55 illustrates a cross-sectional perspective view of a cartridge and backpack showing tube management features of the backpack in accordance with aspects of the present disclosure.

FIG. 55 is a cross-sectional top perspective view of cartridge and backpack assembly 3203 showing how a plurality of coil ramp extensions 4400 can be formed on a bottom surface of internal cavity 3300 to form a ramp that encourages coiling of tubing 4000 when tubing 4000 is inserted into cavity 3300. As shown, each ramp extension 4400 may each have a height. The height of each ramp extension may increase with distance from strain relief structure 4304 to form the desired coil ramp. Thus, when the tubing is retracted into the backpack, the tubing is stored in such a way that the tubing of various cartridge and backpack assemblies in a carousel do not become tangled or otherwise interfere with themselves or each other.

The subject technology is illustrated, for example, according to various aspects described above. Various examples of these aspects are described as numbered concepts or clauses (1, 2, 3, etc.) for convenience. These concepts or clauses are provided as examples and do not limit the subject technology. It is noted that any of the dependent concepts may be combined in any combination with each other or one or more other independent concepts, to form an independent concept. The following is a non-limiting summary of some concepts presented herein:

Concept 1. A carousel for a compounder system, the carousel comprising:

a cartridge pocket configured to receive a pump cartridge for the compounder system;

a top surface having a plurality of extensions configured to extend over the pump cartridge;

a bottom surface having an extension with a recess, the bottom surface recess configured to receive a needle housing of the pump cartridge; and a recess in the top surface configured to receive a protrusion that extends from a top surface of a backpack coupled to the pump cartridge to secure the pump cartridge in the cartridge pocket.

Concept 2. The carousel of Concept 1 or any other Concept, further comprising an additional recess in the top surface configured to accommodate a connector and tubing of the pump cartridge.

Concept 3. The carousel of Concept 2 or any other Concept, further comprising a central opening with a polygonal inner surface, wherein the polygonal inner surface has a shape that corresponds to a carousel hub of the compounder system.

Concept 4. The carousel of Concept 3 or any other Concept, further comprising a handle disposed over the central opening.

Concept 5. The carousel of Concept 3 or any other Concept, wherein the bottom surface recess has an additional bottom surface configured to prevent actuation of the needle housing of the pump cartridge and to collect any drug that may drip from the needle housing.

Concept 6. The carousel of Concept 1 or any other Concept, further comprising a plurality of additional cartridge pockets disposed about the periphery of the carousel.

Concept 7. The carousel of Concept 1 or any other Concept, wherein the cartridge pocket and the plurality of additional cartridge pockets comprises at least ten cartridge pockets disposed about the periphery.

Concept 8. A method, comprising:

providing a carousel having a plurality of cartridge pockets disposed about a periphery of the carousel;

providing a cartridge and backpack assembly in each cartridge pocket of the carousel; and providing the carousel having the cartridge and backpack assemblies onto a carousel hub of a compounder system.

Concept 9. The method of Concept 8 or any other Concept, further comprising retrieving a selected one of the cartridge and backpack assemblies from the carousel by extending a bayonet of a pump drive mechanism of the compounder system into an opening in the selected cartridge and backpack assembly and rotating the bayonet.

Concept 10. The method of Concept 9 or any other Concept, wherein rotating the bayonet comprises rotating a portion of the bayonet against a ramp structure disposed on a surface of an opening in a pump cartridge of the selected cartridge and backpack assembly to lift and pull the selected cartridge and backpack assembly from the carousel.

Concept 11. The method of Concept 10 or any other Concept, wherein rotating the bayonet further comprises rotating an additional portion of the bayonet against a deformable structure disposed between the pump cartridge and a backpack of the selected cartridge and backpack assembly and wherein rotating the additional portion of the bayonet against the deformable structure retracts latching structures of the deformable structure to release the selected cartridge and backpack assembly from the carousel.

Concept 12. The method of Concept 11 or any other Concept, further comprising rotating the carousel to align the bayonet of the pump drive mechanism of the compounder system with the opening in the selected cartridge and backpack assembly.

Concept 13. The method of Concept 12 or any other Concept, further comprising pumping a reconstituted drug through at least one controllable fluid pathway in the pump cartridge of the selected cartridge and backpack assembly and to a receiving container via tubing that extends from the pump cartridge through the backpack of the selected cartridge and backpack assembly.

Concept 14. A compounder system comprising:

a carousel hub having a shape;

a carousel comprising:

a plurality of cartridge pockets each configured to receive a pump cartridge; and a central opening having a shape that corresponds to the shape of the carousel hub; and a vial and carousel drive assembly configured to rotate the carousel hub to rotate the carousel to move a selected one of the pump cartridges to a position adjacent to a pump head assembly of the compounder system.

Concept 15. The compounder system of Concept 14 or any other Concept, further comprising the pump cartridges in the cartridge pockets.

Concept 16. The compounder system of Concept 15 or any other Concept, wherein each cartridge pocket of the carousel is further configured to receive a backpack attached to the pump cartridge in that pocket.

Concept 17. The compounder system of Concept 14 or any other Concept, further comprising a pump drive mechanism having the pump head assembly, wherein the pump head assembly comprises a plurality of operational components operable to pump a fluid through the selected one of the pump cartridges.

Concept 18. The compounder system of Concept 17 or any other Concept, wherein the pump head assembly further comprises a bayonet rotatable to release the selected pump cartridge with the attached backpack from the cartridge pocket.

Concept 19. The compounder system of Concept 18 or any other Concept, wherein the carousel further comprises:

a top surface having a plurality of extensions; and at least one recess in each extension configured to receive a latching mechanism formed on a structure disposed between each cartridge and the backpack attached to that cartridge to secure the pump cartridge and backpack in the cartridge pocket.

Concept 20. The compounder system of Concept 19 or any other Concept, wherein the carousel further comprises a bottom surface having a plurality of extensions each having a recess configured to receive a needle housing of one of the pump cartridges.

The present disclosure is provided to enable any person skilled in the art to practice the various aspects described herein. The disclosure provides various examples of the subject technology, and the subject technology is not limited to these examples. Various modifications to these aspects will be readily apparent to those skilled in the art, and the generic principles defined herein may be applied to other aspects.

One or more aspects or features of the subject matter described herein may be realized in digital electronic circuitry, integrated circuitry, specially designed ASICs (application specific integrated circuits), computer hardware, firmware, software, and/or combinations thereof. For example, infusion pump systems disclosed herein may include an electronic system with one or more processors embedded therein or coupled thereto. Such an electronic system may include various types of computer readable media and interfaces for various other types of computer readable media. Electronic system may include a bus, processing unit(s), a system memory, a read-only memory (ROM), a permanent storage device, an input device interface, an output device interface, and a network interface, for example.

Bus may collectively represent all system, peripheral, and chipset buses that communicatively connect the numerous internal devices of electronic system of an infusion pump system. For instance, bus may communicatively connect processing unit(s) with ROM, system memory, and permanent storage device. From these various memory units, processing unit(s) may retrieve instructions to execute and data to process in order to execute various processes. The processing unit(s) can be a single processor or a multi-core processor in different implementations.

A reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the invention.

The word "exemplary" is used herein to mean "serving as an example or illustration." Any aspect or design described herein as "exemplary" is not necessarily to be construed as preferred or advantageous over other aspects or designs. In one aspect, various alternative configurations and operations described herein may be considered to be at least equivalent.

As used herein, the phrase "at least one of" preceding a series of items, with the term "or" to separate any of the items, modifies the list as a whole, rather than each item of the list. The phrase "at least one of" does not require selection of at least one item; rather, the phrase allows a meaning that includes at least one of any one of the items, and/or at least one of any combination of the items, and/or at least one of each of the items. By way of example, the phrase "at least one of A, B, or C" may refer to: only A, only B, or only C; or any combination of A, B, and C.

A phrase such as an "aspect" does not imply that such aspect is essential to the subject technology or that such aspect applies to all configurations of the subject technology. A disclosure relating to an aspect may apply to all configurations, or one or more configurations. An aspect may provide one or more examples. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. An embodiment may provide one or more examples. A phrase such an embodiment may refer to one or more embodiments and vice versa. A phrase such as a "configuration" does not imply that such configuration is essential to the subject technology or that such configuration applies to all configurations of the subject technology. A disclosure relating to a configuration may apply to all configurations, or one or more configurations. A configuration may provide one or more examples. A phrase such a configuration may refer to one or more configurations and vice versa.

In one aspect, unless otherwise stated, all measurements, values, ratings, positions, magnitudes, sizes, and other specifications that are set forth in this specification, including in the claims that follow, are approximate, not exact. In one aspect, they are intended to have a reasonable range that is consistent with the functions to which they relate and with what is customary in the art to which they pertain.

It is understood that the specific order or hierarchy of steps, or operations in the processes or methods disclosed are illustrations of exemplary approaches. Based upon implementation preferences or scenarios, it is understood that the specific order or hierarchy of steps, operations or processes may be rearranged. Some of the steps, operations or processes may be performed simultaneously. In some implementation preferences or scenarios, certain operations may or may not be performed. Some or all of the steps, operations, or processes may be performed automatically, without the intervention of a user. The accompanying method claims present elements of the various steps, operations or processes in a sample order, and are not meant to be limited to the specific order or hierarchy presented.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112 (f) unless the element is expressly recited using the phrase "means for" or, in the case of a method claim, the element is recited using the phrase "step for." Furthermore, to the extent that the term "include," "have," or the like is used, such term is intended to be inclusive in a manner similar to the term "comprise" as "comprise" is interpreted when employed as a transitional word in a claim.

The Title, Background, Summary, Brief Description of the Drawings and Abstract of the disclosure are hereby incorporated into the disclosure and are provided as illustrative examples of the disclosure, not as restrictive descriptions. It is submitted with the understanding that they will not be used to limit the scope or meaning of the claims. In addition, in the Detailed Description, it can be seen that the description provides illustrative examples and the various features are grouped together in various embodiments for the purpose of streamlining the disclosure. This method of disclosure is not to be interpreted as reflecting an intention that the claimed subject matter requires more features than are expressly recited in each claim. Rather, as the following claims reflect, inventive subject matter lies in less than all features of a single disclosed configuration or operation. The following claims are hereby incorporated into the Detailed Description, with each claim standing on its own as a separately claimed subject matter.

The claims are not intended to be limited to the aspects described herein, but is to be accorded the full scope consistent with the language claims and to encompass all legal equivalents. Notwithstanding, none of the claims are intended to embrace subject matter that fails to satisfy the requirement of 35 U.S.C. § 101, 102, or 103, nor should they be interpreted in such a way.

What is claimed is:

1. A carousel for a compounder system, the carousel for use with a pump cartridge comprising a needle housing and a backpack having a protrusion extending from a top surface of the backpack, the carousel comprising:

a cartridge pocket to receive the pump cartridge for the compounder system;

a top surface having a plurality of extensions to extend over the pump cartridge;

a bottom surface having an extension with a recess, the bottom surface recess to receive the needle housing of the pump cartridge; and a recess in the top surface to receive the protrusion that extends from the top surface of the backpack coupled to the pump cartridge to secure the pump cartridge in the cartridge pocket.

2. The carousel of claim 1, wherein the pump cartridge further comprises a connector and tubing, the top surface having an additional recess in the top surface to permit the connector and tubing of the pump cartridge to extend above the top surface of the carousel.

3. The carousel of claim 2, further comprising a central opening with a polygonal inner surface, wherein the polygonal inner surface has a shape that corresponds to a carousel hub of the compounder system.

4. The carousel of claim 3, further comprising a handle disposed over the central opening.

5. The carousel of claim 3, wherein the bottom surface recess has an additional bottom surface configured to prevent actuation of the needle housing of the pump cartridge and to collect any drug that may drip from the needle housing.

6. The carousel of claim 1, further comprising a plurality of additional cartridge pockets disposed about the periphery of the carousel.

7. The carousel of claim 6, wherein the plurality of additional cartridge pockets comprises at least nine cartridge pockets disposed about the periphery.

8. The carousel of claim 1, wherein the extension of the bottom surface extends downwardly from the bottom surface.

* * * * *